US009017768B2

(12) United States Patent
Tomizaki et al.

(10) Patent No.: US 9,017,768 B2
(45) **Date of Patent: *Apr. 28, 2015**

(54) METHOD FOR FORMING MULTILAYER COATING FILM

(75) Inventors: Yasuhiro Tomizaki, Hiratsuka (JP); Takuya Kawachi, Hiratsuka (JP); Takahisa Ooya, Hiratsuka (JP)

(73) Assignee: Kansai Paint Co., Ltd., Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/999,781

(22) PCT Filed: Jun. 24, 2009

(86) PCT No.: PCT/JP2009/062022

§ 371 (c)(1),
(2), (4) Date: Dec. 17, 2010

(87) PCT Pub. No.: WO2009/157588

PCT Pub. Date: Dec. 30, 2009

(65) Prior Publication Data

US 2011/0111242 A1 May 12, 2011

(30) Foreign Application Priority Data

Jun. 24, 2008 (JP) ..... 2008-165133

(51) Int. Cl.
*B05D 7/14* (2006.01)
*B05D 7/00* (2006.01)

(52) U.S. Cl.
CPC *B05D 7/572* (2013.01); *B05D 7/14* (2013.01); *B05D 7/542* (2013.01); *B05D 2451/00* (2013.01)

(58) Field of Classification Search
None
See application file for complete search history.

(56) References Cited

U.S. PATENT DOCUMENTS

| | | | | |
|---|---|---|---|---|
| 8,575,259 | B2 * | 11/2013 | Tomizaki et al. | 524/504 |
| 2001/0024693 | A1 | 9/2001 | Morimoto et al. | |
| 2004/0134791 | A1 | 7/2004 | Toi et al. | |
| 2004/0228975 | A1 | 11/2004 | Takesako et al. | |

FOREIGN PATENT DOCUMENTS

| | | |
|---|---|---|
| EP | 0 554 780 | 8/1993 |
| EP | 1 788 049 | 5/2007 |
| EP | 2 087 944 | 8/2009 |
| JP | 8-290102 | 11/1996 |
| JP | 2001-205175 | 7/2001 |
| JP | 2004-358462 | 12/2004 |
| WO | 2004/061025 | 7/2004 |
| WO | 2007/026919 | 3/2007 |
| WO | 2007/046533 | 4/2007 |
| WO | WO 2007/046533 A2 * | 4/2007 |
| WO | 2009/014226 | 1/2009 |
| WO | 2009/075389 | 6/2009 |
| WO | 2009/116454 | 9/2009 |

OTHER PUBLICATIONS

International Search Report issued Nov. 16, 2009 in International (PCT) Application No. PCT/JP2009/062022.
PCT Written Opinion of the International Searching Authority issued Nov. 16, 2009 in International (PCT) Application No. PCT/JP2009/062022.

* cited by examiner

*Primary Examiner* — William Phillip Fletcher, III
(74) *Attorney, Agent, or Firm* — Wenderoth, Lind & Ponack, L.L.P.

(57) ABSTRACT

The invention offers methods for forming multilayer coating film excelling in smoothness, distinctness of image, water resistance and chipping resistance, the methods comprising successively applying onto a coating object a water-based first coloring paint and a water-based second coloring paint, and simultaneously heating and curing the resultant first colored coating film and second colored coating film, in which the water-based first coloring paint comprises hydroxy-containing polyester resin, curing agent, and water-dispersible acrylic resin which is obtained by polymerization of a monomer component comprising 30-100 mass % of C5-22 alkyl-containing polymerizable unsaturated monomer and 0-70 mass % of polymerizable unsaturated monomer other than the C5-22 alkyl-containing polymerizable unsaturated monomer.

10 Claims, No Drawings

METHOD FOR FORMING MULTILAYER COATING FILM

TECHNICAL FIELD

This invention relates to a method for forming multilayer coating film having excellent appearance and coated film performance, by multicoating water-based paints.

BACKGROUND ART

As coating film-forming methods on car bodies, those widely adopted comprise forming a multilayer coating film on an electrocoated and heat-cured coating object, by 3-coat-2-bake system in which application of intermediate paint→curing by baking→application of base coat paint→preheating (preliminary heating)→application of clear paint→curing by baking are successively conducted; or by 2-coat-2-bake system in which application of intermediate paint→curing by heating→application of top coat paint→baking by heating are successively conducted.

Generally the 3-coat-2-bake system is adopted when "metallic colored" coating film is to be formed using effect pigment-containing base coat paint, and the 2-coat-2-bake system is adopted in the occasions of forming "solid color" coating film such as of white, black or the like, using coloring pigment-containing top coat paint.

Whereas, from the viewpoint of energy-saving, investigations are made in recent years to omit the bake-curing step after application of intermediate paint and adopt 3-coat-1-bake system successively conducting application of intermediate paint→preheating (preliminary heating)→application of base coat paint→preheating (preliminary heating)→application of clear paint→curing by baking; or 2-coat-1-bake system successively conducting application of intermediate paint→preheating (preliminary heating)→application of top coat paint→curing by baking. In particular, from the viewpoint of reducing environmental pollution by volatilization of organic solvent, 3-coat-1-bake system and 2-coat-1-bake system using water-based paints as the intermediate paint, base coat paint and top coat paint are in demand.

However, in such 3-coat-1-bake system using water-based intermediate paint and water-based base coat paint or 2-coat-1-bake system using water-based intermediate paint and water-based top coat paint, decrease in water resistance of the formed coating film due to the use of water-soluble or water-dispersible resins or deterioration in smoothness and distinctness of image of the formed coating film due to layer-mixing at the interface between the water-based intermediate paint and water-based base coat paint or that between the water-based intermediate paint and water-based top coat paint are liable to take place, which has been the problem requiring solution.

For instance, JP Hei 8 (1996)-290102A discloses that finished appearance such as gloss or distinctness of image is not impaired in the method using thermosetting water-based intermediate paint (A), thermosetting water-based base coat (B) and thermosetting clear coat paint (C), which comprises wet-on-wet system coating of the water-based intermediate paint (A) and water-based base coat (B), when the neutralization value of the base resin of the water-based intermediate paint (A) is made 10-40 mgKOH/g and the neutralization value of the base resin of the water-based base coat paint (B) is made greater than that of the water-based paint (A) by 10-20. The multilayer coating film obtained by the coating method, however, occasionally has insufficient smoothness and water resistance.

JP 2001-205175A discloses that imbibing or inversion at the interface of coating film layers can be controlled to form laminated coating film of excellent appearance can be formed by a coating film-forming method comprising successively forming on an electrocoated substrate an intermediate coating film of a water-based intermediate paint, metallic base coating film of a water-based metallic base paint and clear coating film of a clear paint, in which the water-based intermediate paint contains aqueous dispersion of amido group-containing acrylic resin particles of a size ranging 0.01-1.0 μm, which is obtained by emulsion polymerization of amido group-containing ethylenically unsaturated monomer and other ethylenically unsaturated monomer. The multilayer film obtained by the coating film-forming method, however, occasionally has insufficient smoothness.

JP 2004-358462A discloses a process comprising (1) a step for providing electrocoated object; (2) a step for applying a water-based intermediate paint onto the electrocoated film to form an intermediate coating film; (3) a step for applying on the intermediate coating film without curing the same, successively a water-based base paint and clear paint wet-on-wet, to form a base coating film and clear coating film; and (4) a step for simultaneously baking and curing the intermediate coating film, base coating film and clear coating film, in which layer mixing between the intermediate coating film and the base coating film is effectively prevented and multilayer coating film excelling in surface smoothness can be formed when the water-based intermediate paint contains specific acrylic resin emulsion and urethane resin emulsion and the intermediate coating film formed of the intermediate paint has specific water absorption and water elution. The multilayer coating film obtained according to the multilayer coating film-forming process, however, also occasionally fails to develop satisfactory smoothness or distinctness of image.

International Publication WO2004/061025 Pamphlet discloses use as the intermediate paint in 3-coat-1-bake system a water-based intermediate paint composition comprising a copolymer resin emulsion and curing agent, the copolymer resin emulsion being obtained by emulsion polymerization of monomer (a) comprising at least one monomer selected from alkyl(meth)acrylates and, where necessary, at least one monomer selected from the group consisting of styrene monomer, (meth)acrylonitrile and (meth)acrylamide, acid group-containing polymerizable unsaturated monomer (b), hydroxy group-containing polymerizable unsaturated monomer (c) and crosslinkable monomer (d), said resin having a glass transition temperature of −50° C.-20° C., an acid value of 2-60 mgKOH/g and hydroxy value of 10-120 mgKOH/g. The Pamphlet states that curing reactability of the copolymer resin emulsion with the curing agent is whereby raised to enable formation of multilayer coating film exhibiting good chipping resistance, water resistance and favorable finished appearance. However, there are occasions that sufficient smoothness or distinctness of image are not achieved even by the multilayer coating film obtained by this multilayer coating film-forming method.

SUMMARY OF THE INVENTION

The object of the present invention is to provide a method which can form multilayer coating film excelling in water resistance and chipping resistance and also in smoothness and distinctness of image by suppressing layer mixing between water-based paints which are multicoated to form the multilayer coating film.

As a result of concentrative studies, we have now discovered that the above object can be accomplished by the use of a water-based paint composition containing hydroxy-containing polyester resin, curing agent and specific water-dispersible acrylic resin, and come to complete the present invention.

Thus, the present invention offers a multilayer coating film-forming method comprising successively carrying out the following steps (1)-(4), step (1): a step of applying a water-based first coloring paint (X) onto a coating object to form a first colored coating film, step (2): a step of applying a water-based second coloring paint (Y) onto the uncured first colored coating film as formed in the step (1) to form a second colored coating film, step (3): a step of applying a clear paint (Z) onto the uncured second colored coating film as formed in the step (2) to form a clear coating film, and step (4): a step of heating to simultaneously cure the uncured first colored coating film, uncured second colored coating film and the uncured clear coating film as formed in the steps (1)-(3), characterized in that the water-based first coloring paint (X) contains (A) a hydroxy-containing polyester resin, (B) a curing agent and (C) a water-dispersible acrylic resin which is obtained by polymerizing a monomer component comprising 30-100 mass % of $C_{5-22}$ alkyl-containing polymerizable unsaturated monomer (c-1), and 0-70 mass % of polymerizable unsaturated monomer (c-2) other than the polymerizable unsaturated monomer (c-1).

The invention also offers a multilayer coating film-forming method comprising successively carrying out the following steps (1), (2) and (5), step (1): a step of applying a water-based first coloring paint (X) onto a coating object to form a first colored coating film, step (2): a step of applying a water-based second coloring paint (Y) onto the uncured first colored coating film as formed in the step (1) to form a second colored coating film, and step (5): a step of heating to simultaneously cure the uncured first colored coating film and uncured second colored coating film as formed in the steps (1) and (2), characterized in that the water-based first coloring paint (X) contains (A) a hydroxy-containing polyester resin, (B) a curing agent and (C) a water-dispersible acrylic resin which is obtained by polymerizing a monomer component comprising 30-100 mass % of $C_{5-22}$ alkyl-containing polymerizable unsaturated monomer (c-1), and 0-70 mass % of polymerizable unsaturated monomer (c-2) other than the polymerizable unsaturated monomer (c-1).

According to the methods of the present invention, multilayer coating film excelling in smoothness, distinctness of image, water resistance and chipping resistance can be formed by multicoating water-based paints.

Hereinafter the multilayer coating film-forming methods of the present invention are explained in further details.

EMBODIMENTS FOR WORKING THE INVENTION

Step (1):

According to the multilayer coating film-forming methods of the present invention, first a water-based coloring paint (X) is applied onto a coating object, the paint (X) containing (A) a hydroxy-containing polyester resin, (B) a curing agent and (C) a water-dispersible acrylic resin which is obtained by polymerizing a monomer component comprising 30-100 mass % of $C_{5-22}$ alkyl-containing polymerizable unsaturated monomer (c-1), and 0-70 mass % of polymerizable unsaturated monomer (c-2) other than the polymerizable unsaturated monomer (c-1).

Coating Objects

Coating objects to which the water-based first coloring paint (X) is applicable according to the present invention are not particularly limited and, for example, outer panel portions of car bodies such as of automobiles, trucks, motorcycles, buses and the like: car parts such as bumpers; outer panel portions of house electric appliances such as mobile phones, audio instruments and the like can be named. Of these, outer panel portions of cars and car parts are preferred.

Materials of such coating objects are not particularly limited and include, for example, metallic materials such as iron, aluminium, brass, copper, tin plate, stainless steel, zinc-plated steel, zinc alloys (Zn—Al, Zn—Ni, Zn—Fe and the like), and plated steel; plastic materials such as resins, e.g., poyethylene resin, polypropylene resin, acrylonitrile-butadiene-styrene (ABS) resin, polyamide resin, acrylic resin, vinylidene chloride resin, polycarbonate resin, polyurethane resin and epoxy resin, and various FRP's; inorganic materials such as glass, cement, concrete and the like; wood; and fibrous materials such as paper, cloth and the like. Of these, metallic materials and plastic materials are preferred.

The coating objects may also be metallic surfaces of such metallic substrates as outer panel portions of car bodies, house electric appliances, sheet steel constituting the foregoing and the like, said surfaces having been given a surface treatment such as phosphate treatment, chromate treatment, complex oxide treatment or the like. Furthermore, the coating objects may be such metallic surfaces on which an undercoat film and/or intermediate coat film is formed. Of these, car bodies onto which an undercoat film has been applied with electrodeposition paint are preferred, car bodies onto which an undercoat film has been applied with a cationic electrodeposition paint being particularly preferred.

Hydroxy-Containing Polyester Resin (A)

As the hydroxy-containing polyester resin (A) used in the water-based first coloring paint (X) following the present invention, those water-soluble or water-dispersible hydroxy-containing polyester resins which are known per se and have been used for water-based paint can be used. The hydroxy-containing polyester resin (A) can also optionally contain, besides hydroxy group, crosslinkable functional groups such as carboxy, epoxy and the like.

The hydroxy-containing polyester resin (A) can be usually prepared by esterification reaction or ester-interchange reaction of an acid component with an alcohol component.

As the acid component, those compounds customarily used as acid component in production of polyester resins can be similarly used, examples of which include aliphatic polybasic acid, alicyclic polybasic acid and aromatic polybasic acid.

The aliphatic polybasic acid encompasses aliphatic compounds having at least two carboxy groups per molecule, acid anhydrides of the aliphatic compounds and esters of the aliphatic compounds, for example, aliphatic polyvalent carboxylic acids such as succinic acid, glutaric acid, adipic acid, pimelic acid, suberic acid, azelaic acid, sebacic acid, undecanedioic acid, dodecanedioic acid, brassylic acid, octadecanedioic acid and cytric acid; anhydrides of those aliphatic polyvalent carboxylic acids; and around $C_{1-4}$ lower alkyl esters of those aliphatic polyvalent carboxylic acids. Those aliphatic polybasic acids can be used either alone or in combination of two or more.

From the viewpoint of smoothness of resulting coating film, use of adipic acid and/or adipic anhydride as the aliphatic polybasic acid is particularly preferred.

The alicyclic polybasic acid encompasses compounds having at least one alicyclic structure and at least two carboxy groups per molecule, acid anhydrides of the compounds and esters of the compounds. The alicyclic structure can be mainly 4- to 6-membered ring structure. As the alicyclic polybasic acid, for example, alicyclic polyvalent carboxylic acids such as 1,2-cyclohexanedicarboxylic acid, 1,3-cyclohexanedicarboxylic acid, 1,4-cyclohexanedicarboxylic acid, 4-cyclohexene-1,2-dicarboxylic acid, 3-methyl-1,2-cyclohexane dicarboxylic acid, 4-methyl-1,2-cyclohexanedicarboxylic acid, 1,2,4-cyclohexanetricarboxylic acid and 1,3,5-cyclohexanetricarboxylic acid; anhydrides of the alicyclic polyvalent carboxylic acids; and lower alkyl esters of the alicyclic polyvalent carboxylic acids, the lower alkyl containing around 1-4 carbon atoms, can be named. Those alicyclic polybasic acids can be used either alone or in combination of two or more.

As the alicyclic polybasic acid, use of 1,2-cyclohexanedicarboxylic acid, 1,2-cyclohexanedicarboxylic anhydride, 1,3-cyclohexanedicarboxylic acid, 1,4-cyclohexanedicarboxylic acid, 4-cyclohexene-1,2-dicarboxylic acid or 4-cyclohexene-1,2-dicarboxylic anhydride is preferred from the viewpoint of smoothness of resulting coating film. Of these, it is particularly preferred to use 1,2-cyclohexanedicarboxylic acid and/or 1,2-cyclohexanedicarboxylic anhydride.

The aromatic polybasic acid include aromatic compounds having at least two carboxy groups per molecule, acid anhydrides of the aromatic compounds and esters of the aromatic compounds, for example, aromatic polyvalent carboxylic acids such as phthalic acid, isophthalic acid, terephthalic acid, naphthalenedicarboxylic acid, 4,4'-biphenyldicarboxylic acid, trimellitic acid and pyromellitic acid; anhydrides of those aromatic polyvalent carboxylic acids; and lower alkyl esters of those aromatic polyvalent carboxylic acids, the lower alkyl containing around 1-4 carbon atoms. Above aromatic polybasic acids can be used either alone or in combination of two or more.

As the aromatic polybasic acid, use of phthalic acid, phthalic anhydride, isophthalic acid, trimellitic acid or trimellitic anhydride is preferred.

Acid components other than the above aliphatic polybasic acid, alicyclic polybasic acid and aromatic polybasic acid can also be used. Such acid components are not particularly limited. For example, fatty acids such as coconut oil fatty acid, cottonseed oil fatty acid, hempseed oil fatty acid, rice bran oil fatty acid, fish oil fatty acid, tall oil fatty acid, soybean oil fatty acid, linseed oil fatty acid, tung oil fatty acid, rape seed oil fatty acid, castor oil fatty acid, dehydrated castor oil fatty acid and safflower oil fatty acid; monocarboxylic acids such as lauric acid, myristic acid, palmitic acid, stearic acid, oleic acid, linoleic acid, linolenic acid, benzoic acid, p-tert-butylbenzoic acid, cyclohexanoic acid and 10-phenyloctadecanoic acid; and hydroxycarboxylic acids such as lactic acid, 3-hydroxybutanoic acid and 3-hydroxy-4-ethoxybenzoic acid can be named. These acid components can be used either alone or in combination of two or more.

As the alcohol component, polyhydric alcohol having at least two hydroxy groups per molecule can be conveniently used, examples of which include dihydric alcohols such as ethylene glycol, propylene glycol, diethylene glycol, trimethylene glycol, tetraethylene glycol, triethylene glycol, dipropylene glycol, 1,4-butanediol, 1,3-butanediol, 2,3-butanediol, 1,2-butanediol, 3-methyl-1,2-butanediol, 2-butyl-2-ethyl-1,3-propanediol, 1,2-pentanediol, 1,5-pentanediol, 1,4-pentanediol, 2,4-pentanediol, 2,3-dimethyltrimethylene glycol, tetramethylene glycol, 3-methyl-4,3-pentanediol, 3-methyl-1,5-pentanediol, 2,2,4-trimethyl-1,3-pentanediol, 1,6-hexanediol, 1,5-hexanediol, 1,4-hexanediol, 2,5-hexanediol, neopentyl glycol, 1,4-cyclohexanedimethanol, tricyclodecanedimethanol, hydrogenated bisphenol A, hydrogenated bisphenol F and dimethylolpropionic acid; polylactonediols formed by adding lactones such as ϵ-caprolactone to these dihydric alcohols; ester diols such as bis(hydroxyethyl)terephthalate; polyether diols such as alkylene oxide adduct of bisphenol A, polyethylene glycol, polypropylene glycol and polybutylene glycol; tri- or higher-hydric alcohols such as glycerin, trimethylolethane, trimethylolpropane, diglycerin, triglycerin, 1,2,6-hexanetriol, pentaerythritol, dipentaerythritol, tris(2-hydroxyethyl)isocyanuric acid, sorbitol and mannitol; and polylactonepolyols formed by adding lactones such as ϵ-caprolactone to these tri- or higher-hydric alcohols.

Alcohol component other than the above polyhydric alcohols can also be used without particular limitation, which include, for example, monoalcohols such as methanol, ethanol, propyl alcohol, butyl alcohol, stearyl alcohol and 2-phenoxyethanol; and alcoholic compounds obtained by reaction of monoepoxy compounds such as propylene oxide, butylene oxide, CARDURA E10 (tradename, HEXION Specialty Chemicals Co., a glycidyl ester of synthetic highly branched saturated fatty acid) with acids.

Production method of hydroxy-containing polyester resin (A) is not critical, but convertional methods can be used. For example, a hydroxy-containing polyester resin can be prepared heating the above-described acid component and alcohol component in gaseous nitrogen current, at temperatures ranging about 150-250° C. for about 5-10 hours to carry out an esterification reaction or ester-interchange reaction of the acid component with the alcohol component.

In the occasion of the esterification or ester-interchange reaction of the acid component with the alcohol component, they may be added to the reactor all at once, or either one or both components may be added as divided portions plural times. After synthesizing a hydroxy-containing polyester resin first, the resulting hydroxy-containing polyester resin may be reacted with an acid anhydride to be half-esterified, whereby forming a carboxy- and hydroxy-containing polyester resin. Again, a carboxy-containing polyester resin may be synthesized first, to which then above alcohol component is added to provide a hydroxy-containing polyester resin.

In the occasion of the esterification or ester-interchange reaction, per se known catalyst such as dibutyltin oxide, antimony trioxide, zinc acetate, manganese acetate, cobalt acetate, calcium acetate, lead acetate, tetrabutyl titanate, tetraisopropyl titanate and the like may be used as a catalyst for promoting the reaction.

The hydroxy-containing polyester resin (A) may also be modified, either during or after preparation of the resin, with fatty acid, monoepoxy compound, polyisocyanate compound or the like.

As the fatty acid, for example, coconut oil fatty acid, cottonseed oil fatty acid, hempseed oil fatty acid, rice bran oil fatty acid, fish oil fatty acid, tall oil fatty acid, soybean oil fatty acid, linseed oil fatty acid, tung oil fatty acid, rape seed oil fatty acid, castor oil fatty acid, dehydrated castor oil fatty acid and safflower oil fatty acid can be named; and as the monoepoxy compound, for example, CARDURA (tradename, HEXION Specialty Chemicals Co., a glycidyl ester of synthetic highly branched saturated fatty acid) can be favorably used.

As the polyisocyanate compound, for example, aliphatic diisocyanates such as lysine diisocyanate, hexamethylene diisocyanate and trimethylhexane diisocyanate; alicyclic diisocyanates such as hydrogenated xylylene diisocyanate, isophorone diisocyanate, methylcyclohexane-2,4-diisocyanate, methylcyclohexane-2,6-diisocyanate, 4,4'-methylenebis-(cyclohexylisocyanate) and 1,3-(isocyanatomethyl) cyclohexane; aromatic diisocyanates such as tolylene diisocyanate, xylylene diisocyanate and diphenylmethane diisocyanate; organic polyisocyanates themselves such as tri- or higher-valent polyisocyanates like lysine triisocyanate; adducts of each of these organic polyisocyanates with polyhydric alcohol, low molecular weight polyester resin, water or the like; or mutually cyclized polymers of these organic polyisocyanates (e.g., isocyanurates) and biuret type adducts can be named. These polyisocyanate compounds can be used either alone or in combination of two or more.

In the hydroxy-containing polyester resin (A), preferably the combined content of aliphatic polybasic acid and alicyclic polybasic acid in the starting acid component lies within a range of generally 30-100 mol %, in particular, 40-97 mol %, inter alia, 50-80 mol %, based on the total amount of the acid component, from the viewpoint of excellent smoothness, distinctness of image and chipping resistance of resulting coating film. Particularly for chipping resistance of the coating film, it is preferred that the aliphatic polybasic acid is adipic acid and/or adipic anhydride, and the alicyclic polybasic acid is 1,2-cyclohexanedicarboxylic acid and/or 1,2-cyclohexanedicarboxylic anhydride.

The hydroxy-containing polyester resin (A) can have a hydroxy value within a range of generally 10-300 mgKOH/g, in particular, 50-250 mgKOH/g, inter alia, 80-180 mgKOH/g. Where the hydroxy-containing polyester resin (A) has also carboxy groups, it can have an acid value within a range of generally 1-200 mgKOH/g, in particular, 15-100 mgKOH/g, inter alia, 20-60 mgKOH/g. Furthermore, the hydroxy-containing polyester resin (A) can have a number-average molecular weight within a range of generally 500-50,000, in particular, 1,000-30,000, inter alia, 1,200-10,000.

In the present specification, "number-average molecular weight" and "weight-average molecular weight" are the values obtained by converting the number-average molecular weight or weight-average molecular weight as measured with gel permeation chromatograph (GPC), using the molecular weight of standard polystyrene as the basis.

Curing Agent (B)

The curing agent (B) to be used in the water-based first coloring paint (X) following the present invention is a compound which can react with the crosslinkable functional groups which may be present in the hydroxy-containing polyester resin (A) such as hydroxy, carboxy, epoxy and the like, to cure the water-based first coloring paint (X). As the curing agent (B), for example, amino resin, polyisocyanate compound, blocked polyisocyanate compound, epoxy-containing compound, carboxy-containing compound, carbodiimido group-containing compound and the like can be named. Of these, amino resin, polyisocyanate compound and blocked polyisocyanate compound which are reactable with hydroxy group; and carbodiimido group-containing compound reactable with carboxy group are preferred. From the viewpoint of storage stability of the paint, amino resin is particularly preferred. The curing agents (B) can be used each alone or in combination of two or more.

As the amino resin, partially methylolated amino resin or wholly methylolated amino resin obtained through a reaction of amino component with aldehyde component can be used. Examples of the amino component include melamine, urea, benzoguanamine, acetoguanamine, steroguanamine, spiroguanamine, dicyandiamide; and also as the aldehyde component, for example, formaldehyde, paraformaldehyde, acetaldehyde, benzaldehyde and the like can be named.

As the amino resin, those formed by partially or wholly etherifying those methylol groups in the methylolated amino resins with suitable alcohol can be used. As the alcohol to be used for the etherification, for example, methyl alcohol, ethyl alcohol, n-propyl alcohol, i-propyl alcohol, n-butyl alcohol, i-butyl alcohol, 2-ethyl-1-butanol, 2-ethyl-1-hexanol and the like can be named.

As the amino resin, melamine resin is preferred. In particular, methyl-etherified melamine resin formed by partially or wholly etherifying methylol groups in partially or wholly methylolated melamine resin with methyl alcohol; butyl-etherified melamine resin formed by partially or wholly etherifying methylol groups in partially or wholly methylolated melamine resin with butyl alcohol; and methyl-butyl mixed-etherified melamine resin formed by partially or wholly etherifying methylol groups in partially or wholly methylolated melamine resin with methyl alcohol and butyl alcohol; are preferred. In particular, methyl-butyl mixed-etherified melamine resin is preferred.

It is particularly advantageous for the water-based first coloring paint (X) to use, as the hydroxy-containing polyester resin (A), hydroxy-containing polyester resin (A1) in which the combined content of the aliphatic polybasic acid and alicyclic polybasic acid in the starting acid component is 30-97 mol % and the content of the aromatic polybasic acid is 3-70 mol %, based on the total amount of the acid component; and to use as the curing agent (B) at least one of alkyl-etherified melamine resin among the methyl-etherified melamine resin, butyl-etherified melamine resin and methyl-butyl mixed-etherified melamine resin; for obtaining multilayer coating film of excellent distinctness of image and water resistance.

The melamine resin also preferably has a weight-average molecular weight within a range of normally 400-6,000, in particular, 500-4,000, inter alia, 600-3,000.

Commercially available melamine resins are also useful, examples of which include CYMEL 202, CYMEL 203, CYMEL 204, CYMEL 211, CYMEL 238, CYMEL 251, CYMEL 303, CYMEL 323, CYMEL 324, CYMEL 325, CYMEL 327, CYMEL 350, CYMEL 385, CYMEL 1156, CYMEL 1158, CYMEL 1116 and CYMEL 1130 (Nippon Cytec Industries, Inc.); U-VAN 120, U-VAN 20HS, U-VAN 20SE60, U-VAN 2021, U-VAN 2028, and U-VAN 28-60 (Mitsui Chemicals, Inc.).

When melamine resin is used as the curing agent (B), sulfonic acids such as para-toluenesulfonic acid, dodecylbenzenesulfonic acid and dinonylnaphthalenesulfonic acid; alkyl phosphoric acid esters such as monobutyl phosphate, dibutyl phosphate, mono-2-ethylhexyl phosphate, di-2-ethylhexyl phosphate and the like; and salts of these acids with amine can be used as the catalyst.

The polyisocyanate compounds are those compounds which contain at least two isocyanate groups per molecule, for example, aliphatic polyisocyanate, alicyclic polyisocyanate, aromatic-aliphatic polyisocyanate, aromatic polyisocyanate and derivatives of these polyisocyanates.

Examples of the aliphatic polyisocyanate include aliphatic diisocyanates such as trimethylene diisocyanate, tetramethylene diisocyanate, hexamethylene diisocyanate, pentamethylene diisocyanate, 1,2-propylene diisocyanate, 1,2-butylene diisocyanate, 2,3-butylene diisocyanate, 1,3-butylene diisocyanate, 2,4,4- or 2,2,4-trimethylhexamethylene diisocyanate, dimeric acid diisocyanate, methyl 2,6-diisocyanatohexanoate (common name: lysine diisocyanate) and the like; and aliphatic triisocyanates such as 2-isocyanatoethyl 2,6-diisocyanatohexanoate, 1,6-diisocyanato-3-isocyanatomethylhexane, 1,4,8-triisocyanatooctane, 1,6,11-triisocyanatoundecane, 1,8-diisocyanato-4-isocyanatomethyloctane, 1,3,6-triisocyanatohexane, 2,5,7-trimethyl-1,8-diisocyanato-5-isocyanatomethyloctane and the like.

Examples of the alicyclic polyisocyanate include alicyclic diisocyanates such as 1,3-cyclopentene diisocyanate, 1,4-cyclohexane diisocyanate, 1,3-cyclohexane diisocyanate, 3-isocyanatomethyl-3,5,5-trimethylcylohexyl isocyanate (common name: isophorone diisocyanate), methyl-2,4-cyclohexane diisocyanate, methyl-2,6-cyclohexane diisocyanate, 1,3- or 1,4-bis(isocyanato-methyl)cyclohexane (common name: hydrogenated xylylene diisocyanate) or mixtures thereof, norbornane diisocyanate and the like; and alicyclic triisocyanates such as 1,3,5-triisocyanatocyclo-hexane, 1,3,5-trimethylisocyanatocyclohexane, 2-(3-isocyanatopropyl)-2,5-di(isocyanatomethyl)-bicyclo(2.2.1)heptane, 2-(3-isocyanatopropyl)-2,6-di(isocyanatomethyl)-bicyclo(2.2.1)heptane, 3-(3-isocyanatopropyl)-2,5-di(isocyanatomethyl)-bicyclo(2.2.1)heptane, 5-(2-isocyanatoethyl)-2-isocyanatomethyl-3-(3-isocyanatopropyl)-bicyclo(2.2.1)heptane, 6-(2-isocyanatoethyl)-2-isocyanatomethyl-3-(3-isocyana to propyl)-bicyclo(2.2.1)heptane, 5-(2-isocyanatoethyl)-2-isocyanatomethyl-2-(3-isocyanatopropyl)-bicyclo(2.2.1)heptane, 6-(2-isocyanatoethyl)-2-isocyanatomethyl-2-(3-isocyanatopropyl)-bicyclo(2.2.1)heptane and the like.

Examples of the aromatic-aliphatic polyisocyanate include aromatic-aliphatic diisocyanates such as 1,3- or 1,4-xylylene diisocyanate or mixtures thereof, ω,ω'-diisocyanato-1,4-diethylbenzene, 1,3- or 1,4-bis(1-isocyanato-1-methylethyl) benzene (common name: tetramethylxylylene diisocyanate) or mixtures thereof; and aromoatic-aliphatic triisocyanates such as 1,3,5-triisocyanatomethylbenzene and the like.

Examples of the aromatic polyisocyanate include aromatic diisocyanates such as m-phenylene diisocyanate, p-phenylene diisocyanate, 4,4'-diphenyl diisocyanate, 1,5-naphthalene diisocyanate, 2,4'- or 4,4'-diphenylmethane diisocyanate or mixtures thereof, 2,4- or 2,6-tolylene diisocyanate or mixtures thereof, 4,4'-toluidine diisocyanate, 4,4'-diphenylether diisocyanate and the like; aromatic triisocyanates such as triphenylmethane-4,4',4"-triisocyanate, 1,3,5-triisocyanatobenzene, 2,4,6-triisocyanatotoluene and the like; and aromatic tetraisocyanates such as 4,4'-diphenylmethane-2,2',5,5'-tetraisocyanate and the like.

Also as the polyisocyanate derivatives, for example, dimers, trimers, biurets, allophanates, urethodiones, urethoimines, isocyanurates, oxadiazintrione, polymethylene polyphenyl polyisocyanate (crude MDI, polymeric MDI), crude TDI and the like of above polyisocyanate compounds can be named.

Above polyisocyanates and derivatives thereof can be used either alone or in combination of two or more. It is preferable to use, either singly or in combination of two or more, aliphatic diisocyanates, alicyclic diisocyanates and their derivatives, among these polyisocyanates.

It is also possible to use, as the polyisocyanate compound, to prepolymers formed by urethanation reaction of above polyisocyanates or derivatives thereof with polyhydric alcohol, low molecular weight polyester resin or water, under a condition that the isocyanate groups are in excess.

As the polyisocyanate compound, use of water-dispersible polyisocyanate compound is preferred from the viewpoint of smoothness of resultant coating film. While any polyisocyanate compound which can be stably dispersed in an aqueous medium can be used as the water-dispersible polyisocyanate compound without limitation, particularly such hydrophilic polyisocyanate compound which has been modified to be imparted with hydrophilicity, or polyisocyanate compound to which dispersibility in water is imparted by mixing it with a surfactant in advance, can be conveniently used.

As the hydrophilic polyisocyanate compound, for example, anionic hydrophilic polyisocyanate compound obtained through reaction of active hydrogen group in active hydrogen group-containing compound having anionic group with isocyanate group in the polyisocyanate compound; and nonionic hydrophilic polyisocyanate compound obtained through reaction of hydrophilic polyether alcohol such as monoalcohol of polyoxyethylene with polyisocyanate compound can be named, which can be used each alone or in combination of two or more.

Above active hydrogen group-containing compound having anionic group covers those compounds having anionic groups such as carboxy, sulfonic acid or phosphoric acid groups, and betaine structure-containing group, and also active hydrogen group reactable with isocyanate group, such as hydroxy, amino and the like groups. Through reaction of such a compound with polyisocyanate compound, hydrophilicity can be imparted to the polyisocyanate compound.

The active hydrogen group-containing compound having anionic group is not particularly limited and, for example, those compounds having one anionic group and at least two active hydrogen groups can be used. More specifically, examples of active hydrogen group-containing compound having carboxy group include dihydroxycarboxylic acids such as 2,2-dimethylolacetic acid, 2,2-dimethylollactic acid, 2,2-dimethylolpropionic acid, 2,2-dimethylolbutanoic acid, dimethylolheptanoic acid, dimethylolnonanoic acid, 2,2-dimethylolbutyric acid, 2,2-dimethylolvaleric acid and the like; diaminocarboxylic acids such as 1-carboxy-1,5-pentylenediamine, dihydroxybenzoic acid, 3,5-diaminobenzoic acid, lysine, alginine and the like; and half-ester compounds of polyoxypropylenetriol with maleic anhydride or phthalic anhydride.

Examples of active hydrogen group-containing compound having sulfonic acid group include N,N-bis(2-hydroxyethyl)-2-aminoethanesulfonic acid, 1,3-phenylenediamine-4,6-disulfonic acid, diaminobutanesulfonic acid, 3,6-diamino-2-toluenesulfonic acid, 2,4-diamino-5-toluenesulfonic acid, 2-(cyclohexylamino)-ethanesulfonic acid, 3-(cyclohexylamino)-propanesulfonic acid and the like.

Examples of active hydrogen group-containing compound having phosphoric acid group include 2,3-dihydroxypropylphenyl phosphate and the like.

Examples of active hydrogen group-containing compound having betaine structure-containing group include sulfobetaine group-containing compounds obtained through reaction of tertiary amine such as N-methyldiethanolamine with 1,3-propanesultone.

These active hydrogen group-containing compounds having anionic group can be converted to alkylene oxide-modified compounds, by addition of alkylene oxide such as ethylene oxide or propylene oxide.

These active hydrogen group-containing compounds having anionic group can be used either alone or in combination of two or more.

As the anionic hydrophilic polyisocyanate compound, use of the anionic hydrophilic polyisocyanate compound obtained by reaction of active hydrogen groups in active hydrogen group-containing compound having sulfonic acid group and/or phosphoric acid group with isocyanate groups of polyisocyanate compound is particularly preferred, from the viewpoint of smoothness of resulting coating film.

As polyisocyanate compounds which can be modified to be made hydrophilic, those polyisocyanate compounds listed in the above can be used, among which aliphatic diisocyanate, alicyclic diisocyanate and their derivatives are preferred, specific examples including hexamethylene diisocyanate (HMDI), derivatives of hexamethylene diisocyanate (HMDI), isophorone diisocyanate (IPDI) and derivatives of isophorone diisocyanate (IPDI).

In case of imparting water dispersibility to polyisocyanate compound by mixing it with surfactant in advance, anionic surfactant and/or nonionic surfactant are preferred as the surfactant, anionic surfactant being particularly preferred.

From the viewpoint of water resistance of resultant coating film, it is suitable to use the polyisocyanate compound at such a ratio that renders the equivalent ratio (NCO/OH) of isocyanate groups in the polyisocyanate compound to hydroxy groups in the hydroxy-containing polyester resin (A) to be within a range of normally 0.5-2.0, in particular, 0.8-1.5.

The blocked polyisocyanate compounds are those having at least two isocyanate groups per molecule, whose isocyanate groups are blocked with blocking agent.

Examples of the polyisocyanate compound having at least two isocyanate groups per molecule include aliphatic diisocyanates such as hexamethylene diisocyanate, trimethylhexamethylene diisocyanate, dimeric acid diisocyanate, lysine diisocyanate and the like; alicyclic diisocyanates such as hydrogenated xylylene diisocyanate, cyclohexylene diisocyanate, isophorone diisocyanate and the like; aromatic diisocyanates such as tolylene diisocyanate, phenylene diisocyanate, 4,4'-diphenylmethane diisocyanate, xylylene diisocyanate, tetramethylxylylene diisocyanate, naphthalene diisocyanate and the like; tri- or higher-valent organic polyisocyanate compounds such as 2-isocyanatoethyl-2,6-diisocyanatocaproate, 3-isocyanatomethyl-1,6-hexamethylene diisocyanate, 4-isocyanatomethyl-1,8-octamethylene diisocyanate (common name; triaminononane triisocyanate) and the like; dimers or trimers (biuret, isocyanurate and the like) of these polyisocyanate compounds; and prepolymers formed by urethanation reaction of these polyisocyanate compounds with polyhydric alcohol, low molecular weight polyester resin or water, under isocyanate group-excessive condition.

Examples of blocking agent include phenolic compounds such as phenol, cresol, xylenol, nitrophenol, ethylphenol, hydroxydiphenyl, butylphenol, isopropyiphenol, nonylphenol, octylphenol, methyl hydroxybenzoate and the like; lactam compounds such as ϵ-caprolactam, δ-valerolactam, γ-butyrolactam, β-propiolactam and the like; aliphatic alcoholic compounds such as methanol, ethanol, propyl alcohol, butyl alcohol, amyl alcohol, lauryl alcohol and the like; ether compounds such as ethylene glycol monomethyl ether, ethylene glycol monoethyl ether, ethylene glycol monobutyl ether, diethylene glycol monomethyl ether, diethylene glycol monoethyl ether, propylene glycol monomethyl ether, methoxymethanol and the like; alcoholic compounds such as benzyl alcohol, glycolic acid, methyl glycolate, ethyl glycolate, butyl glycolate, lactic acid, methyl lactate, ethyl lactate, butyl lactate, methylolurea, methylolmelamine, diacetone alcohol, 2-hydroxyethyl acrylate, 2-hydroxyethyl methacrylate and the like; oxime compounds such as formamidoxime, acetamidoxime, acetoxime, methyl ethyl ketoxime, diacetylmonooxime, benzophenone-oxime, cyclohexane-oxime and the like; active methylene compounds such as dimethyl malonate, diethyl malonate, ethyl acetoacetate, methyl acetoacetate, acetylacetone and the like; mercaptan compounds such as butyl mercaptan, t-butyl mercaptan, hexyl mercaptan, t-dodecyl mercaptan, 2-mercaptobenzothiazole, thiophenol, methylthiophenol, ethylthiophenol and the like; acid amide compounds such as acetanilide, acetanisidide, acetotoluide, acrylamide, methacrylamide, acetamide, stearamide, benzamide and the like; imide compounds such as succinimide, phathalimide, maleimide and the like; amine compounds such as diphenylamine, phenylnaphthylamine, xylidine, N-phenylxylidine, carbazole, aniline, naphthylamine, butylamine, dibutylamine, butylphenylamine and the like; urea compounds such as urea, thiourea, ethyleneurea, ethylenethiourea, diphenylurea and the like; carbamic acid ester compounds such as phenyl N-phenylcarbamate; imine compounds such as ethyleneimine, propyleneimine and the like; and sulfurous acid salt compounds such as sodium bisulfite, potassium bisulfite and the like; and azole compounds. Examples of azole compound include pyrazole or pyrazole derivatives such as pyrazole, 3,5-dimethylpyrazole, 3-methylpyrazole, 4-benzyl-3,5-dimethylpyrazole, 4-nitro-3,5-dimethylpyrazole, 4-bromo-3,5-dimethylpyrazole, 3-methyl-5-phenylpyrazole and the like; imidazole or imidazole derivatives such as imidazole, benzimidazole, 2-methylimidazole, 2-ethylimidazole, 2-phenylimidazole and the like; and imidazoline derivatives such as 2-methylimidazoline, 2-phenylimidazoline and the like.

Of these, preferred blocking agents are oximes, active methylenes and pyrazole or pyrazole derivatives.

As the blocking agent, hydroxycarboxylic acid which has at least one hydroxy group and at least one carboxy group, such as hydroxypivalic acid, dimethylolpropionic acid and the like can also be used. In particular, blocked polyisocyanate compounds which are rendered water-dispersible by blocking their isocyanate groups with the hydroxycarboxylic acid and thereafter neutralizing the carboxy group(s) in the hydroxycarboxylic acid can be conveniently used.

As the carbodiimido-containing compound, for example, those formed by mutual de-carbon dioxide reaction of isocyanate groups in the polyisocyanate compounds can be used. As the carbodiimido-containing compounds, use of polycarbodiimide compounds having at least two carbodiimido groups per molecule is preferred.

Use of water-soluble or water-dispersible polycarbodiimide compound as the polycarbodiimide compound is preferred from the viewpoint of smoothness of resultant coating film. As such water-soluble or water-dispersible polycarbodiimide compound, any polycarbodiimide compound which is stably soluble or dispersible in aqueous medium can be used without particular limitation.

Specific examples of water-soluble polycarbodiimide compound include CARBODILITE SV-02, CARBODILITE V-02, CARBODILITE V-02-L2 and CARBODILITE V-04 (tradename, Nisshinbo Industires, Inc.). Also as the water-dispersible polycarbodiimide compound, for example, CARBODILITE E-01 and CARBODILITE E-02 (tradename, Nisshinbo Industries, Inc.) can be used.

Above polycarbodiimide compounds can be used either alone or in combination of two or more.

Water-Dispersible Acrylic Resin (C)

The water-dispersible acrylic resin (C) to be used in the water-based first coloring paint (X) can be obtained by polymerizing a monomer component comprising 30-100 mass % of $C_{5-22}$ alkyl-containing polymerizable unsaturated monomer (c-1) and 0-70 mass % of polymerizable unsaturated monomer (c-2) other than the polymerizable unsaturated monomer (c-1).

Examples of the $C_{5-22}$ alkyl-containing polymerizable unsaturated monomer (c-1) include alkyl or cycloalkyl(meth) acrylates such as pentyl(meth)acrylate, hexyl(meth)acrylate, octyl(meth)acrylate, 2-ethylhexyl(meth)acrylate, nonyl (meth)acrylate, tridecyl(meth)acrylate, lauryl(meth)acrylate, stearyl(meth)acrylate, isostearyl(meth)acrylate, cyclohexyl (meth)acrylate, methylcyclohexyl(meth)acrylate, t-butylcyclohexyl(meth)acrylate, cyclododecyl(meth)acrylate, isobornyl(meth)acrylate, adamantyl(meth)acrylate, tricyclodecanyl(meth)acrylate and the like. These monomers can be used either alone or in combination of two or more.

As the $C_{5-22}$ alkyl-containing polymerizable unsaturated monomer (c-1), those particularly preferred are $C_{6-18}$ alkyl-containing polymerizable unsaturated monomers, inter alia, $C_{8-13}$ alkyl-containing polymerizable unsaturated monomers. From the viewpoint of smoothness of formed coating film, 2-ethylhexyl acrylate, dodecyl methacrylate and tridecyl methacrylate, in particular, 2-ethylhexyl acrylate, are preferred.

The use ratio of the $C_{5-22}$ alkyl-containing polymerizable unsaturated monomer (c-1) in the water-dispersible acrylic resin (C) preferably is within a range of 30-100 mass %, in particular, 45-100 mass %, inter alia, 60-100 mass %, based on the combined amount of the $C_{5-22}$ alkyl-containing polymerizable unsaturated monomer (c-1) and the polymerizable unsaturated monomer (c-2) other than the polymerizable unsaturated monomer (c-1), from the viewpoint of smoothness and distinctness of image of formed coating film.

As the polymerizable unsaturated monomer (c-2) other than the polymerizable unsaturated monomer (c-1), for example, $C_{1-4}$ alkyl-containing alkyl(meth)acrylates such as methyl(meth)acrylate, ethyl(meth)acrylate, n-propyl(meth) acrylate, iso-propyl(meth)acrylate, n-butyl(meth)acrylate, iso-butyl(meth)acrylate, tert-butyl(meth)acrylate and the like; aromatic ring-containing polymerizable unsaturated monomers such as benzyl(meth)acrylate, styrene, α-methylstyrene and vinyltoluene; alkoxysilyl group-containing polymerizable unsaturated monomers such as vinyl trimethoxysilane, vinyl triethoxysilane, vinyl tris(2-methoxyethoxy) silane, γ-(meth)acryloyloxypropyl trimethoxysilane and γ-(meth)acryloyloxypropyl triethoxysilane; perfluoroalkyl (meth)acrylates such as perfluorobutylethyl(meth)acrylate and perfluorooctylethyl(meth)acrylate; fluorinated alkyl group-containing polymerizable unsaturated monomers such as fluoroolefin; polymerizable unsaturated monomers having photo-polymerizable functional group such as maleimide group; vinyl compounds such as N-vinylpyrrolidone, ethylene, butadiene, chloroprene, vinyl propionate and vinyl acetate; hydroxy-containing polymerizable unsaturated monomers such as monoesters of (meth)acrylic acid with $C_{2-8}$ dihydric alcohol such as 2-hydroxyethyl(meth)acrylate, 2-hydroxypropyl(meth)acrylate, 3-hydroxypropyl(meth) acrylate and 4-hydroxybutyl(meth)acrylate, ϵ-caprolactone-modified monoesters of (meth)acrylic acid with $C_{2-8}$ dihydric alcohol, N-hydroxymethyl(meth)acrylamide, allyl alcohol and (meth)acrylate having hydroxy-terminated polyoxyethylene chain; carboxy-containing polymerizable unsaturated monomers such as (meth)acrylic acid, maleic acid, crotonic acid and β-carboxyethyl acrylate; polymerizable unsaturated monomers having at least two polymerizable unsaturated groups per molecule, such as allyl(meth)acrylate, ethylene glycol di(meth)acrylate, triethylene glycol di(meth)acrylate, tetraethylene glycol di(meth)acrylate, 1,3-butylene glycol di(meth)acrylate, trimethylolpropane tri(meth)acrylate, 1,4-butanediol di(meth)acrylate, neopentyl glycol di(meth)acrylate, 1,6-hexanediol di(meth)acrylate, pentaerythritol di(meth)acrylate, pentaerythritol tetra(meth)acrylate, glycerol di(meth)acrylate, 1,1,1-trishydroxymethylethane di(meth)acrylate, 1,1,1-trishydroxymethylethane tri(meth) acrylate, 1,1,1-trishydroxymethylpropane tri(meth)acrylate, triallyl isocyanurate, diallyl terephthalate and divinylbenzene; nitrogen-containing polymerizable unsaturated monomers such as (meth)acrylonitrile, (meth)acrylamide, N,N-dimethylaminoethyl(meth)acrylate, N,N-diethylaminoethyl (meth)acrylate, N,N-dimethylaminopropyl(meth) acrylamide, and adducts of glycidyl(meth)acrylate with amines; epoxy group-containing polymerizable unsaturated monomers such as glycidyl(meth)acrylate, β-methylglycidyl (meth)acrylate, 3,4-epoxycyclohexylmethyl(meth)acrylate, 3,4-epoxycyclohexylethyl(meth)acrylate, 3,4-epoxycyclohexylpropyl(meth)acrylate and allyl glycidyl ether; isocyanato group-containing polymerizable unsaturated monomers such as 2-isocyanatoethyl(meth)acrylate and misopropenyl-α,α-dimethylbenzyl isocyanate; (meth)acrylate having alkoxy group-terminated polyoxyethylene chain; and carbonyl group-containing polymerizable unsaturated monomers such as acrolein, diacetone acrylamide, diacetone methacrylamide, acetoacetoxyethyl methacrylate, formyl styrol, vinyl alkyl ketones having 4-7 carbon atoms (e.g., vinyl methyl ketone, vinyl ethyl ketone and vinyl butyl ketone) and the like can be named. These monomers can be used either alone or in combination of two or more.

In the present specification, "(meth)acrylate" means "acrylate or methacrylate", "(meth)acrylic acid" means "acrylic acid or methacrylic acid", "(meth)acryloyl" means "acryloyl or methacryloyl", and "(meth)acrylamide" means "acrylamide or methacrylamide".

The polymerizable unsaturated monomer (c-2) other than the polymerizable unsaturated monomer (c-1) preferably contains, as at least a part thereof, hydroxy-containing polymerizable unsaturated monomer (c-5).

The hydroxy-containing polymerizable unsaturated monomer (c-5) has the function to supply to the resulting water-dispersible acrylic resin (C) hydroxy groups reactable with the curing agent (B) to crosslink, whereby improving water resistance of resulting coating film, and at the same time improving also the stability of the water-dispersible acrylic resin (C) in aqueous medium.

As the hydroxy-containing polymerizable unsaturated monomer (c-5), for example, one or at least two of the hydroxy-containing polymerizable unsaturated monomers among those exemplified in the explanation of the polymerizable unsaturated monomer (c-2) other than the polymerizable unsaturated monomer (c-1) can be suitably selected to be used either singly or in combination.

As the hydroxy-containing polymerizable unsaturated monomer (c-5), 2-hydroxyethyl(meth)acrylate, 2-hydroxypropyl(meth)acrylate, 3-hydroxypropyl(meth)acrylate and 4-hydroxybutyl(meth)acrylate are preferred from the viewpoint of smoothness, distinctness of image and water resistance of resulting coating film, 2-hydroxyethyl(meth)acrylate and 4-hydroxybutyl(meth)acrylate being particularly preferred.

Where the polymerizable unsaturated monomer (c-2) other than the polymerizable unsaturated monomer (c-1) contains the hydroxy-containing polymerizable unsaturated monomer (c-5), the latter's use ratio is preferably within a range of generally within 1-50 mass %, in particular, 2-30 mass %, inter alia, 3-20 mass %, based on the total mass of the $C_{5-22}$ alkyl-containing polymerizable unsaturated monomer (c-1) and the polymerizable unsaturated monomer (c-2) other than the polymerizable unsaturated monomer (c-1), from the viewpoint of stability of the water-dispersible acrylic resin (C) in aqueous medium and water resistance of formed coating film.

The polymerizable unsaturated monomer (c-2) other than the polymerizable unsaturated monomer (c-1) can also contain, as at least a part thereof, carboxy-containing polymerizable unsaturated monomer (c-6).

As the carboxy-containing polymerizable unsaturated monomer (c-6), for example, one or at least two of the carboxy-containing polymerizable unsaturated monomers among those exemplified in the explanation of the polymerizable unsaturated monomer (c-2) other than the polymerizable unsaturated monomer (c-1) can be suitably selected to be used either singly or in combination. In particular, use of acrylic acid and/or methacrylic acid is preferred.

When the polymerizable unsaturated monomer (c-2) other than the polymerizable unsaturated monomer (c-1) contains such carboxy-containing polymerizable unsaturated monomer (c-6), the latter's use ratio is preferably within a range of generally 0.1-30 mass %, in particular, 0.5-20 mass %, inter alia, 1-15 mass %, based on the total mass of the $C_{5-22}$ alkyl-containing polymerizable unsaturated monomer (c-1) and the polymerizable unsaturated monomer (c-2) other than the polymerizable unsaturated monomer (c-1), from the viewpoint of attaining excellent stability of the water-dispersible acrylic resin (C) in aqueous medium.

Also from the viewpoint of smoothness and distinctness of image of formed coating film, the water-dispersible acrylic resin (C) preferably has crosslinked structure. Methods of introducing crosslinked structure into the water-dispersible acrylic resin (C) include, for example, use of a polymerizable unsaturated monomer (c-7) having at least two polymerizable unsaturated groups per molecule, as a part of the polymerizable unsaturated monomer (c-2) other than the polymerizable unsaturated monomer (c-1); or use of a polymerizable unsaturated monomer (c-8) having a later specified functional group(s), and a polymerizable unsaturated monomer (c-9) having such functional group which can complementally react with the functional group in the polymerizable unsaturated monomer (c-8); as a part of the polymerizable unsaturated monomer (c-2) other than the polymerizable unsaturated monomer (c-1). Of these, the method of introducing the crosslinked structure by using a polymerizable unsaturated monomer (c-7) having at least two polymerizable unsaturated groups per molecule as a part of the polymerizable unsaturated monomer (c-2) other than the polymerizable unsaturated monomer (c-1) is preferred.

Examples of such polymerizable unsaturated monomer (c-7) having at least two polymerizable unsaturated groups per molecule include allyl(meth)acrylate, ethylene glycol di(meth)acrylate, triethylene glycol di(meth)acrylate, tetraethylene glycol di(meth)acrylate, 1,3-butylene glycol di(meth)acrylate, trimethylolpropane tri(meth)acrylate, 1,4-butanediol di(meth)acrylate, neopentyl glycol di(meth)acrylate, 1,6-hexanediol di(meth)acrylate, pentaerythritol di(meth)acrylate, pentaerythritol tetra(meth)acrylate, glycerol di(meth)acrylate, 1,1,1-trishydroxymethylethane di(meth)acrylate, 1,1,1-trishydroxymethylethane tri(meth)acrylate, 1,1,1-trishydroxymethylpropane tri(meth)acrylate, triallyl isocyanurate, diallyl terephthalate, divinylbenzene, methylenebisacrylamide and ethylenebisacrylamide. These monomers can be used either alone or in combination of two or more. As the polymerizable unsaturated monomer (c-7) having at least two polymerizable unsaturated groups per molecule, allyl(meth)acrylate, ethylene glycol di(meth)acrylate, 1,4-butanediol di(meth)acrylate, neopentyl glycol di(meth)acrylate and 1,6-hexanediol di(meth)acrylate can be preferably used.

When the polymerizable unsaturated monomer (c-7) having at least two polymerizable unsaturated groups per molecule is used as a part of the polymerizable unsaturated monomer (c-2) other than the polymerizable unsaturated monomer (c-1), its preferred use ratio from the viewpoint of smoothness and distinctness of image of formed coating film is within a range of generally about 0.1—about 30 mass %, in particular, about 0.5—about 15 mass %, inter alia, about 1—about 8 mass %, based on the total mass of the $C_{5-22}$ alkyl-containing polymerizable unsaturated monomer (c-1) and polymerizable unsaturated monomer (c-2) other than the polymerizable unsaturated monomer (c-1).

As the functional group-containing polymerizable unsaturated monomer (c-8), for example, epoxy group-containing polymerizable unsaturated monomer, methylol group-containing polymerizable unsaturated monomer, alkoxysilyl group-containing polymerizable unsaturated monomer and isocyanato group-containing polymerizable unsaturated monomer can be conveniently used.

Examples of the epoxy group-containing polymerizable unsaturated monomer include glycidyl(meth)acrylate, β-methylglycidyl(meth)acrylate, 3,4-epoxycyclohexylmethyl(meth)acrylate, 3,4-epoxycyclohexylethyl(meth)acrylate, 3,4-epoxycyclohexylpropyl(meth)acrylate and allyl glycidyl ether. These can be used either alone or in combination of two or more. In particular, use of glycidyl methacrylate is preferred.

Examples of the methylol group-containing polymerizable unsaturated monomer include N-(hydroxymethyl)(meth)acrylamide, N-(n-butoxymethyl)(meth)acrylamide and N-(iso-butoxymethyl)(meth)acrylamide, which can be used either alone or in combination of two or more. In the present invention, the methylol group-containing polymerizable unsaturated monomer encompasses polymerizable unsaturated monomer having methylol group and polymerizable unsaturated monomer having etherified methylol group. As the methylol group-containing polymerizable unsaturated monomer, N-(hydroxymethyl)(meth)acrylamide and N-(n-butoxymethyl)(meth)acrylamide can be conveniently used.

Examples of the alkoxysilyl group-containing polymerizable unsaturated monomer include vinyltrimethoxysilane, vinyltriethoxysilane, vinyltris(2-methoxyethoxy)silane, γ(meth)acryloyloxypropyltrimethoxysilane and γ-(meth)acryloyloxypropyltriethoxysilane, which can be used either alone or in combination of two or more. Of these, γ-acryloyloxypropyltrimethoxysilane and γ-methacryloyloxypropyltrimethoxysilane can be conveniently used.

Examples of the isocyanato group-containing polymerizable unsaturated monomer include 2-isocyanatoethyl(meth)acrylate and m-isopropenyl-α,α-dimethylbenzyl isocyanate, which can be used either alone or in combination of two or more. Of these, to m-isopropenyl-α,α-dimethylbenzyl isocyanate can be conveniently used.

The use ratio of the functional group-containing polymerizable unsaturated monomer (c-8) preferably is within a range of generally 0.1-60 mass %, in particular, 1-30 mass %, inter alia, 2-20 mass %, based on the total mass of the $C_{5-22}$ alkyl-containing polymerizable unsaturated monomer (c-1) and polymerizable unsaturated monomer (c-2) other than the polymerizable unsaturated monomer (c-1), from the viewpoint of smoothness and distinctness of image of formed coating film.

The polymerizable unsaturated monomer (c-9) is such a monomer having a functional group which is complementally reactable with the functional group in the polymerizable unsaturated monomer (c-8). More specifically, for example, when an epoxy group-containing polymerizable unsaturated monomer is used as the polymerizable unsaturated monomer (c-8), a carboxy-containing polymerizable unsaturated monomer can be used as the polymerizable unsaturated monomer (c-9). As the carboxy-containing polymerizable unsaturated monomer, for example, (meth)acrylic acid, maleic acid, fumaric acid, crotonic acid, itaconic acid and β-carboxyethyl acrylate can be named, which can be used either alone or in combination of two or more. Of these, use of acrylic acid or methacrylic acid is preferred.

Where a methylol group-containing polymerizable unsaturated monomer is used as the polymerizable unsaturated monomer (c-8), for example, hydroxy-containing polymerizable unsaturated monomer can be used as the polymerizable unsaturated monomer (c-9). As the hydroxy-containing polymerizable unsaturated monomer, for example, 2-hydroxyethyl(meth)acrylate, 2-hydroxypropyl(meth)acrylate, 3-hydroxypropyl(meth)acrylate and 4-hydroxybutyl(meth) acrylate can be named, which can be used either alone or in combination of two or more. Of these, use of 4-hydroxybutyl acrylate is preferred.

Where an alkoxysilyl group-containing polymerizable unsaturated monomer is used as the polymerizable unsaturated monomer (c-8), for example, hydroxy-containing polymerizable unsaturated monomer can be used as the polymerizable unsaturated monomer (c-9). As the hydroxyl-containing polymerizable unsaturated monomer, for example, above-exemplified hydroxy-containing polymerizable unsaturated monomers can be named, which can be used either alone or in combination of two or more. Of these, use of 4-hydroxybutyl acrylate is preferred.

Where an isocyanato group-containing polymerizable unsaturated monomer is used as the polymerizable unsaturated monomer (c-8), for example, hydroxy-containing polymerizable unsaturated monomer can be used as the polymerizable unsaturated monomer (c-9). As the hydroxy-containing polymerizable unsaturated monomer, for example, above-exemplified hydroxy-containing polymerizable unsaturated monomers can be named, which can be used either alone or in combination of two or more. In particular, use of 4-hydroxybutyl acrylate is preferred.

According to the present invention, polymerizable unsaturated monomers having functional groups which mutually react to self-crosslink are covered by the above functional group-containing polymerizable unsaturated monomer (c-8). As such polymerizable unsaturated monomer, for example, aforesaid methylol group-containing polymerizable unsaturated monomer can be named. For example, when such a methylol group-containing polymerizable unsaturated monomer is used as the functional group-containing polymerizable unsaturated monomer (c-8), the methylol groups in the methylol group-containing polymerizable unsaturated monomer mutually react and crosslink to form a shell part having the crosslinked structure. In this case, the shell part having the crosslinked structure can be formed in the absence of any polymerizable unsaturated monomer (c-9) having a functional group complementally reactable with the functional group in the polymerizable unsaturated monomer (c-8).

The use ratio of the polymerizable unsaturated monomer (c-9) having a functional group complementally reactable with a functional group in the polymerizable unsaturated monomer (c-8) preferably is, when the polymerizable unsaturated monomer having the functional group (c-8) contains such a polymerizable unsaturated monomer having a functional group reactable with each other to self-crosslink, within a range of generally 0-60 mass %, in particular, 1-30 mass %, inter alia, 2-20 mass %, based on the total mass of the $C_{5-22}$ alkyl-containing polymerizable unsaturated monomer (c-1) and polymerizable unsaturated monomer (c-2) other than the polymerizable unsaturated monomer (c-1), from the viewpoint of improving smoothness and distinctness of image of formed coating film.

When the polymerizable unsaturated monomer (c-8) does not contain such a polymerizable unsaturated monomer having a functional group reactable with each other to self-crosslink, the use ratio of the polymerizable unsaturated monomer (c-9) preferably is within a range of generally 0.1-60 mass %, in particular, 1-30 mass %, inter alia, 2-20 mass %, based on the total mass of the $C_{5-22}$ alkyl-containing polymerizable unsaturated monomer (c-1) and polymerizable unsaturated monomer (c-2).

The water-dispersible acrylic resin (C) may be of a monolayer type obtainable by reacting the whole of above-exemplified monomeric components or a multilayer type obtainable by staged reaction of monomeric components of different compositions, for example, core/shell type.

Preparation method of the water-dispersible acrylic resin (C) is not particularly limited and, for example, there are such methods as polymerization of polymerizable unsaturated monomers in an aqueous medium in which an emulsifier and/or protective colloid are(is) dispersed or dissolved; seed polymerization comprising forming seed particles in advance by polymerizing a suitable amount of polymerizable unsaturated monomers in a reactor and then adding the remainder of the polymerizable unsaturated monomers to continue the polymerization; a method comprising solution polymerizing a polymerizable unsaturated monomer component containing as an essential constituent a polymerizable unsaturated monomer containing hydrophilic group such as carboxy group, in a solvent, phase inversion-emulsifying, and thereafter desolventing where necessary; power feed polymerization in which the composition of polymerizable unsaturated monomer component added during the polymerization is continuously changed; miniemulsion polymerization comprising exerting intense shear force with high pressure homogenizer or ultrasonic waves on the monomer dispersed system to finely divide the monomer drop to an order not exceeding around 500 nm, and then converting each monomer drop to a polymer particle by polymerization; and so on. Of these, use of the seed polymerization or miniemulsion polymerization method is preferred from the viewpoint of stable production.

It is convenient that the water-dispersible acrylic resin (C) has an average particle diameter within a range of generally 10-5,000 nm, preferably 50-3,000 nm, inter alia, 100-1,000 nm.

In the present specification, the average particle size of the water-dispersible acrylic resin (C) is the value measured of the particles which are diluted with deionized water according to the accepted practice at 20° C., with a submicron particle size distribution measuring device. As the submicron particle size distribution analyser, for example, COULTER N4 Model (tradename, Beckman Coulter, Inc.) can be used.

Where the water-dispersible acrylic resin (C) contains acidic groups such as carboxy group, it is desirable to neutralize the acidic groups with a neutralizer to improve mechanical stability of the particles of the resin (C). The neutralizer is subject to no particular limitation, so long as it can neutralize such acidic groups. Examples of the neutralizer include sodium hydroxide, potassium hydroxide, trimethylamine, 2-(dimethylamino)ethanol, 2-amino-2-methyl-1-propanol, triethylamine, aqueous ammonia and the like. These neutralizers are desirably used in an amount to render pH of the aqueous dispersion of water-dispersible acrylic resin (C) after the neutralization within a range of around 6-9.

As the water-dispersible acrylic resin (C), it is particularly advantageous from the viewpoint of smoothness, distinctness of image, water resistance and chipping resistance of formed coating film, to use a core/shell type water-dispersible acrylic resin (C1) formed of the core of a polymer (I) which is obtained by polymerizing a monomer component comprising 60-100 mass % of the $C_{5-22}$ alkyl-containing polymerizable unsaturated monomer (c-1) and 0-40 mass % of the polymerizable unsaturated monomer (c-2) other than the polymerizable unsaturated monomer (c-1), and the shell of a polymer (II) which is obtained by polymerizing a monomer component comprising 45-100 mass % of $C_{1-2}$ alkyl-containing polymerizable unsaturated monomer (c-3) and 0-55 mass % of polymerizable unsaturated monomer (c-4) other than the polymerizable unsaturated monomer (c-3).

As the $C_{5-22}$ alkyl-containing polymerizable unsaturated monomer (c-1) to be used for forming the polymer (I) serving as the core part of the water-dispersible acrylic resin (C1), $C_{6-18}$ alkyl-, in particular, $C_{8-13}$ alkyl-containing polymerizable unsaturated monomers are preferred. From the viewpoint of smoothness of formed coating film, 2-ethylhexyl acrylate, dodecyl methacrylate and tridecyl methacrylate are preferred, 2-ethylhexyl acrylate being particularly advantageous.

The use ratio of the $C_{5-22}$ alkyl-containing polymerizable unsaturated monomer (c-1) in the water-dispersible acrylic resin (C1) is conviently within a range of generally 60-100 mass %, in particular, 80-100 mass %, inter alia, 90-100 mass %, based on the total mass of the $C_{5-22}$ alkyl-containing polymerizable unsaturated monomer (c-1) and the polymerizable unsaturated monomer (c-2) other than the polymerizable unsaturated monomer (c-1), from the viewpoint of smoothness and distinctness of image of formed coating film.

The polymerizable unsaturated monomer (c-2) other than the $C_{5-22}$ alkyl-containing polymerizable unsaturated monomer (c-1), which is used for forming the polymer (I) serving as the core of water-dispersible acrylic resin (C1), can be suitably selected from those exemplified as the polymerizable unsaturated monomer (c-2) other than the polymerizable unsaturated monomer (c-1) in the explanation of the water-dispersible acrylic resin (C) given earlier.

As the $C_{1-2}$ alkyl-containing polymerizable unsaturated monomer (c-3) to be used for making the polymer (II) serving as the shell of the water-dispersible acrylic resin (C1), for example, methyl(meth)acrylate and ethyl(meth)acrylate can be named. These monomers can be used either alone or in combination of two or more. From the viewpoint of smoothness and distinctness of image of formed coating film, use of methyl methacrylate and/or ethyl methacrylate, in particular, use of methyl methacrylate, is preferred.

The use ratio of $C_{1-2}$ alkyl-containing polymerizable unsaturated monomer (c-3) in the water-dispersible acrylic resin (C1) is conveniently within a range of generally 45-100 mass %, in particular, 60-98 mass %, inter alia, 70-95 mass %, based on the total mass of the $C_{1-2}$ alkyl-containing polymerizable unsaturated monomer (c-3) and polymerizable unsaturated monomer (c-4) other than the polymerizable unsaturated monomer (c-3), from the viewpoint of smoothness and distinctness of image of formed coating film.

As the polymerizable unsaturated monomer (c-4) other than the $C_{1-2}$ alkyl-containing polymerizable unsaturated monomer (c-3), which is used for making the polymer (II) serving as the shell part of polymer (II), for example, alkyl or cycloalkyl(meth)acrylates such as n-propyl(meth)acrylate, i-propyl(meth)acrylate, n-butyl(meth)acrylate, i-butyl(meth)acrylate, tert-butyl(meth)acrylate, n-hexyl(meth)acrylate, n-octyl(meth)acrylate, 2-ethylhexyl(meth)acrylate, nonyl(meth)acrylate, tridecyl(meth)acrylate, lauryl(meth)acrylate, stearyl(meth)acrylate, isostearyl(meth)acrylate, cyclohexyl(meth)acrylate, methylcyclohexyl(meth)acrylate, t-butylcyclohexyl(meth)acrylate, cyclododecyl(meth)acrylate, tricyclodecanyl(meth)acrylate and the like; isobornyl group-containing polymerizable unsaturated monomers such as isobornyl(meth)acrylate; adamantyl group-containing polymerizable unsaturated monomers such as adamantyl(meth)acrylate; tricyclodecenyl group-containing polymerizable unsaturated monomers such as tricyclodecenyl(meth)acrylate; aromatic ring-containing polymerizable unsaturated monomers such as benzyl(meth)acrylate, styrene, α-methylstyrene, vinyltoluene and the like; alkoxysilyl group-containing polymerizable unsaturated monomers such as vinyltrimethoxysilane, vinyltriethoxysilane, vinyltris(2-methoxyethoxy)silane, γ-(meth)acryloyloxypropyltrimethoxysilane, γ-(meth)acryloyloxypropyltriethoxysilane and the like; perfluoroalkyl(meth)acrylates such as perfluorobutylethyl(meth)acrylate, perfluorooctylethyl(meth)acrylate and the like; polymerizable unsaturated monomers having fluorinated alkyl groups such as fluoroolefin; polymerizable unsaturated monomers having photo-polymerizable functional groups such as maleimide group; vinyl compounds such as N-vinylpyrrolidone, ethylene, butadiene, chloroprene, vinyl propionate, vinyl acetate and the like; hydroxy-containing polymerizable unsaturated monomers such as monoesters of (meth)acrylic acid with $C_{2-8}$ dihydric alcohols such as 2-hydroxyethyl(meth)acrylate, 2-hydroxypropyl(meth)acrylate, 3-hydroxypropyl(meth)acrylate, 4-hydroxybutyl(meth)acrylate and the like, ε-caprolactone-modified products of the monoesters of (meth)acrylic acid with $C_{2-8}$ dihydric alcohols, N-hydroxymethyl(meth)acrylamide, allyl alcohol, (meth)acrylates having hydroxy-terminated polyoxyethylene chain and the like; carboxy-containing polymerizable unsaturated monomers such as (meth)acrylic acid, maleic acid, crotonic acid, β-carboxyethyl acrylate and the like; polymerizable unsaturated monomers having at least two polymerizable unsaturated groups per molecule, such as allyl(meth)acrylate, ethylene glycol di(meth)acrylate, 1,4-butanediol(meth)acrylate, neopentyl glycol di(meth)acrylate, 1,6-hexanediol di(meth)acrylate and the like; nitrogen-containing polymerizable unsaturated monomers such as (meth)acrylonitrile, (meth)acrylamide, N,N-dimethylaminoethyl(meth)acrylate, N,N-diethylaminoethyl(meth)acrylate, N,N-dimethylaminopropyl(meth)acrylamide, adducts of glycidyl(meth)acrylates with amines and the like; epoxy-containing polymerizable unsaturated monomers such as glycidyl(meth)acrylate, β-methylglycidyl(meth)acrylate, 3,4-epoxycyclohexylmethyl(meth)acrylate, 3,4-epoxycyclohexylethyl(meth)acrylate, 3,4-epoxycyclohexylpropyl(meth)acrylate, allyl glycidyl ether and the like; and (meth)acrylates having alkoxy-terminated polyoxyethylene chain can be named. These polymerizable unsaturated monomers can be used either alone or in combination of two or more.

The polymerizable unsaturated monomer (c-4) other than the polymerizable unsaturated monomer (c-3) preferably contains, as at least a part thereof, hydroxy-containing polymerizable unsaturated monomer (c-10).

The hydroxy-containing polymerizable unsaturated monomer (c-10) has the function to improve stability of the water-dispersible acrylic resin (C1) in aqueous medium as well as to improve water resistance of formed coating film, by introducing into the resultant water-dispersible acrylic resin (C1) hydroxy groups which react with the curing agent (B) to form crosslinkage.

The hydroxy-containing polymerizable unsaturated monomer (c-10) can be suitably selected from, for example, those exemplified in the foregoing explanation of the polymerizable unsaturated monomer (c-4) other than the polymerizable unsaturated monomer (c-3). These monomers can be used either alone or in combination of two or more.

As the hydroxy-containing polymerizable unsaturated monomer (c-10), 2-hydroxyethyl(meth)acrylate, 2-hydroxypropyl(meth)acrylate, 3-hydroxypropyl(meth)acrylate and 4-hydroxybutyl(meth)acrylate are preferred from the viewpoint of smoothness, distinctness of image and water resistance of formed coating film, 2-hydroxyethyl(meth)acrylate and 4-hydroxybutyl(meth)acrylate being particularly preferred.

When the polymerizable unsaturated monomer (c-4) other than the polymerizable unsaturated monomer (c-3) contains hydroxy-containing polymerizable unsaturated monomer (c-10), suitable use ratio of the hydroxy-containing polymerizable unsaturated monomer (c-10) is within a range of generally 1-60 mass %, in particular, 2-50 mass %, inter alia, 3-40 mass %, based on the total mass of the $C_{1-2}$ alkyl-containing polymerizable unsaturated monomer (c-3) and polymerizable unsaturated monomer (c-4) other than the polymerizable unsaturated monomer (c-3), from the viewpoint of stability of the water dispersible acrylic resin (C1) in aqueous medium and water resistance of formed coating film.

The polymerizable unsaturated monomer (c-4) other than the polymerizable unsaturated monomer (c-3) can also contain, as at least a part thereof, carboxy-containing polymerizable unsaturated monomer (c-11).

The carboxy-containing polymerizable unsaturated monomer (c-11) can be suitably selected from, for example, those carboxy-containing polymerizable unsaturated monomers exemplified in the explanation of the polymerizable unsaturated monomer (c-4) other than the polymerizable unsaturated monomer (c-3). These monomers can be used either alone or in combination of two or more. In particular, use of acrylic acid and/or methacrylic acid is preferred.

When the polymerizable unsaturated monomer (c-4) other than the polymerizable unsaturated monomer (c-3) contains carboxy-containing polymerizable unsaturated monomer (c-11), the use ratio of the carboxy-containing polymerizable unsaturated monomer (c-11) preferably is within a range of generally 1-30 mass %, in particular, 2-20 mass %, inter alia, 3-15 mass %, based on the total mass of the $C_{1-2}$ alkyl-containing polymerizable unsaturated monomer (c-3) and the polymerizable unsaturated monomer (c-4) other than the polymerizable unsaturated monomer (c-3), from the viewpoint of stability of the water-dispersible acrylic resin (C1) in aqueous medium.

From the viewpoint of smoothness and distinctness of image of formed coating film, the polymer (I) for the core part and/or the polymer (II) for the shell part of the water-dispersible acrylic resin (C1) preferably have(has) crosslinked structure.

As means for introducing crosslinked structure into the core polymer (I), for example, use of the polymerizable unsaturated monomer (c-7) having at least two polymerizable unsaturated groups per molecule, as a part of the polymerizable unsaturated monomer (c-2) other than the polymerizable unsaturated monomer (c-1); or use of the functional group-containing polymerizable unsaturated monomer (c-8) and the polymerizable unsaturated monomer (c-9) having a functional group complementally reactable with the functional group in the polymerizable unsaturated monomer (c-8), as a part of the polymerizable unsaturated monomer (c-2) other than the polymerizable unsaturated monomer (c-1) can be adopted. Of these, introduction of crosslinked structure by use of the polymerizable unsaturated monomer (c-7) having at least two polymerizable unsaturated groups as a part of the polymerizable unsaturated monomer (c-2) other than the polymerizable unsaturated monomer (c-1) is preferred.

Where the polymerizable unsaturated monomer (c-7) having at least two polymerizable unsaturated groups per molecule is used as a part of the polymerizable unsaturated monomer (c-2) other than the polymerizable unsaturated monomer (c-1) in the water-dispersible acrylic resin (C1), its use ratio preferably is within a range of generally 0.1-30 mass %, in particular, 0.5-15 mass %, inter alia, 1-8 mass %, based on the total mass of the $C_{5-22}$ alkyl-containing polymerizable unsaturated monomer (c-1) and the polymerizable unsaturated monomer (c-2) other than the polymerizable unsaturated monomer (c-1), from the viewpoint of smoothness and distinctness of image of formed coating film.

Where the functional group-containing polymerizable unsaturated monomer (c-8) is used as a part of the polymerizable unsaturated monomer (c-2) other than the polymerizable unsaturated monomer (c-1) in the water-dispersible acrylic resin (C1), its preferred use ratio is within a range of generally 0.1-60 mass %, in particular, 1-30 mass %, inter alia, 2-20 mass %, based on the total mass of the $C_{5-22}$ alkyl-containing polymerizable unsaturated monomer (c-1) and the polymerizable unsaturated monomer (c-2) other than the polymerizable unsaturated monomer (c-1), from the standpoint of improving smoothness and distinctness of image of formed coating film.

Where the polymerizable unsaturated monomer (c-9) having a functional group complementally reactable with the functional group in the polymerizable unsaturated monomer (c-8) is used as a part of the polymerizable unsaturated monomer (c-2) other than the polymerizable unsaturated monomer (c-1) in the water-dispersible acrylic resin (C1), its use ratio, when the polymerizable unsaturated monomer (c-8) contains a functional group-containing polymerizable unsaturated monomer whose functional groups can mutually react to cause self-crosslinkage, is preferably within a range of generally 0-60 mass %, in particular, 1-30 mass %, inter alia, 2-20 mass %, based on the total mass of the $C_{5-22}$ alkyl-containing polymerizable unsaturated monomer (c-1) and the polymerizable unsaturated monomer (c-2) other than the polymerizable unsaturated monomer (c-1), from the viewpoint of smoothness and distinctness of image of formed coating film.

When the polymerizable unsaturated monomer (c-8) does not contain a functional group-containing polymerizable unsaturated monomer whose functional groups can mutually react to cause self-crosslinkage, suitable use ratio of the polymerizable unsaturated monomer (c-9) is within a range of generally 0.1-60 mass %, in particular, 1-30 mass %, inter alia, 2-20 mass %, based on the total mass of the $C_{5-22}$ alkyl-containing polymerizable unsaturated monomer (c-1) and the polymerizable unsaturated monomer (c-2) other than the polymerizable unsaturated monomer (c-1), from the viewpoint of smoothness and distinctness of image of formed coating film.

Also as the means for introducing crosslinked structure into the polymer (II) serving as the shell part, for example, use of the polymerizable unsaturated monomer (c-7) having at least two polymerizable unsaturated groups per molecule, as a part of the polymerizable unsaturated monomer (c-4) other than the polymerizable unsaturated monomer (c-3); or use of the functional group-containing polymerizable unsaturated monomer (c-8) and the polymerizable unsaturated monomer (c-9) having a functional group complementally reactable with the functional group in the polymerizable unsaturated monomer (c-8), as a part of the polymerizable unsaturated monomer (c-4) other than the polymerizable unsaturated monomer (c-3) can be adopted. Of these, introduction of crosslinked structure by use of the polymerizable unsaturated monomer (c-7) having at least two polymerizable unsaturated groups as a part of the polymerizable unsaturated monomer (c-4) other than the polymerizable unsaturated monomer (c-3) is preferred.

Where the polymerizable unsaturated monomer (c-7) having at least two polymerizable unsaturated groups per molecule is used as a part of the polymerizable unsaturated monomer (c-4) other than the polymerizable unsaturated monomer (c-3) in the water-dispersible acrylic resin (C1), its use ratio preferably is within a range of generally 0.1-30 mass %, in particular, 0.5-15 mass %, inter alia, 1-8 mass %, based on the total mass of the $C_{1-2}$ alkyl-containing polymerizable unsaturated monomer (c-3) and the polymerizable unsaturated monomer (c-4) other than the polymerizable unsaturated monomer (c-3), from the viewpoint of smoothness and distinctness of image of formed coating film.

Where the functional group-containing polymerizable unsaturated monomer (c-8) is used as a part of the polymerizable unsaturated monomer (c-4) other than the polymerizable unsaturated monomer (c-3) in the water-dispersible acrylic resin (C1), its preferred use ratio is within a range of generally 0.1-55 mass %, in particular, 1-30 mass %, inter alia, 2-20 mass %, based on the total mass of the $C_{1-2}$ alkyl-containing polymerizable unsaturated monomer (c-3) and the polymerizable unsaturated monomer (c-4) other than the polymerizable unsaturated monomer (c-3), from the viewpoint of smoothness and distinctness of image of formed coating film.

Where the polymerizable unsaturated monomer (c-9) having a functional group complementally reactable with the functional group in the polymerizable unsaturated monomer (c-8) is used as a part of the polymerizable unsaturated monomer (c-4) other than the polymerizable unsaturated monomer (c-3) in the water-dispersible acrylic resin (C1), its use ratio, when the polymerizable unsaturated monomer (c-8) contains a functional group-containing polymerizable unsaturated monomer whose functional groups can mutually react to cause self-crosslinkage, is preferably within a range of generally 0-54.9 mass %, in particular, 1-30 mass %, inter alia, 2-20 mass %, based on the total mass of the $C_{1-2}$ alkyl-containing polymerizable unsaturated monomer (c-3) and the polymerizable unsaturated improving monomer (c-4) other than the polymerizable unsaturated monomer (c-3), from the viewpoint of improving smoothness and distinctness of image of formed coating film. Whereas, when the polymerizable unsaturated monomer (c-8) does not contain a functional group-containing polymerizable unsaturated monomer whose functional groups can mutually react to cause self-crosslinkage, suitable use ratio of the polymerizable unsaturated monomer (c-9) is within a range of generally 0.1-54.9 mass %, in particular, 1-30 mass %, inter alia, 2-20 mass %, based on the total mass of the $C_{1-2}$ alkyl-containing polymerizable unsaturated monomer (c-3) and the polymerizable unsaturated monomer (c-4) other than the polymerizable unsaturated monomer (c-3).

The ratio of the polymer (I)/polymer (II) in the water-dispersible acrylic resin (C1) preferably is within a range of, in terms of solid mass ratio, generally 5/95-95/5, in particular, 50/50-90/10, inter alia, 65/35-85/15, from the viewpoint of smoothness of coating film.

The water-dispersible acrylic resin (C1) preferably has a hydroxy value within a range of generally 1-150 mgKOH/g, in particular, 2-100 mgKOH/g, inter alia, 5-60 mgKOH/g, 10-40 mgKOH/g for the best, from the viewpoint of water resistance of formed coating film.

From the viewpoint of smoothness and distinctness of image of formed coating film, the water-dispersible acrylic resin (C1) furthermore preferably has an acid value within a range of generally 0-50 mgKOH/g, in particular, 0-20 mgKOH/g, inter alia, from 0 mgKOH/g to less than 10 mgKOH/g.

According to the present invention, the polymer (I) which is obtained by polymerizing the $C_{5-22}$ alkyl-containing polymerizable unsaturated monomer (c-1) and polymerizable unsaturated monomer (c-2) other than the polymerizable unsaturated monomer (c-1) preferably has a glass transition temperature ($Tg_1$) within a range of generally from −65 to −10° C., in particular, from −60 to −20° C., inter alia, from −55 to −40° C., from the viewpoint of smoothness and distinctness of image of formed coating film. Also the polymer (II) obtained by polymerization of the $C_{1-2}$ alkyl-containing polymerizable unsaturated monomer (c-3) and the polymerizable unsaturated monomer (c-4) other than the polymerizable unsaturated monomer (c-3) preferably has a glass transition temperature ($Tg_2$) within a range of generally from −55 to 150° C., in particular, from −10 to 120° C., inter alia, from 10 to 110° C. It is furthermore preferred that $Tg_2$ is higher than $Tg_1$ and the difference between $Tg_2$ and $Tg_1$ is within a range of generally 5-200° C., in particular, 30-180° C., inter alia, 50-160° C.

In the present invention, the glass transition temperature Tg (absolute temperature) is the value calculated by the following equation:

$$1/Tg=W_1/T_1+W_2/T_2+\ldots Wn/Tn$$

in the equation, $W_1$, $W_2$ . . . Wn are the mass fractions of respective monomers, and $T_1$, $T_2$ . . . Tn are the glass transition temperature (absolute temperature) of homopolymers of respective monomers.

Glass transition temperatures of homopolymers of respective monomers are those given on Polymer Handbook, 4th Edition, ed. by J. Brandrup, E.h. Immergut, E. A. Grulke (1999). Glass transition temperatures of monomers not given in the literature were measured of homopolymers of the monomers which were synthesized to have each a weight-average molecular weight of approx. 50,000, by means of differential scanning calorimeter.

The water-dispersible acrylic resin (C1) can be produced, for example, by emulsion polymerizing a monomer mixture containing 60-100 mass % of the $C_{5-22}$ alkyl-containing polymerizable unsaturated monomer (c-1) and 0-40 mass % of the polymerizable unsaturated monomer (c-2) other than the polymerizable unsaturated monomer (c-1), adding to the resulting emulsion which contains the polymer (I), a monomer mixture of 45-100 mass % of the $C_{1-2}$ alkyl-containing polymerizable unsaturated monomer (c-3) and 0-55 mass % of the polymerizable unsaturated monomer (c-4) other than the polymerizable unsaturated monomer (c-3), and forming a polymer (II) by further emulsion polymerization.

The emulsion polymerization for making the polymer (I) can be carried out by the means known per se, for example, seed polymerization, mini-emulsion polymerization or the like, e.g., by emulsion polymerization of the monomer mixture using a polymerization initiator in the presence of an emulsifier.

As the emulsifier, anionic or nonionic emulsifiers are suitable. Examples of anionic emulsifier include sodium salts or ammonium salts of such acids as alkylsulfonic acid, alkylbenzenesulfonic acid, alkylphosphoric acid and the like, and examples of nonionic emulsifier include polyoxyethylene oleyl ether, polyoxyethylene stearyl ether, polyoxyethylene lauryl ether, polyoxyethylene tridecyl ether, polyoxyethylene phenyl ether, polyoxyethylene nonylphenyl ether, polyoxyethylene octylphenyl ether, polyoxyethylene monolaurate, polyoxyethylene monostearate, polyoxyethylene monooleate, sorbitan monolaurate, sorbitan monostearate, sorbitan tristearate, sorbitan trioleate, polyoxyethylene sorbitan monolaurate and the like. It is also permissible to use polyoxyalkylene group-containing anionic emulsifier containing an anionic group and polyoxyalkylene group such as polyoxyethylene, polyoxypropylene or the like group per molecule, or reactive anionic emulsifier containing an anionic group and polymerizable unsaturated group per molecule.

The emulsifier can be used within a range of normally 0.1-15 mass %, preferably 0.5-10 mass %, inter alia, 1-5 mass %, based on the total mass of all of the monomers used.

As the polymerization initiator, for example, organic peroxides such as benzoyl peroxide, octanoyl peroxide, lauroyl peroxide, stearoyl peroxide, cumene hydroperoxide, tert-butyl peroxide, tert-butyl peroxylaurate, tert-butyl peroxyisopropylcarbonate, tert-butyl peroxyacetate, diisopropylbenzene hydroperoxide and the like; azo compounds such as azobisisobutyronitrile, azobis(2,4-dimethylvarelonitrile), azobis(2-methylpropionitrile), azobis(2-methylbutyronitrile), 4,4'-azobis(4-cyanobutanoic acid), dimethylazobis(2-methyl propionate), azobis[2-methyl-N-(2-hydroxyethyl)-propionamide], azobis{2-methyl-N-[2-(1-hydroxybutyl)]-propionamide} and the like; and persulfates such as potassium persulfate, ammonium persulfate, sodium persulfate and the like. These polymerization initiators can be used either alone or in combination of two or more. Furthermore, where necessary, such a polymerization initiator may be co-used with reducing agent such as sugar, sodium formaldehyde sulfoxylate, iron complex and the like to form a redox initiator.

The polymerization initiator is preferably used within a range of normally around 0.1-5 mass %, in particular, around 0.2-3 mass %, based on the total mass of all of the monomers used. Method of adding the polymerization initiator is not particularly limited and can be suitably selected according to its kind and amount. For example, it may be advancedly contained in the monomer mixture or aqueous medium, or may be added in lump or dropwise at the time of polymerization.

The monomer mixture may contain chain transfer agent, for adjusting molecular weight of resulting water-dispersible acrylic resin (C1). The chain transfer agent includes mercapto group-containing compounds, specific examples including lauryl mercaptan, t-dodecylmercaptan, octylmercaptan, 2-ethylhexyl thioglycolate, 2-methyl-5-tert-butylthiophenol, mercaptoethanol, thioglycerol, mercaptoacetic acid (thioglycolic acid), mercaptopropionate, n-octyl-3-mercaptopropionate and the like. When the chain transfer agent is used, its suitable use ratio is normally within a range of 0.05-10 mass %, in particular, 0.1-5 mass %, based on the total mass of all the monomers used.

Where necessary, the monomer mixture may be blended with organic solvent, for example, long chain saturated hydrocarbon solvent such as hexadecane or long chain alcoholic solvent such as hexadecanol.

The water-dispersible acrylic resin (C1) can be formed by adding to the emulsion of polymer (I) as obtained in the above, a monomer mixture of the $C_{1-2}$ alkyl-containing polymerizable unsaturated monomer (c-3) and polymerizable unsaturated monomer (c-4) other than the polymerizable unsaturated monomer (c-3), and further polymerizing the system to form a polymer (II).

The monomer mixture for forming the polymer (II) can suitably contain such components as the emulsifier, polymerization initiator, reducing agent, chain transfer agent and the like, where necessary. The monomer mixture may be added dropwise as it is, but it is generally desirable to disperse it in an aqueous medium and to add the resultant monomer emulsion dropwise. The particle size of the monomer emulsion in this case is not particularly limited.

As the polymerization method of the monomer mixture for forming the polymer (II), for example, the monomer mixture or emulsion thereof is added either in lump or gradually to the emulsion of polymer (I) followed by heating to an adequate temperature under stirring.

Thus obtained water-dispersible acrylic resin (C1) normally has a multilayer structure having as the core part the polymer (I) of the monomer mixture of the $C_{5-22}$ alkyl-containing polymerizable unsaturated monomer (c-1) and the polymerizable unsaturated monomer (c-2) other than the polymerizable unsaturated monomer (c-1) and, as the shell part, the polymer (II) of the monomer mixture of the $C_{1-2}$ alkyl-containing polymerizable unsaturated monomer (c-3) and the polymerizable unsaturated monomer (c-4) other than the polymerizable unsaturated monomer (c-3).

The water-dispersible acrylic resin (C1), furthermore, may be caused to consist of three or more layers, by adding a step or steps comprising supplying polymerizable unsaturated monomer (one or a mixture of at least two monomers) to form other layer(s) and emulsion polymerizing the monomer(s), between the step of obtaining the polymer (I) and the step of obtaining the polymer (II).

In the present invention, "shell part" of the water-dispersible acrylic resin (C1) signifies the polymeric layer present as the outermost layer of each resin particle, "core part" signifies the polymeric layer(s) inside the resin particles other than the shell part, and "core/shell structure", a structure having the core part and the shell part. The core/shell structure in general takes a layered structure such that the core part is completely covered by the shell part, but depending on the mass ratio of the core part to the shell part, it may occur that the amount of the monomer for the shell part is insufficient for forming the layer structure. In that case, a complete layer structure as above is not essential but a structure, wherein the shell partially covers the core or the polymerizable unsaturated monomers which are the constituent elements of the shell are graft-polymerized at a part of the core, may be taken. The concept of the multilayer structure of above core/shell structure is applicable similarly to the case wherein the multilayer structure is formed as the core in the water-dispersible acrylic resin (C1) of the present invention.

In the multilayer coating film-forming method of the present invention, the reason why the water-based first coloring paint (X) which contains the core/shell structured water-dispersible acrylic resin (C1) can form a coating film excelling in smoothness, distinctness of image, water resistance and chipping resistance is not fully clear, but it is inferred that the water-dispersible acrylic resin (C1) in the water-based first coloring paint (X) has at the core part relatively long chain alkyl groups which lead to formation of uncured first colored coating film having adequate hydrophobic property to suppress layer-mixing between two coating films when a water-based second coloring paint is applied onto the first colored coating film, eventually improving smoothness and distinctness of image of the coating film. Furthermore, water resistance of the coating film is improved as infiltration of water into the formed multilayer coating film is suppressed by the alkyl groups. Still in addition, because the water-dispersible acrylic resin (C1) has adequate pliability due to the alkyl groups, it absorbs impact exerted on the formed coating film to improve the chipping resistance. It is also inferred that smoothness of the coating film is improved as the water-dispersible acrylic resin (C1) is uniformly dispersible in the water-based first coloring paint X), because the water-dispersible acrylic resin (C1) has the relatively short chained alkyl groups at the shell part.

Water-Based First Coloring Paint (X)

The water-based first coloring paint (X) used in the multi-layer coating film-forming method of the present invention is a water-based paint composition which contains the above-described hydroxy-containing polyester resin (A), curing agent (B) and water-dispersible acrylic resin (C).

The blend ratios of the hydroxy-containing polyester resin (A), curing agent (B) and water-dispersible acrylic resin (C) in the water-based first coloring paint (X) preferably are within the following ranges, per 100 mass parts in total of the hydroxy-containing polyester resin (A) and curing agent (B):

hydroxy-containing polyester resin (A): generally 20-95 mass parts, preferably 40-90 mass parts, inter alia, 50-80 mass parts;

curing agent (B): generally 5-80 mass parts, preferably 10-60 mass parts, inter alia, 20-50 mass parts;

water-dispersible resin (C): generally 1-100 mass parts, preferably 5-70 mass parts, inter alia, 10-50 mass parts.

The water-based first coloring paint (X) can contain, besides the hydroxy-containing polyester resin (A), a modifying resin such as water-soluble or water-dispersible acrylic resin, polyurethane resin, alkyd resin, epoxy resin and the like. These modifying resins preferably contain crosslinkable functional groups such as hydroxy, carboxy, epoxy and the like.

As the modifying resin, use of acrylic resin and/or polyurethane resin is preferred, from the viewpoint of improving distinctness of image, water resistance and chipping resistance.

As the acrylic resin, hydroxy-containing acrylic resin can be conveniently used. The hydroxy-containing acrylic resin can be normally prepared through copolymerizing a hydroxy-containing polymerizable unsaturated monomer with other polymerizable unsaturated monomer which is copolymerizable with the hydroxy-containing polymerizable unsaturated monomer, by a per se known method, such as solution polymerization in an organic solvent, emulsion polymerization in water, and the like.

The hydroxy-containing polymerizable unsaturated monomer is a compound having at least one each of hydroxy group and polymerizable unsaturated bond per molecule, examples of which include monoesters of (meth)acrylic acid with $C_{2-8}$ dihydric alcohols such as 2-hydroxyethyl(meth)acrylate, 2-hydroxypropyl(meth)acrylate, 3-hydroxypropyl(meth) acrylate and 4-hydroxybutyl(meth)acrylate; ϵ-caprolatone modification products of such monoesters of (meth)acrylic acid with $C_{2-8}$ dihydric alcohols; N-hydroxymethyl(meth) acrylamide; allyl alcohol, and (meth)acrylates having hydroxy-terminated polyoxyethylene chain.

The other polymerizable unsaturated monomer which is copolymerizable with the hydroxy-containing polymerizable unsaturated monomer can be suitably selected and used according to characteristic properties desired for the hydroxy-containing acrylic resin. Specific examples of such monomer are enumerated in the following, which can be used each alone or in combination of two or more:

(i) alkyl or cycloalkyl(meth)acrylates: for example, methyl (meth)acrylate, ethyl(meth)acrylate, n-propyl(meth) acrylate, i-propyl(meth)acrylate, n-butyl(meth)acrylate, i-butyl(meth)acrylate, tert-butyl(meth)acrylate, n-hexyl (meth)acrylate, n-octyl(meth)acrylate, 2-ethylhexyl (meth)acrylate, nonyl(meth)acrylate, tridecyl(meth) acrylate, lauryl(meth acrylate, stearyl(meth)acrylate, isostearyl(meth)acrylate, cyclohexyl(meth)acrylate, methylcyclohexyl(meth)acrylate, t-butylcyclohexyl (meth)acrylate, cyclododecyl(meth)acrylate and tricyclodecanyl(meth)acrylate and the like;

(ii) polymerizable unsaturated monomers having isobornyl group: for example, isobornyl(meth)acrylate and the like;

(iii) polymerizable unsaturated monomers having adamantyl group: for example, adamantyl(meth)acrylate and the like;

(iv) polymerizable unsaturated monomers having tricyclodecenyl group: for example, tricyclodecenyl(meth)acrylate and the like;

(v) aromatic ring-containing polymerizable unsaturated monomers: for example, benzyl(meth)acrylate, styrene, α-methylstyrene, vinyltoluene and the like;

(vi) polymerizable unsaturated monomers having alkoxysilyl group: for example, vinyltrimethoxysilane, vinyltriethoxysilane, vinyltris(2-methoxyethoxy)silane, γ-(meth)acryloyloxypropyltrimethoxysilane, γ-(meth) acryloyloxypropyltriethoxysilane and the like;

(vii) polymerizable unsaturated monomer having fluorinated alkyl group: for example, perfluoroalkyl(meth) acrylates such as perfluorobutylethyl(meth)acrylate, perfluorooctylethyl(meth)acrylate; fluoroolefin, and the like;

(viii) polymerizable unsaturated monomers having photopolymerizable functional group like maleimide group;

(ix) vinyl compounds: for example, N-vinylpyrrolidone, ethylene, butadiene, chloroprene, vinyl propionate, vinyl acetate and the like;

(x) phosphoric acid group-containing polymerizable unsaturated monomers: for example, 2-acryloyloxyethyl acid phosphate, 2-methacryloyloxyethyl acid phosphate, 2-acryloyloxypropyl acid phosphate, 2-methacryloyloxypropyl acid phosphate and the like;

(xi) carboxy-containing polymerizable unsaturated monomers: for example, (meth)acrylic acid, maleic acid, crotonic acid, β-carboxyethyl acrylate and the like;

(xii) nitrogen-containing polymerizable unsaturated monomers: for example, (meth)acrylonitrile, (meth) acrylamide, N,N-dimethylaminoethyl(meth)acrylate, N,N-diethylaminoethyl(meth)acrylate, N,N-dimethylaminopropyl(meth)acrylamide, methylenebis(meth) acrylamide, ethylenebis(meth)acrylamide, 2-(methacryloyloxy)ethyltrimethyl ammonium chloride, addition products of glycidyl(meth)acrylate with amines and the like;

(xiii) polymerizable unsaturated monomers having at least two polymerizable unsaturated groups per molecule: for example, allyl(meth)acrylate, 1,6-hexanediol di(meth) acrylate and the like;

(xiv) epoxy-containing polymerizable unsaturated monomers: for example, glycidyl(meth)acrylate, β-methylglycidyl(meth)acrylate, 3,4-epoxycyclohexylmethyl (meth)acrylate, 3,4-epoxycyclohexylethyl(meth) acrylate, 3,4-epoxycyclohexylpropyl(meth)acrylate, allyl glycidyl ether and the like;

(xv) (meth)acrylates having alkoxy-terminated polyoxyethylene chain;

(xvi) sulfonic acid group-containing polymerizable unsaturated monomers: for example, 2-acrylamido-2-methylpropane-sulfonic acid, 2-sulfoethyl(meth)acrylate, allylsulfonic acid, 4-styrenesulfonic acid; and sodium salts or ammonium salts of these sulfonic acids;

(xvii) polymerizable unsaturated monomers having LTV absorbing functional group: for example, 2-hydroxy-4-(3-methacryloyloxy-2-hydroxypropoxy)benzophenone, 2-hydroxy-4-(3-acryloyloxy-2-hydroxypropoxy) benzophenone, 2,2'-dihydroxy-4-(3-methacryloyloxy-2-hydroxypropoxy)-benzophenone, 2,2'-dihydroxy-4-(3-acryloyloxy-2-hydroxypropoxy)-benzophenone, 2-(2'-hydroxy-5'-methacryloyloxyethylphenyl)-2H-benzotriazole and the like;

(xviii) photostable polymerizable unsaturated monomers: for example, 4-(metWacryloyloxy-1,2,2,6,6-pentamethylpiperidine, 4-(metWacryloyloxy-2,2,6,6-tetramethylpiperidine, 4-cyano-4-(meth)acryloylamino-2,2,6,6-tetramethylpiperidine, 1-(meth)acryloyl-4-(meth) acryloylamino-2,2,6,6-tetramethylpiperidine, 1-(meth) acryloyl-4-cyano-4-(meth)acryloylamino-2,2,6,6-tetramethylpiperidine, 4-crotonoyloxy-2,2,6,6-tetramethylpiperidine, 4-crotonoylamino-2,2,6,6-tetramethylpiperidine, 1-crotonoyl-4-crotonoyloxy-2,2,6,6-tetramethylpiperidine and the like;

(xix) carbonyl group-containing polymerizable unsaturated monomers: for example, acrolein, diacetonacrylamide, diacetonmethacrylamide, acetoacetoxyethyl methacrylate, formylstyrol, $C_{4-7}$ vinyl alkyl ketones (e.g., vinyl methyl ketone, vinyl ethyl ketone, vinyl butyl ketone) and the like.

It is permissible for the hydroxy-containing acrylic resin to be concurrently used, as a part thereof, with "urethane-modified acrylic resin" which is formed by extending polyisocyanate compound at a part of hydroxy groups in the resin by urethanation reaction to give the resin higher molecular weight.

The hydroxy-containing acrylic resin preferably has a hydroxy value within a range of generally 1-200 mgKOH/g, in particular, 2-100 mgKOH/g, inter alia, 5-60 mgKOH/g, from the viewpoint of storage stability and water resistance of resulting coating film. The hydroxy-containing acrylic resin preferably has an acid value within a range of generally 1-200 mgKOH/g, in particular, 2-150 mgKOH/g, inter alia, 5-80 mgKOH/g, from the viewpoint of water resistance of resulting coating film.

The hydroxy-containing acrylic resin furthermore preferably has a weight-average molecular weight within a range of generally 2,000-5,000,000, in particular, 10,000-3,500,000, inter alia, 100,000-2,000,000, from the viewpoint of appearance, water resistance and the like of resulting coating film.

Where the water-based first coloring paint (X) contains such a hydroxy-containing acrylic resin, the content of the hydroxy-containing acrylic resin can be generally within a range of 1-80 mass parts, preferably 5-70 mass parts, inter alia, 10-50 mass parts, per 100 mass parts in total of the hydroxy-containing polyester resin (A), curing agent (B) and water-dispersible acrylic resin (C) in the water-based first coloring paint (X).

As the polyurethane resin, for example, the useful is a product which is prepared by the steps of making a urethane prepolymer by reaction of aliphatic and/or alicyclic diisocyanates; at least one diol selected from polyetherdiol, polyesterdiol and polycarbonatediol; low molecular weight polyhydroxy compound; and dimethanolalkanoic acid; neutralizing the prepolymer with tertiary amine and emulsion-dispersing it in water; and, where necessary, mixing the emulsion-dispersion with an aqueous medium containing chain extending agent such as polyamine, crosslinking agent and/or suspending agent and carrying out the reaction until isocyanate groups substantially disappear. According to the above method, normally a self-emulsifying type polyurethane resin having an average particle size ranging from about 0.001-about 3 μm can be obtained. As examples of such polyurethane resin which are commercially available, U-COAT UX-5000 and U-COAT UX-8100 (tradenames, Sanyo Chemical Industries, Ltd.) can be named.

Where the water-based first coloring paint (X) contains the polyurethane resin, the polyurethane resin content can be generally within a range of 1-80 mass parts, preferably 5-70 mass parts, inter alia, 10-50 mass parts, per 100 mass parts in total of the hydroxy-containing polyester resin (A), curing agent (B) and water-dispersible acrylic resin (C) in the water-based first coloring paint (X).

The water-based first coloring paint (X), furthermore, preferably contains pigment (D). As the pigment (D), for example, coloring pigment, extender pigment, effect pigment and the like can be named. The pigment (D) can be used each singly or in combination of two or more.

Where the water-based first coloring paint (X) contains such pigment (D), the content of the pigment (D) can be within a range of generally 1-200 mass parts, preferably 20-150 mass parts, inter alia, 50-120 mass parts, per 100 mass parts in total of the hydroxy-containing polyester resin (A), curing agent (B) and water-dispersible acrylic resin (C) in the water-based first coloring paint (X). In particular, it is convenient that the water-based first coloring paint (X) contains the coloring pigment and/or extender pigment, and the combined content of the coloring pigment and extender pigment is within a range of generally 40-150 mass parts, in particular, 50-130 mass parts, inter alia, 65-110 mass parts, per 100 mass parts in total of the hydroxy-containing polyester resin (A), curing agent (B) and water-dispersible acrylic resin (C) in the water-based first coloring paint (X).

As the coloring pigment, for example, titanium dioxide, zinc oxide, carbon black, molybdenum red, Prussian Blue, cobalt blue, azo pigment, phthalocyanine pigment, quinacridone pigment, isoindoline pigment, vat pigment, perylene pigment, dioxazine pigment, diketopyrrolopyrrole pigment and the like can be named, among which titanium dioxide and carbon black can be conveniently used.

Where a water-based first coloring paint (X) contains coloring pigment, the content of the coloring pigment can be within a range of normally 1-120 mass parts, preferably 3-100 mass parts, inter alia, 5-90 mass parts, per 100 mass parts in total of the hydroxy-containing polyester resin (A), curing agent (B) and water-dispersible acrylic resin (C) in the water-based first coloring paint (X).

As the extender pigment, for example, clay, kaolin, barium sulfate, barium carbonate, calcium carbonate, talc, silica and alumina white can be named. Of those, use of barium sulfate and/or talc is preferred. It is advantageous for the paint to contain as the extender pigment the barium sulfate having an average primary particle size not more than 1 μm, in particular, that within a range of 0.01-0.8 μm, for obtaining a multilayer coating film of excellent smoothness, and of excellent appearance with high flip-flop property and little metallic mottling when a paint containing effect pigment is used as the water-based second coloring paint (Y).

The average primary particle size of barium sulfate as referred to in this invention is the value determined by observing barium sulfate with scanning type electron microscope and averaging the maximum diameters of 20 barium sulfate particles present on a randomly drawn straight line on the electron micrograph.

Where the water-based first coloring paint (X) contains above extender pigment, the content of the extender pigment can be within a range of normally 1-120 mass parts, preferably 5-100 mass parts, inter alia, 10-80 mass parts, per 100 mass parts in total of the hydroxy-containing polyester resin (A), curing agent (B) and water-dispersible acrylic resin (C) in the water-based first coloring paint (X).

Also as the effect pigment, for example, aluminum (including vapor-deposited aluminum), copper, zinc, brass, nickel, aluminum oxide, mica, aluminum oxide covered with titanium oxide or iron oxide, mica covered with titanium oxide or iron oxide, glass flakes, hologram pigment and the like can be named. These effect pigments can be used either alone or in combination of two or more. While aluminum pigment includes leafing type aluminum and non-leafing type aluminum, both types are useful.

Where the water-based first coloring paint (X) contains such effect pigment, the content of the effect pigment can be within a range of normally 1-50 mass parts, preferably 2-30 mass parts, inter alia, 3-20 mass parts, per 100 mass parts in total of the hydroxy-containing polyester resin (A), curing agent (B) and water-dispersible acrylic resin (C) in the water-based first coloring paint (X).

From the viewpoint of improving smoothness and distinctness of image of formed coating film, water-based first coloring paint (X) preferably further contains hydrophobic solvent (E).

As the hydrophobic solvent (E) an organic solvent whose mass soluble in 100 g of water at 20° C. is not more than 10 g, preferably not more than 5 g, inter alia, not more than 1 g, is desirable, examples of which include hydrocarbon solvents such as rubber gasoline, mineral spirit, toluene, xylene, solvent naphtha and the like; alcoholic solvents such as 1-hexanol, 1-octanol, 2-octanol, 2-ethyl-1-hexanol, 1-decanol, benzyl alcohol, ethylene glycol mono-2-ethylhexyl ether, propylene glycol mono-n-butyl ether, dipropylene glycol mono-n-butyl ether, tripropylene glycol mono-n-butyl ether, propylene glycol mono-2-ethylhexyl ether, propylene glycol monophenyl ether and the like; ester solvents such as n-butyl acetate, isobutyl acetate, isoamyl acetate, methylamyl acetate, ethylene glycol monobutyl ether acetate and the like; and ketone solvents such as methyl isobutyl ketone, cyclohexanone, ethyl n-amyl ketone, diisobutyl ketone and the like. These can be used either alone or in combination of two or more.

As the hydrophobic solvent (E), use of alcoholic hydrophobic solvent is preferred. In particular, $C_{7-14}$ alcoholic hydrophobic solvents, inter alia, at least one alcoholic solvent selected from the group consisting of 1-octanol, 2-octanol, 2-ethyl-1-hexanol, ethylene glycol mono-2-ethylhexyl ether, propylene glycol mono-n-butyl ether and dipropylene glycol mono-n-butyl ether, are preferred.

Where the water-based first coloring paint (X) contains such hydrophobic solvent (E), its content is preferably within a range of generally 2-50 mass parts, in particular, 5-40 mass parts, inter alia, 8-30 mass parts, per 100 mass parts in total of the hydroxy-containing polyester resin (A), curing agent (B) and water-dispersible acrylic resin (C).

From the viewpoint of improving smoothness and distinctness of image of formed coating film, the water-based first coloring paint (X) can furthermore contain a diester compound (F) represented by the following general formula (1):

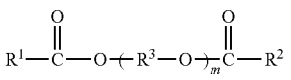

(1)

in the formula, $R^1$ and $R^2$ each independently stands for $C_{4-18}$ hydrocarbon group, $R^3$ stands for $C_{2-4}$ alkylene group, m is an integer of 3-25, and the m $R^3$s may be the same or different.

As the hydrocarbon groups, $C_{5-11}$ alkyl groups, in particular, $C_{5-9}$ alkyl groups, inter alia, $C_{6-8}$ alkyl groups, are preferred. Especially when the $R^1$ and $R^2$ are $C_{6-8}$ branched alkyl groups, excellent smoothness and distinctness of image can be imparted to the formed coating film, even after the paint was stored for a relatively long time before its application.

Above diester compound (F) can be obtained, for example, by diesterification reaction of polyoxyalkylene glycol having two terminal hydroxy groups with monocarboxylic acid having $C_{4-18}$ hydrocarbon group.

Examples of the polyoxyalkylene glycol include polyethylene glycol, polypropylene glycol, ethylene glycol/propylene glycol copolymer, polybutylene glycol and the like, polyethylene glycol being particularly preferred among these. These polyoxyalkylene glycols preferably have a number-average molecular weight within a range of generally 100-1,200, in particular, 150-600, inter alia, 200-400.

Monocarboxylic acid having $C_{4-18}$ hydrocarbon group includes, for example, pentanoic acid, hexanoic acid, 2-ethylbutanoic acid, 3-methylpentanoic acid, benzoic acid, cyclohexanecarboxylic acid, heptanoic acid, 2-ethylpentanoic acid, 3-ethylpentanoic acid, octanoic acid, 2-ethylhexanoic acid, 4-ethylhexanoic acid, nonanoic acid, 2-ethylheptanoic acid, decanoic acid, 2-ethyloctanoic acid, 4-ethyloctanoic acid, dodecanoic acid, hexadecanoic acid and octadecanoic acid. Of those, monocarboxylic acid having $C_{5-9}$ alkyl groups, such as hexanoic acid, heptanoic acid, 2-ethylpentanoic acid, 3-ethylpentanoic acid, octanoic acid, 2-ethylhexanoic acid, 4-ethylhexanoic acid, nonanoic acid, 2-ethylheptanoic acid, decanoic acid, 2-ethyloctanoic acid, 4-ethyloctanoic acid and the like are preferred. In particular, monocarboxylic acid having $C_{6-8}$ alkyl group, such as heptanoic acid, 2-ethylpentanoic acid, 3-ethylpentanoic acid, octanoic acid, 2-ethylhexanoic acid, 4-ethylhexanoic acid, nonanoic acid, 2-ethylheptanoic acid and the like are more favorable, and monocarboxylic acid having $C_{6-8}$ branched alkyl group, such as 2-ethylpentanoic acid, 3-ethylpentanoic acid, 2-ethylhexanoic acid, 4-ethylhexanoic acid, 2-ethylheptanoic acid and the like are the most favorable.

The diesterification reaction of the polyoxyalkylene glycol with monocarboxylic acid having $C_{4-18}$ hydrocarbon group can be carried out by the means known per se. The polyoxyalkylene glycol and the monocarboxylic acid having $C_{4-18}$ hydrocarbon group can be each used either alone or in combination of two or more. The resultant diester compound (F) preferably has a molecular weight within a range of generally 320-1,400, in particular, 450-1,000, inter alia, 500-800, and 500-700 for the best.

Where the water-based first coloring paint (X) contains the diester compound (F), its content preferably is within a range of generally 1-30 mass parts, in particular, 3-20 mass parts, inter alia, 5-15 mass parts, per 100 mass parts in total of the hydroxy-containing polyester resin (A), curing agent (B) and water-dispersible acrylic resin (C).

The water-based first coloring paint (X) can further contain, where necessary, paint additives such as thickener, curing catalyst, UV absorber, light stabilizer, defoaming agent, plasticizing agent, organic solvent other than the hydrophobic solvent (E), surface regulating agent, antisettling agent and the like.

As the thickener, for example, inorganic thickeners such as silicate, metal silicate, montmorillonite, colloidal alumina and the like; polyacrylic acid thickeners such as copolymers of (meth)acrylic acid with (meth)acrylic acid esters, sodium polyacrylate and the like; association type thickeners having hydrophilic moiety and hydrophobic moiety per molecule, which exhibit effective thickening action as the hydrophobic moiety adsorbs onto surfaces of the pigment or emulsion particles in the paint or the hydrophobic moieties mutually associate, in an aqueous medium; cellulose derivative thickeners such as carboxymethyl cellulose, methyl cellulose, hydroxyethyl cellulose and the like; protein thickeners such as casein, sodium caseinate, ammonium caseinate and the like; alginic acid thickeners such as sodium alginate; polyvinyl thickeners such as polyvinyl alcohol, polyvinylpyrrolidone, polyvinyl benzyl ether copolymers and the like; polyether thickeners such as Pluronic polyether, polyether dialkyl ester, polyether dialkyl ether, polyether epoxy-modified products and the like; maleic anhydride copolymer thickeners such as partial esters of vinyl methyl ether-maleic anhydride copolymers; and polyamide thickeners such as polyamide amine salts and the like can be named. These thickeners can be used either alone or in combination of two or more.

Polyacrylic acid thickeners are commercially available, under the tradenames as, for example, PRIMAL ASE-60, PRIMAL TT-615 and PRIMAL RM-5 of Rohm & Haas Co.; SN Thickener 613, SN Thickener 618, SN Thickener 630, SN Thickener 634 and SN Thickener 636 of SAN NOPCO, Ltd. and the like. As commercially available association type thickeners, for example, UH-420, UH-450, UH-462, UH-472, UH-540, UH-752, UH-756 VF and UH-814N (all tradenames) of ADEKA Corporation; PRIMAL RM-8W, PRIMAL RM-825, PRIMAL RM-2020 NPR, PRIMAL RM-12W and PRIMAL SCT-275 (all tradenames) of Rohm & Haas Co.; SN Thickener 612, SN Thickener 621N, SN Thickener 625N, SN Thickener 627N and SN Thickener 660T (all tradenames) of SAN NOPCO, Ltd. can be named.

As the thickener, polyacrylic acid thickeners and/or association type thickeners, in particular, association type thickeners, inter alia, urethane association type thickener having terminal hydrophobic group and containing urethane linkage in its molecular chain, are preferred. As such urethane association type thickeners, commercial products can be used, such as UH-420, UH-462, UH-472, UH-540, UH-752, UH-756 VF and UH-814N (all tradenames) of ADEKA Corporation; SN Thickener 612, SN Thickener 621N, SN Thickener 625N, SN Thickener 627N and SN Thickener 660T (all tradenames) of SAN NOPCO, Ltd.

Where the water-based first coloring paint (X) contains such a thickener, the content of the thickener is preferably within a range of normally 0.01-10 mass parts, in particular, 0.05-3 mass parts, inter alia, 0.1-2 mass parts, per 100 mass parts in total of the hydroxy-containing polyester resin (A), curing agent (B) and water-dispersible acrylic resin (C).

The water-based first coloring paint (X) can be prepared by mixing and dispersing in an aqueous medium the hydroxy-containing polyester resin (A), curing agent (B) and water-dispersible acrylic resin (C), and where necessary, pigment (D), hydrophobic solvent (E), diester compound (F) and other paint additives, by the means known per se. As the aqueous medium, deionized water or a mixture of deionized water and hydrophilic organic solvent can be used. As the hydrophilic organic solvent, for example, propylene glycol monomethyl ether and the like can be named.

The water-based first coloring paint (X) can have a solid concentration within a range of generally 30-80 mass %, preferably 40-70 mass %, inter alia, 45-60 mass %.

The water-based first coloring paint (X) can be applied onto a coating object by the means known per se, for example, air spray coating, airless spray coating, rotary atomizing coating, curtain flow coating and the like. During the coating, static electricity may be impressed. Of these, air spray coating and rotary atomizing coating are preferred.

The application rate of the water-based first coloring paint (X) can be such that will form its cured coating film having a thickness within a range of normally 5-70 μm, preferably 10-50 μm, inter alia, about 15-about 40 μm.

The reason why a coating film excelling in smoothness, distinctness of image, water resistance and chipping resistance can be formed by the multilayer coating film-forming method of the present invention which uses the water-based first coloring paint (X) is not precisely clear. Whereas, it is inferred that the uncured first colored coating film having an adequate hydrophobicity is formed because the water-dispersible acrylic resin (C) in the water-based first coloring paint (X) has relatively long-chain alkyl groups, which, when the water-based second coloring paint is applied onto the first colored coating film, prevents layer mixing between the two coating films to improve smoothness and distinctness of image; and furthermore because infiltration of water into the resulting multilayer coating film is suppressed by the alkyl groups to improve the water resistance. Furthermore, the water-dispersible acrylic resin (C) has adequate pliability due to the relatively long-chain alkyl group therein, it absorbs impact exerted on the formed coating film to improve the film's chipping resistance. It is furthermore inferred: because a continuous layer of the hydroxy-containing polyester resin (A) and the curing agent (B) is formed in the interspaces of the water-dispersible acrylic resin (C), in the formed coating film, smoothness and water resistance of the film are improved.

Step 2:

Onto the coating film of the water-based first coloring paint (X) (hereafter may be referred to as "first colored coating film") as formed in the above-described step (1), then a water-based second coloring paint (Y) is applied.

From the viewpoint of preventing occurrence of coating film defect such as foaming, the first colored coating film is preferably given a preheating (preliminary heating), air blowing or the like treatment under such heating conditions as will not substantially cure the coating film, before applying a water-based second coloring paint thereon. The preheating temperature normally ranges about 40-about 100° C., in particular, about 50-about 90° C., inter alia, about 60-about 80° C. The preheating time can range normally around 30 seconds-15 minutes, in particular, around 1-10 minutes, inter alia, around 2-5 minutes. The air blowing can be carried out by blowing against the coated surface of the coating object, normally air of ambient temperature or air heated to a temperature of 25-about 80° C., for around 30 seconds-15 minutes. In the present specification, furthermore, "uncured coating film" includes coating film in set-to-touch dry condition and that in dry-to-touch condition.

Before applying the water-based second coloring paint (Y), the solid content of the first colored coating film is preferably adjusted to fall within a range of normally 60-100 mass %, in particular, 80-100 mass %, inter alia, 90-100 mass %, where necessary by carrying out such preheating, air blowing or the like.

Here the solid content of the coating film can be measured by the following method: first, simultaneously with applying the water-based first coloring paint (X) onto a coating object, the same water-based first coloring paint (X) is applied onto a piece of aluminum foil whose mass ($W_1$) was measured in advance. Subsequent to the application, the aluminum foil which is given a preheating or the like treatment is recovered immediately before the water-based second coloring paint (Y) is applied and its mass ($W_2$) is measured. Then the recovered aluminum foil is dried at 110° C. for 60 minutes, allowed to cool off to room temperature in a desiccastor, and its mass ($W_3$) is measured. The solid content is determined according to the following equation:

$$\text{solid content (mass \%)}=\{(W_3-W_1)/(W_2-W_1)\}\times 100.$$

The water-based second coloring paint (Y) generally aims at imparting excellent appearance to the coated objects. For example, those paints formulated by dissolving or dispersing in water, resin component composed of a base resin having crosslinkable functional groups such as carboxy, hydroxy or the like, such as acrylic resin, polyester resin, alkyd resin, urethane resin, epoxy resin or the like; and a curing agent such as optionally blocked polyisocyanate compound, melamine resin, urea resin or the like; concurrently with pigment and other additives, can be used. In particular, thermosetting water-based paint comprising the hydroxy-containing polyester resin (A) and/or hydroxy-containing acrylic resin as the base resin and melamine resin as the curing agent can be suitably used.

As the pigment, earlier described coloring pigment, extender pigment, effect pigment and the like can be used. In particular, the water-based second coloring paint (Y) preferably contains coloring and/or effect pigment, as at least one of the pigments.

As the coloring pigments, for example, titanium oxide, zinc flower, carbon black, molybdenum red, Prussian Blue, cobalt blue, azo pigment, phthalocyanine pigment, quinacridone pigment, isoindoline pigment, vat pigment, perylene pigment, dioxazine pigment, diketopyrrolopyrrole pigment and the like, as exemplified in the explanation of the water-based first coloring paint (X), can be named.

Where the water-based second coloring paint (Y) contains such coloring pigment, the content of the coloring pigment can be within a range of normally 1-150 mass parts, preferably 3-130 mass parts, inter alia, 5-110 mass parts, per 100 mass parts of the solid resin content in the water-based second coloring paint (Y).

As the effect pigment, for example, aluminum (including vapor-deposited aluminum), copper, zinc, brass, nickel, aluminum oxide, mica, aluminum oxide covered with titanium oxide or iron oxide, mica covered with titanium oxide or iron oxide, glass flakes, hologram pigment and the like can be named, as exemplified in the explanation of the water-based first coloring paint (X). Of these, use of aluminum, aluminum oxide, mica, aluminum oxide coated with titanium oxide or iron oxide, or mica coated with titanium oxide or iron oxide is preferred, in particular, use of aluminum being preferred. These effect pigments can be used either alone or in combination of two or more.

It is also preferred that the effect pigment is flaky. As the effect pigments, those having the longitudinal dimention within a range of normally 1-100 μm, in particular, 5-40 μm, and the thickness, within a range of normally 0.001-5 μm, in particular, 0.01-2 μm are suitable.

Where the water-based second coloring paint (Y) contains effect pigment, the content of the effect pigment preferably is within a range of normally 1-50 mass parts, in particular, 2-30 mass parts, inter alia, 3-20 mass parts, per 100 mass parts of the solid resin content of the water-based second coloring paint (Y).

The water-based second coloring paint (Y) also suitably contains the hydrophobic solvent (E). As the hydrophobic solvent (E), use of alcoholic hydrophobic solvent is preferred for excellent brilliance of formed coating film. In particular, $C_{7-14}$ alcoholic hydrophobic solvent, for example, at least one of alcoholic hydrophobic solvent selected from the group consisting of 1-octanol, 2-octanol, 2-ethyl-1-hexanol, ethylene glycol mono-2-ethylhexyl ether, propylene glycol mono-n-butyl ether and dipropylene glycol mono-n-butyl ether is even more suitable.

Where the water-based second coloring paint (Y) contains the hydrophobic solvent (E), its content preferably is within a range of normally 2-70 mass parts, in particular, 11-60 mass parts, inter alia 16-50 mass parts, per 100 mass parts of the solid resin content in the water-based second coloring paint (Y), for excellent brilliance of formed coating film.

The water-based second coloring paint (Y) can further contain, where necessary, such ordinary paint additives as curing catalyst, thickener, UV absorber, light stabilizer, defoamer, plasticizer, organic solvent, surface-regulating agent, antisettling agent and the like, either alone or in combination of two or more.

The water-based second coloring paint (Y) can be applied by any method known per se, such as air spray, airless spray, or with rotary atomizing coating machine. Static electricity may be impressed in the occasion of coating operation. The coated film thickness can be within a range of normally 5-80 μm, preferably 8-60 μm, inter alia, 10-50 μm, in terms of cured film thickness.

Step (3):

According to the first multilayer coating film-forming method of the present invention, a clear paint (Z) is applied onto the coating film of the water-based second coloring paint (Y) (which hereafter may be referred to as "the second colored coating film") as formed in the above step (2).

From the viewpoint of preventing occurrence of defect in the coated film such as foaming, the second colored coating film is preferably given such a treatment as preheating or air blowing under the heating conditions as will not substantially cure the coating film, before application of the clear paint (Z). The preheating temperature normally ranges about 40-about 100° C., preferably about 50-about 90° C., inter alia, about 60-about 80° C. The preheating time can range normally around 30 seconds-15 minutes, preferably around 1-10 minutes, inter alia, around 2-5 minutes. The air blowing can be normally carried out by blowing against the coated surface of the coating object, air of ambient temperature or air heated to a temperature of 25-about 80° C., for around 30 seconds-15 minutes.

Before applying the clear paint (Z), the solid content of the second colored coating film is preferably adjusted to fall within a range of normally 70-100 mass %, in particular, 80-100 mass %, inter alia, 90-100 mass %, where necessary by carrying out such preheating, air blowing or the like.

As the clear paint (Z), any of thermosetting clear paint compositions known as those for coating car bodies and the like can be used. For example, organic solvent-based thermosetting paint compositions, water-based thermosetting paint compositions, powder thermosetting paint compositions, which comprise base resin having crosslinkable functional groups and crosslinking agent, can be named.

Examples of the crosslinkable functional group include carboxy, hydroxy, epoxy, silanol and the like groups. As species of the base resin, for example, acrylic resin, polyester resin, alkyd resin, urethane resin, epoxy resin and fluorinated resin can be named. Examples of the crosslinking agent include polyisocyanate compound, blocked polyisocyanate compound, melamine resin, urea resin, carboxy-containing compound, carboxy-containing resin, epoxy-containing resin, epoxy-containing compound and the like.

As combinations of the base resin/crosslinking agent in the clear paint composition, carboxy-containing resin/epoxy-containing resin, hydroxy-containing resin/polyisocyanate compound, hydroxy-containing resin/blocked polyisocyanate compound, hydroxy-containing resin/melamine resin or the like are preferred.

The clear paint (Z) may be of one-package type paint or multi-package type paint such as two-package type urethane resin paint.

The clear paint (Z) may also contain, where necessary, coloring pigment, effect pigment, dye or the like to an extent not impairing transparency, and furthermore, suitably extender pigment, UV absorber, light stabilizer, defoamer, thickener, rust-proofing agent, surface-regulating agent and the like.

The clear paint (Z) can be applied onto the coated film surface of the water-based second coloring paint (Y) by per se known method, for example, such methods as air spray coating, airless spray coating, rotary atomizing coating and the like. In the occasion of its application, static electricity may be impressed. The clear paint (Z) can be applied to provide a cured film thickness within a range of normally 10-80 μm, preferably 15-60 μm, inter alia, 20-50 μm.

After applying the clear paint (Z), where necessary the coated film may be allowed to stand for an interval of about 1-60 minutes at room temperature or preheated at about 40-about 80° C. for around 1-60 minutes.

Step (4)

According to the first multilayer coating film-forming method of the present invention, the uncured first colored coating film, uncured second colored coating film and uncured clear coating film as formed in the above-described Steps (1)-(3) are simultaneously heated and cured.

Curing of the first colored coating film, second colored coating film and clear coating film can be effected by ordinary baking means of coated film, for example, hot air heating, infrared ray heating, high frequency heating or the like. The heating temperature can be within a range of normally about 80-about 180° C., preferably about 100-about 170° C., inter alia, about 120-about 160° C. While the heating time is not particularly limited, it can be normally around 10-60 minutes, in particular, around 15-40 minutes. By this heating the multilayer coating film formed of the three layers of first colored coating film, second colored coating film and clear coating film can be simultaneously cured.

The first multilayer coating film-forming method comprising the above Steps (1)-(4) can be conveniently used, specifically, in an occasion of forming on a coating object such as a car body a multilayer coating film consisting of an intermediate coating film, a base coating film and clear coating film by 3-coat-1-bake system. The formation of the multilayer coating film in this occasion can be performed according to the following method I.

Method I

A multilayer coating film-forming method comprising:

(1) a step of applying the water-based first coloring paint (X) onto a coating object to form an intermediate coating film;

(2) a step of applying the water-based second coloring paint (Y) onto the uncured intermediate coated film to form a base coating film, (3) a step of applying the clear paint (Z) onto the uncured base coating film to form a clear coating film, and (4) a step of simultaneously heating and curing the uncured intermediate coating film, uncured base coating film and uncured clear coating film.

As the object to be coated by the above method I, car bodies or the like on which an undercoat film of cationic electrodeposition paint has been formed are preferred.

According to the method I, the coated film thickness of the water-based first coloring paint (X), in terms of cured film thickness, preferably is within a range of normally 5-70 μm, in particular, 10-50 μm, inter alia, 15-40 μm. Also the coated film thickness of the water-based second coloring paint (Y), in terms of cured film thickness, is preferably within a range of normally 5-30 μm, in particular, 8-25 μm, inter alia, 10-20 μm. The coated film thickness of the clear paint (Z), in terms of cured film thickness, preferably is within a range of normally 10-80 μm, in particular, 5-60 μm, inter alia, 20-50 μm.

Step (5):

According to the second multilayer coating film-forming method of the present invention, the steps (3) and (4) in the first multilayer coating film-forming method are omitted, and the following step (5) is carried out subsequent to the above-described steps (1) and (2).

The step (5) is a step for simultaneously heating and curing the first colored coating film and the second colored coating film as formed in the steps (1) and (2).

Curing of the first colored coating film and second colored coating film can be effected by ordinary baking means of coated film, for example, hot air heating, infrared ray heating, high frequency heating or the like. The heating temperature can be within a range of normally 80-180° C., preferably 100-170° C., inter alia, 120-160° C. The heating time can be normally around 10-60 minutes, in particular, around 15-40 minutes. By this heating the multilayer coating film formed of the first colored coating film and second colored coating film can be simultaneously cured.

Before heat-curing the second colored coating film, it is preferred to carry out a preheating, air blowing or the like as earlier described, under the heating conditions as will not substantially cure the coating film. The preheating temperature normally ranges 40-100° C., in particular, 50-90° C., inter alia, 60-80° C. The preheating time preferably ranges normally around 30 seconds-15 minutes, in particular, around 1-10 minutes, inter alia, around 2-5 minutes. The air blowing can be normally carried out by blowing against the coated surface of the coating object, air of ambient temperature or air heated to a temperature of 25-80° C., for around 30 seconds-15 minutes.

The solid content of the second colored coating film is preferably adjusted by the preheating, air blowing or the like as above, to fall within a range of normally 70-100 mass %, in particular, 80-100 mass %, inter alia, 90-100 mass %.

The second multilayer coating film-forming method of the present invention comprising the steps (1), (2) and (5) can be conveniently used, specifically, in an occasion of forming on a coating object such as a car body a multiple layer coating film consisting of an intermediate coating film and top coating film by 2-coat-1-bake system. The formation of the multilayer coating film in this occasion can be preformed according to the following method II.

Method II (1) a step of applying the water-based first coloring paint (X) onto a coating object to form an intermediate coating film;

(2) a step of applying the water-based second coloring paint (Y) onto the uncured intermediate coating film to form a top coating film, and (3) a step of simultaneously heating and curing the uncured intermediate coating film and the uncured top coating film.

The coating object in the method II preferably is a car body or the like, on which an undercoat film has been formed with a cationic electrodeposition paint.

According to the method II, the coated film thickness of the water-based first coloring paint (X), in terms of cured film thickness, preferably is within a range of normally 5-70 μm, in particular, 10-50 μm, inter alia, 15-40 μm. Also the coated film thickness of the water-based second coloring paint (Y), in terms of cured film thickness, is preferably within a range of normally 10-80 μm, in particular, 15-60 μm, inter alia, 20-50 μm.

Example

Hereinafter the invention is explained more specifically, referring to working Examples and Comparative Examples, it being understood that the invention is not limited to these Examples only "Part" and "%" are invariably by mass.

Preparation of hydroxy-containing polyester resin (A)

Production Example 1

A reactor equipped with a thermometer, thermostat, stirrer, reflux condenser and water-separator was charged with 174 parts of trimethylolpropane, 327 parts of neopentyl glycol, 352 parts of adipic acid, 109 parts of isophthalic acid and 101 parts of 1,2-cyclohexanedicarboxylic anhydride, and the temperature therein was raised from 160° C. to 230° C. over 3 hours. While maintaining the temperature at 230° C. and distilling off the formed water of condensation with the water separator, the reaction was carried out until the acid value became no higher than 3 mgKOH/g. To the reaction product 59 parts of trimellitic anhydride was added, followed by 30 minutes' addition reaction at 170° C. Cooling the reaction product to 50° C. or lower, an equivalent to the acid groups therein of 2-(dimethylamino)ethanol was added for neutralization. Then deionized water was gradually added to provide a hydroxy-containing polyester resin solution (A-1) having a solid content of 45% and pH of 7.2. The combined content of the aliphatic polybasic acid and alicyclic polybasic acid was 76 mol % and the aromatic polybasic acid content was 24 mol % in the resultant hydroxy-containing polyester resin, based on its total acid component. The resin had an acid value of 35 mgKOH/g, hydroxy value of 128 mgKOH/g and number-average molecular weight of 1,480.

Production Example 2

A reactor equipped with a thermometer, thermostat, stirrer, reflux condenser and water-separator was charged with 168 parts of trimethylolpropane, 316 parts of neopentyl glycol, 93 parts of adipic acid, 211 parts of isophthalic acid 188 parts of phthalic anhydride and 65 parts of 1,2-cyclohexanedicarboxylic anhydride, and the temperature therein was raised from 160° C. to 230° C. over 3 hours. While maintaining the temperature at 230° C. and distilling off the formed water of condensation with the water separator, the reaction was carried out until the acid value became no higher than 3 mgKOH/g. To the reaction product 59 parts of trimellitic anhydride was added, followed by 30 minutes' addition reaction at 170° C. Cooling the reaction product to 50° C. or lower, an equivalent to the acid groups therein of 2-(dimethylamino)ethanol was added for neutralization. Then deionized water was gradually added to provide a hydroxy-containing polyester resin solution (A-2) having a solid content of 45% and pH of 7.2. The combined content of the aliphatic polybasic acid and alicyclic polybasic acid was 27 mol % and the aromatic polybasic acid content was 73 mol % in the resultant hydroxy-containing polyester resin, based on its total acid component. The resin had an acid value of 35 mgKOH/g, hydroxy value of 124 mgKOH/g and number-average molecular weight of 1,530.

Production Example 3

A reactor equipped with a thermometer, thermostat, stirrer, reflux condenser and water-separator was charged with 166 parts of trimethylolpropane, 314 parts of neopentyl glycol, 338 parts of adipic acid and 194 parts of 1,2-cyclohexanedicarboxylic anhydride, and the temperature therein was raised from 160° C. to 230° C. over 3 hours. While maintaining the temperature at 230° C. and distilling off the formed water of condensation with the water separator, the reaction was carried out until the acid value became no higher than 3 mgKOH/g. To the reaction product 94 parts of 1,2-cyclohexanedicarboxylic anhydride was added, followed by 30 minutes' addition reaction at 170° C. Cooling the reaction product to 50° C. or lower, an equivalent to the acid groups therein of 2-(dimethylamino)ethanol was added for neutralization. Then deionized water was gradually added to provide a hydroxy-containing polyester resin solution (A-3) having a solid content of 45% and pH of 7.2. The combined content of the aliphatic polybasic acid and alicyclic polybasic acid was 100 mol % and the aromatic polybasic acid content was 0 mol % in the resultant hydroxy-containing polyester resin, based on its total acid component. The resin had an acid value of 35 mgKOH/g, hydroxy value of 106 mgKOH/g and number-average molecular weight of 1,540.

Production Example 4

A reactor equipped with a thermometer, thermostat, stirrer, reflux condenser and water-separator was charged with 51.3 parts of trimethylolpropane, 355 parts of neopentyl glycol, 165 parts of adipic acid, 187 parts of isophthalic acid and 174 parts of 1,2-cyclohexanedicarboxylic anhydride, and the temperature therein was raised from 160° C. to 230° C. over 5 hours. While maintaining the temperature at 230° C. and distilling off the formed water of condensation with the water separator, the reaction was carried out until the acid value became no higher than 2.5 mgKOH/g. To the reaction product 1.70 parts of trimellitic anhydride was added, followed by an hour's addition reaction at 170° C. Cooling the reaction product to 85° C. or lower, an equivalent to the acid groups therein of 2-(dimethylamino)ethanol was added for neutralization. Then deionized water was gradually added to provide a hydroxy-containing polyester resin solution (A-4) having a solid content of 45% and pH of 7.1. The combined content of the aliphatic polybasic acid and alicyclic polybasic acid was 53 mol % and the aromatic polybasic acid content was 47 mol % in the resultant hydroxyl-containing polyester resin based on its total acid component. The resin had an acid value of 100 mgKOH/g, hydroxy value of 15 mgKOH/g and number-average molecular weight of 2,450.

Production of Water-Dispersible Acrylic Resin (C)

Production Example 5

A reactor equipped with a thermometer, thermostat, stirrer, reflux condenser, nitrogen inlet pipe and dropping device was charged with 130 parts of deionized water and 0.52 part of AQUALON KH-10 (tradename, Daiichi Kogyo Seiyaku Co., Ltd., polyoxyethylene alkyl ether sulfate ester ammonium salt, active ingredient, 97%), which were stirred and mixed in nitrogen gas current, and the temperature was raised to 80° C.

Then 1% of the total amount of the following monomer emulsion (1) and 5.3 parts of 6% aqueous ammonium persulfate solution were introduced into the reactor and kept at 80° C. for 15 minutes. The remainder of the monomer emulsion (1) was dropped into the reactor which was maintained at the same temperature, over 3 hours, followed by 1 hour's aging. Thereafter the following monomer emulsion (2) was added dropwise over an hour, and after the subsequent 1 hour's aging, the reactor was cooled to 30° C. under gradual addition of 40 parts of 5% aqueous 2-(dimethylamino)ethanol solution to provide a dispersion of water-dispersible acrylic resin (C-1) having a solid content of 30% and an average particle size of 195 nm [measured with a submicron particle size distribution-measuring device, COULTER N4 Model (tradename, Beckman Coulter, Inc.) as diluted with deionized water, at 20° C.]. The resultant water-dispersible acrylic resin had a hydroxy value of 20 mgKOH/g, acid value of 0 mgKOH/g, and in which the ratio of $C_{5-22}$ alkyl-containing polymerizable unsaturated monomer (c-1) was 33.6 mass % based on the monomer component. The ratio of the $C_{5-22}$ alkyl-containing polymerizable unsaturated monomer (c-1) in the polymer (I) was 48 mass %, and the ratio of $C_{1-2}$ alkyl-containing polymerizable unsaturated monomer (c-3) in the polymer (II) was 84 mass %. The polymer (I) had a glass transition temperature ($Tg_1$) of −28° C., and the polymer (II) had a glass transition temperature ($Tg_2$) of 63° C.

Monomer emulsion (1): Mixing by stirring 42 parts of deionized water, 0.72 part of AQUALON KH-10, 33.6 parts of 2-ethylhexyl acrylate, 2.8 parts of allyl methacrylate and 33.6 parts of ethyl acrylate, monomer emulsion (1) was obtained.

Monomer emulsion (2): Mixing by stirring 18 parts of deionized water, 0.31 part of AQUALON KH-10, 0.03 part of ammonium persulfate, 25.2 parts of methyl methacrylate, 1.2 parts of 2-hydroxyethyl acrylate and 3.6 parts of 4-hydroxybutyl acrylate, the monomer emulsion (2) was obtained.

Production Examples 6-11, 14-33

Production Example 4 was repeated except that the compositions of the monomer emulsions (1) and (2) were changed as shown in the later appearing Table 1, to provide water-dispersible acrylic resin dispersions (C-2)-(C-7) and (C-10)-(C-29). The solid content, acid value, hydroxy value, ratio of the $C_{5-22}$ alkyl-containing polymerizable unsaturated monomer (c-1) in the monomer component, ratio of the $C_{5-22}$ alkyl-containing unsaturated monomer (c-1) in the polymer (I), ratio of the $C_{1-2}$ alkyl-containing polymerizable unsaturated monomer (c-3) in the polymer (II), glass transition temperature and average particle size of each of the water-dispersible acrylic resin dispersions (C-1)-(C-7) and (C-10)-(C-29), concurrently with those of Production Example 5, are shown in the following Table 1.

Production Example 12

A reactor equipped with a thermometer, thermostat, stirrer, reflux condenser, nitrogen inlet pipe and dropping device was charged with the following monomer emulsion (1). After raising its temperature to 85° C., 16 parts of 6% aqueous ammonium persulfate solution was introduced into the reactor, followed by 2 hours' stirring, while the same temperature was maintained. Thus a resin dispersion having an average particle size of 150 nm was obtained. Then the following monomer emulsion (2) was added dropwise over an hour, aged for another hour and cooled to 40° C. Deionized water and 2-(dimethylamino)ethanol were introduced into the reaction mixture to provide a water-dispersible acrylic resin dispersion (C-8) having pH of 8.0, solid content of 30% and average particle size of 165 nm. Thus obtained water-dispersible acrylic resin had a hydroxy value of 19 mgKOH/g, an acid value of 0 mgKOH/g, and in which the ratio of $C_{5-22}$ alkyl-containing polymerizable unsaturated monomer (c-1) was 67.2 mass % based on the monomer component. The ratio of the $C_{5-22}$ alkyl-containing polymerizable unsaturated monomer (c-1) in the polymer (I) was 96 mass %, and the ratio of $C_{1-2}$ alkyl-containing polymerizable unsaturated monomer (c-3) in the polymer (II) was 84 mass %. The polymer (I) had a glass transition temperature ($Tg_1$) of −63° C., and the polymer (II) had a glass transition temperature ($Tg_2$) of 63° C.

Monomer emulsion (1): The monomer emulsion (1) having an average particle size of 160 nm was obtained by mixing by stirring 70 parts of deionized water, 7 parts of NEWCOL 707SF (tradename, Nippon Nyukazai Co., Ltd., ammonium polyoxyethylene alkylbenzenesulfonate, active ingredient 30%), 33.6 parts of dodecyl methacrylate, 33.6 parts of tridecyl methacrylate and 2.8 parts of allyl methacrylate; and further subjecting the mixture to a high pressure treatment with a high-pressure emulsifier (Nanomizer, Yoshida KIKAI Co. Ltd.) at 100 MPa, Monomer emulsion (2): The monomer emulsion (2) was obtained by mixing by stirring 14 parts of deionized water, 3 parts of NEWCOL 707SF, 25.2 parts of methyl methacrylate and 4.8 parts of 4-hydroxybutyl acrylate.

Production Example 13

A reactor equipped with a thermometer, thermostat, stirrer, reflux condenser, nitrogen inlet pipe and dropping device was charged with the following monomer emulsion (1). After raising its temperature to 85° C., 16 parts of 6% aqueous ammonium persulfate solution was introduced into the reactor, followed by 2 hours' stirring, while the same temperature was maintained. Thus a resin dispersion having an average particle size of 155 nm was obtained. Then the following monomer emulsion (2) was added dropwise over an hour, aged for another hour and cooled to 40° C. Deionized water and 2-(dimethylamino)ethanol were introduced into the reaction mixture to provide a water-dispersible acrylic resin dispersion (C-9) having pH of 8.0, solid content of 30% and average particle size of 167 nm. Thus obtained water-dispersible acrylic resin had a hydroxy value of 19 mgKOH/g and an acid value of 0 mgKOH/g, and in which the ratio of $C_{5-22}$ alkyl-containing polymerizable unsaturated monomer (c-1) was 67.2 mass % based on the monomer component. The ratio of the $C_{5-22}$ alkyl-containing polymerizable unsaturated monomer (c-1) in the polymer (I) was 96 mass %, and the ratio of $C_{1-2}$ alkyl-containing polymerizable unsaturated monomer (c-3) in the polymer (II) was 84 mass %. The polymer (I) had a glass transition temperature ($Tg_1$) of −29° C., and the polymer (II) had a glass transition temperature ($Tg_2$) of 63° C.

Monomer emulsion (1): The monomer emulsion (1) having an average particle size of 162 nm was obtained by mixing by stirring 70 parts of deionized water, 7 parts of NEWCOL 707SF, 46.2 parts of 2-ethylhexyl acrylate, 21 parts of Isostearyl Acrylate (tradename, Osaka Organic Chemical Industry, Ltd., branched higher alkyl acrylate) and 2.8 parts of allyl methacrylate, and further subjecting the mixture to a high pressure treatment with a high-pressure emulsifier (Nanomizer, Yoshida Kikai Co., Ltd.) at 100 MPa.

Monomer emulsion (2): The monomer emulsion (2) was obtained by mixing by stirring 14 parts of deionized water, 3 parts of NEWCOL 707SF, 25.2 parts of methyl methacrylate and 4.8 parts of 4-hydroxybutyl acrylate.

TABLE 1

| Production Example | | | | | 5 | 6 | 7 | 8 | 9 |
|---|---|---|---|---|---|---|---|---|---|
| Water-dispersible acrylic resin dispersion | | | | | C-1 | C-2 | C-3 | C-4 | C-5 |
| Monomer emulsion (1) | deionized water | | | | 42 | 42 | 48 | 42 | 42 |
| | Aqualon KH-10 | | | | 0.72 | 0.72 | 0.82 | 0.72 | 0.72 |
| | Newcol 707 SF | | | | | | | | |
| | monomer (c-1) | $C_{5-22}$ alkyl-containing polymerizable unsaturated monomer | | 2-ethylhexyl acrylate | 33.6 | 39.2 | 51.2 | 58.8 | 67.2 |
| | | | | dodecyl methacrylate | | | | | |
| | | | | tridecyl methacrylate | | | | | |
| | | | | isostearyl acrylate | | | | | |
| | monomer (c-2) | monomer (c-7) | polymerizable unsaturated monomer having at least 2 polymerizable unsaturated groups per molecule | allyl methacrylate | 2.8 | 2.8 | 3.2 | 2.8 | 2.8 |
| | | | | ethyl acrylate | 33.6 | 28 | 25.6 | | |
| | | | | n-butyl acrylate | | | | 8.4 | |
| | | | | styrene | | | | | |
| Monomer emulsion (2) | deionized water | | | | 18 | 18 | 12 | 18 | 18 |
| | Aqualon KH-10 | | | | 0.31 | 0.31 | 0.21 | 0.31 | 0.31 |
| | Newcol 707 SF | | | | | | | | |
| | ammonium persulfate | | | | 0.03 | 0.03 | 0.02 | 0.03 | 0.03 |
| | monomer (c-3) | $C_{1-2}$ alkyl-containing polymerizable unsaturated monomer | | methyl methacrylate | 25.2 | 25.2 | 16.8 | 25.2 | 30 |
| | monomer (c-4) | monomer (C-10) | hydroxy-containing polymerizable unsaturated monomer | 2-hydroxyethyl acrylate | 1.2 | | | | |
| | | | | 4-hydroxybutyl acrylate | 3.6 | 4.8 | 3.2 | 4.8 | |
| Solid content (%) | | | | | 30 | 30 | 30 | 30 | 30 |
| Hydroxy value (mgKOH/g) | | | | | 20 | 19 | 12 | 19 | 0 |
| Acid value (mgKOH/g) | | | | | 0 | 0 | 0 | 0 | 0 |
| Ratio of $C_{5-22}$ alkyl-containing polymerizable unsaturated monomer (c-1) in the monomer component (mass %) | | | | | 33.6 | 39.2 | 51.2 | 58.8 | 67.2 |
| Ratio of $C_{5-22}$ alkyl-containing polymerizable unsaturated monomer (c-1) in polymer (I) (mass %) | | | | | 48 | 56 | 64 | 84 | 96 |
| Ratio of $C_{1-2}$ alkyl-containing polymerizable unsaturated monomer (c-3) in polymer (II) (mass %) | | | | | 84 | 84 | 84 | 84 | 100 |
| Glass transition temp. Tg (° C.) | glass transition temp. ($Tg_1$) of polymer (I) | | | | −28 | −32 | −36 | −51 | −51 |
| | glass transition temp. ($Tg_2$) of polymer (II) | | | | 63 | 63 | 63 | 63 | 105 |
| Average particle size (nm) | | | | | 195 | 188 | 190 | 194 | 184 |

| Production Example | | | | | 10 | 11 | 12 | 13 | 14 |
|---|---|---|---|---|---|---|---|---|---|
| Water-dispersible acrylic resin dispersion | | | | | C-6 | C-7 | C-8 | C-9 | C-10 |
| Monomer emulsion (1) | deionized water | | | | 42 | 42 | 70 | 70 | 36 |
| | Aqualon KH-10 | | | | 0.72 | 0.72 | | | 0.62 |
| | Newcol 707 SF | | | | | | 7 | 7 | |
| | monomer (c-1) | $C_{5-22}$ alkyl-containing polymerizable unsaturated monomer | | 2-ethylhexyl acrylate | 61.6 | 67.2 | | 46.2 | 51.6 |
| | | | | dodecyl methacrylate | | | 33.6 | | |
| | | | | tridecyl methacrylate | | | 33.6 | | |
| | | | | isostearyl acrylate | | | | 21 | |
| | monomer (c-2) | monomer (c-7) | polymerizable unsaturated monomer having at least 2 polymerizable unsaturated groups per molecule | allyl methacrylate | 2.1 | 2.8 | 2.8 | 2.8 | 2.4 |
| | | | | ethyl acrylate | | | | | |
| | | | | n-butyl acrylate | | | | | 6 |
| | | | | styrene | 6.3 | | | | |
| Monomer emulsion (2) | deionized water | | | | 18 | 18 | 14 | 14 | 24 |
| | Aqualon KH-10 | | | | 0.31 | 0.31 | | | 0.41 |
| | Newcol 707 SF | | | | | | 3 | 3 | |
| | ammonium persulfate | | | | 0/03 | 0.03 | | | 0.04 |
| | monomer (c-3) | $C_{1-2}$ alkyl-containing polymerizable unsaturated monomer | | methyl methacrylate | 25.2 | 25.2 | 25.2 | 25.2 | 33.6 |
| | monomer (c-4) | monomer (C-10) | hydroxy-containing polymerizable unsaturated monomer | 2-hydroxyethyl acrylate | | | | | |
| | | | | 4-hydroxybutyl acrylate | 4.8 | 4.8 | 4.8 | 4.8 | 6.4 |
| Solid content (%) | | | | | 30 | 30 | 30 | 30 | 30 |
| Hydroxy value (mgKOH/g) | | | | | 19 | 19 | 19 | 19 | 25 |
| Acid value (mgKOH/g) | | | | | 0 | 0 | 0 | 0 | 0 |
| Ratio of $C_{5-22}$ alkyl-containing polymerizable unsaturated monomer (c-1) in the monomer component (mass %) | | | | | 61.6 | 67.2 | 67.2 | 67.2 | 51.6 |
| Ratio of $C_{5-22}$ alkyl-containing polymerizable unsaturated monomer (c-1) in polymer (I) (mass %) | | | | | 88 | 96 | 96 | 96 | 86 |
| Ratio of $C_{1-2}$ alkyl-containing polymerizable unsaturated monomer (c-3) in polymer (II) (mass %) | | | | | 84 | 84 | 84 | 84 | 84 |
| Glass transition temp. Tg (° C.) | glass transition temp. ($Tg_1$) of polymer (I) | | | | −43 | −51 | −63 | −29 | −51 |
| | glass transition temp. ($Tg_2$) of polymer (II) | | | | 63 | 63 | 63 | 63 | 63 |
| Average particle size (nm) | | | | | 193 | 195 | 165 | 167 | 210 |

TABLE 1-continued

| Production Example | | | | | 15 | 16 | 17 | 18 | 19 |
|---|---|---|---|---|---|---|---|---|---|
| Water-dispersible acrylic resin dispersion | | | | | C-11 | C-12 | C-13 | C-14 | C-15 |
| Monomer emulsion (1) | deionized water | | | | 42 | 42 | 42 | 42 | 42 |
| | Aqualon KH-10 | | | | 0.72 | 0.72 | 0.72 | 0.72 | 0.72 |
| | monomer (c-1) | $C_{5-22}$ alkyl-containing polymerizable unsaturated monomer | | 2-ethylhexyl acrylate | 67.2 | 67.2 | 67.2 | 59.5 | 59.5 |
| | monomer (c-2) | monomer (c-7) | polymerizable unsaturated monomer having at least 2 polymerizable unsaturated groups per molecule | allyl methacrylate | 2.8 | 2.8 | 2.8 | 2.1 | 2.1 |
| | | | | 1,6-hexanediol diacrylate | | | | | |
| | | monomer (c-8) | functional group-containing polymerizable unsaturated monomer | glycidyl methacrylate | | | | | |
| | | monomer (c-9) | polymerizable unsaturated monomer having functional group complementally reactable with functional group in polymerizable unsaturated monomer (c-8) | methacrylic acid | | | | | |
| | | | | methyl methacrylate | | | | | |
| | | | | n-butyl acrylate | | | | 8.4 | 8.4 |
| Monomer emulsion (2) | deionized water | | | | 18 | 18 | 18 | 18 | 18 |
| | Aqualon KH-10 | | | | 0.31 | 0.31 | 0.31 | 0.31 | 0.31 |
| | ammonium persulfate | | | | 0.03 | 0.03 | 0.03 | 0.03 | 0.03 |
| | monomer (c-3) | $C_{1-2}$ alkyl-containing polymerizable unsaturated monomer | | methyl methacrylate | 25.8 | 24 | 23.1 | 22.8 | 21.6 |
| | monomer (c-4) | monomer (c-7) | polymerizable unsaturated monomer having at least 2 polymerizable unsaturated groups per molecule | allyl methacrylate | | | | | |
| | | monomer (c-10) | hydroxy-containing polymerizable unsaturated monomer | 2-hydroxyethyl acrylate | 4.2 | | | | |
| | | | | 4-hydroxybutyl acrylate | | 4.8 | 4.8 | 4.2 | 5.4 |
| | | monomer (c-11) | carboxy-containing polymerizable unsaturated monomer | methacrylic acid | | 1.2 | 2.1 | | |
| | | | | diacetone acrylamide | | | | 3 | |
| | | | | γ-methacryloxypropyl trimethoxysilane | | | | | 3 |
| Solid content (%) | | | | | 30 | 30 | 30 | 30 | 30 |
| Hydroxy value (mgKOH/g) | | | | | 18 | 19 | 19 | 16 | 21 |
| Acid value (mgKOH/g) | | | | | 0 | 8 | 14 | 0 | 0 |
| Ratio of $C_{5-22}$ alkyl-containing polymerizable unsaturated monomer (c-1) in the monomer component (mass %) | | | | | 67.2 | 67.2 | 67.2 | 59.5 | 59.5 |
| Ratio of $C_{5-22}$ alkyl-containing polymerizable unsaturated monomer (c-1) in polymer (I) (mass %) | | | | | 96 | 96 | 96 | 85 | 85 |
| Ratio of $C_{1-2}$ alkyl-containing polymerizable unsaturated monomer (c-3) in polymer (II) (mass %) | | | | | 86 | 80 | 77 | 76 | 72 |
| Glass transition temp. Tg(° C.) | glass transition temp. ($Tg_1$) of polymer (I) | | | | −51 | −51 | −51 | −52 | −52 |
| | glass transition temp. ($Tg_2$) of polymer (II) | | | | 68 | 66 | 69 | 66 | 46 |
| Average particle size (nm) | | | | | 195 | 192 | 198 | 204 | 208 |

| Production Example | | | | | 20 | 21 | 22 | 23 | 24 |
|---|---|---|---|---|---|---|---|---|---|
| Water-dispersible acrylic resin dispersion | | | | | C-16 | C-17 | C-18 | C-19 | C-20 |
| Monomer emulsion (1) | deionized water | | | | 42 | 42 | 42 | 42 | 42 |
| | Aqualon KH-10 | | | | 0.72 | 0.72 | 0.72 | 0.72 | 0.72 |
| | monomer (c-1) | $C_{5-22}$ alkyl-containing polymerizable unsaturated monomer | | 2-ethylhexyl acrylate | 52.5 | 65.8 | 65 | 67.2 | 70 |
| | monomer (c-2) | monomer (c-7) | polymerizable unsaturated monomer having at least 2 polymerizable unsaturated groups per molecule | allyl methacrylate | | | | 2.8 | |
| | | | | 1,6-hexanediol diacrylate | | 4.2 | | | |
| | | monomer (c-8) | functional group-containing polymerizable unsaturated monomer | glycidyl methacrylate | | | 3.2 | | |
| | | monomer (c-9) | polymerizable unsaturated monomer having functional group complementally reactable with functional group in polymerizable unsaturated monomer (c-8) | methacrylic acid | | | 1.9 | | |
| | | | | methyl methacrylate | 17.5 | | | | |
| | | | | n-butyl acrylate | | | | | |
| Monomer emulsion | deionized water | | | | 18 | 18 | 18 | 18 | 18 |
| | Aqualon KH-10 | | | | 0.31 | 0.31 | 0.31 | 0.31 | 0.31 |

TABLE 1-continued

| | | | | | | | | | |
|---|---|---|---|---|---|---|---|---|---|
| (2) | ammonium persulfate | | | | 0.03 | 0.03 | 0.03 | 0.03 | 0.03 |
| | monomer (c-3) | $C_{1-2}$ alkyl-containing polymerizable unsaturated monomer | | methyl methacrylate | 24 | 25.2 | 25.5 | 24 | 25.2 |
| | monomer (c-4) | monomer (c-7) | polymerizable unsaturated monomer having at least 2 polymerizable unsaturated groups per molecule | allyl methacrylate | 1.2 | | | 1.5 | |
| | | monomer (c-10) | hydroxy-containing polymerizable unsaturated monomer | 2-hydroxyethyl acrylate | | | | | |
| | | | | 4-hydroxybutyl acrylate | 4.8 | 4.8 | 4.5 | 4.5 | 4.8 |
| | | monomer (c-11) | carboxy-containing polymerizable unsaturated monomer | methacrylic acid | | | | | |
| | | | | diacetone acrylamide | | | | | |
| | | | | γ-methacryloxypropyl trimethoxysilane | | | | | |
| Solid content (%) | | | | | 30 | 30 | 30 | 30 | 30 |
| Hydroxy value (mgKOH/g) | | | | | 19 | 19 | 18 | 18 | 19 |
| Acid value (mgKOH/g) | | | | | 0 | 0 | 0 | 0 | 0 |
| Ratio of $C_{5-22}$ alkyl-containing polymerizable unsaturated monomer (c-1) in the monomer component (mass %) | | | | | 52.5 | 65.8 | 65.0 | 67.2 | 70.0 |
| Ratio of $C_{5-22}$ alkyl-containing polymerizable unsaturated monomer (c-1) in polymer (I) (mass %) | | | | | 75 | 94 | 93 | 96 | 100 |
| Ratio of $C_{1-2}$ alkyl-containing polymerizable unsaturated monomer (c-3) in polymer (II) (mass %) | | | | | 80 | 84 | 85 | 80 | 84 |
| Glass transition temp. Tg(° C.) | glass transition temp. ($Tg_1$) of polymer (I) | | | | −27 | −52 | −46 | −51 | −53 |
| | glass transition temp. ($Tg_2$) of polymer (II) | | | | 59 | 63 | 66 | 61 | 63 |
| Average particle size (nm) | | | | | 215 | 210 | 215 | 222 | 225 |

| Production Example | | | | | 25 | 26 | 27 | 28 | 29 |
|---|---|---|---|---|---|---|---|---|---|
| Water-dispersible acrylic resin dispersion | | | | | C-21 | C-22 | C-23 | C-24 | C-25 |
| Monomer emulsion (1) | deionized water | | | | 42 | 42 | 42 | 42 | 42 |
| | Aqualon KH-10 | | | | 0.72 | 0.72 | 0.72 | 0.72 | 0.72 |
| | ammonium persulfate | | | | | | | | |
| | monomer (c-1) | $C_{5-22}$ alkyl-containing polymerizable unsaturated monomer | | 2-ethylhexyl acrylate | 67.2 | 67.2 | 67.2 | 67.2 | 67.2 |
| | monomer (c-2) | monomer (c-7) | polymerizable unsaturated monomer having at least 2 polymerizable unsaturated groups per molecule | allyl methacrylate | 2.8 | 2.8 | 2.8 | 2.8 | 2.8 |
| | | | | 1,6-hexanediol diacrylate | | | | | |
| | | hydroxy-containing polymerizable unsaturated monomer | | 2-hydroxyethyl acrylate | | | | | |
| | | | | 4-hydroxybutyl acrylate | | | | | |
| | | | | methyl methacrylate | | | | | |
| | | | | ethyl acrylate | | | | | |
| | | | | n-butyl acrylate | | | | | |
| | | | | styrene | | | | | |
| Monomer emulsion (2) | deionized water | | | | 18 | 18 | 18 | 18 | 18 |
| | Aqualon KH-10 | | | | 0.31 | 0.31 | 0.31 | 0.31 | 0.31 |
| | ammonium persulfate | | | | 0.03 | 0.03 | 0.03 | 0.03 | 0.03 |
| | monomer (c-3) | $C_{1-2}$ alkyl-containing polymerizable unsaturated monomer | | methyl methacrylate | 21 | | 27.6 | 15 | 12 |
| | | | | ethyl acrylate | | 25.2 | | | |
| | monomer (c-4) | monomer (c-10) | hydroxy-containing polymerizable unsaturated monomer | 2-hydroxyethyl acrylate | 9 | 1.2 | | | |
| | | | | 4-hydroxybutyl acrylate | | 3.6 | 2.4 | 4.8 | 4.8 |
| | | | | 2-ethylhexyl acrylate | | | | 10.2 | 13.2 |
| Solid content (%) | | | | | 30 | 30 | 30 | 30 | 30 |
| Hydroxy value (mgKOH/g) | | | | | 44 | 20 | 9 | 19 | 19 |
| Acid value (mgKOH/g) | | | | | 0 | 0 | 0 | 0 | 0 |
| Ratio of $C_{5-22}$ alkyl-containing polymerizable unsaturated monomer (c-1) in the monomer component (mass %) | | | | | 67.2 | 67.2 | 67.2 | 77.4 | 80.4 |
| Ratio of $C_{5-22}$ alkyl-containing polymerizable unsaturated monomer (c-1) in polymer (I) (mass %) | | | | | 96 | 96 | 96 | 96 | 96 |
| Ratio of $C_{1-2}$ alkyl-containing polymerizable unsaturated monomer (c-3) in polymer (II) (mass %) | | | | | 70 | 84 | 92 | 50 | 40 |
| Glass transition temp. Tg (° C.) | glass transition temp. ($Tg_1$) of polymer (I) | | | | −51 | −51 | −51 | −51 | −51 |
| | glass transition temp. ($Tg_2$) of polymer (II) | | | | 34 | 36 | 83 | 3 | −10 |
| Average particle size (nm) | | | | | 190 | 198 | 205 | 196 | 198 |

| Production Example | | | | | 30 | 31 | 32 | 33 |
|---|---|---|---|---|---|---|---|---|
| Water-dispersible acrylic resin dispersion | | | | | C-26 | C-27 | C-28 | C-29 |
| Monomer emulsion | deionized water | | | | 42 | 60 | 42 | 60 |
| | Aqualon KH-10 | | | | 1.03 | 1.03 | 0.72 | 1.03 |

TABLE 1-continued

| | | | | | | | | |
|---|---|---|---|---|---|---|---|---|
| (1) | ammonium persulfate | | | | | 0.07 | | 0.07 |
| | monomer (c-1) | $C_{5-22}$ alkyl-containing polymerizable unsaturated monomer | | 2-ethylhexyl acrylate | 66.5 | 91 | 25.2 | |
| | monomer (c-2) | monomer (c-7) | polymerizable unsaturated monomer having at least 2 polymerizable unsaturated groups per molecule | allyl methacrylate | 3.5 | 4 | 2.8 | |
| | | | | 1,6-hexanediol diacrylate | | | | 5 |
| | | hydroxy-containing polymerizable unsaturated monomer | | 2-hydroxyethyl acrylate | | | | 5 |
| | | | | 4-hydroxybutyl acrylate | | 5 | | |
| | | | | methyl methacrylate | | | 21 | |
| | | | | ethyl acrylate | | | 21 | |
| | | | | n-butyl acrylate | | | | 80 |
| | | | | styrene | | | | 10 |
| Monomer emulsion (2) | deionized water | | | | 18 | | 18 | |
| | Aqualon KH-10 | | | | 0.31 | | 0.31 | |
| | ammonium persulfate | | | | 0.03 | | 0.03 | |
| | monomer (c-3) | $C_{1-2}$ alkyl-containing polymerizable unsaturated monomer | | methyl methacrylate | | | 25.2 | |
| | | | | ethyl acrylate | | | | |
| | monomer (c-4) | monomer (c-10) | hydroxy-containing polymerizable unsaturated monomer | 2-hydroxyethyl acrylate | | | | |
| | | | | 4-hydroxybutyl acrylate | 4.2 | | 4.8 | |
| | | | | 2-ethylhexyl acrylate | 25.8 | | | |
| Solid content (%) | | | | | 30 | 30 | 30 | 30 |
| Hydroxy value (mgKOH/g) | | | | | 16 | 19 | 19 | 24 |
| Acid value (mgKOH/g) | | | | | 0 | 0 | 0 | 0 |
| Ratio of $C_{5-22}$ alkyl-containing polymerizable unsaturated monomer (c-1) in the monomer component (mass %) | | | | | 92.3 | 91.0 | 25.2 | 0.0 |
| Ratio of $C_{5-22}$ alkyl-containing polymerizable unsaturated monomer (c-1) in polymer (I) (mass %) | | | | | 95 | | 36 | |
| Ratio of $C_{1-2}$ alkyl-containing polymerizable unsaturated monomer (c-3) in polymer (II) (mass %) | | | | | 0 | | 84 | |
| Glass transition temp. Tg (° C.) | glass transition temp. ($Tg_1$) of polymer (I) | | | | −51 | −51 | −1 | −44 |
| | glass transition temp. ($Tg_2$) of polymer (II) | | | | −54 | | 63 | |
| Average particle size (nm) | | | | | 200 | 175 | 182 | 160 |

Preparation of hydroxy-containing acrylic resin

Production Example 34

A flask equipped with a thermometer, thermostat, stirrer, reflux condenser, nitrogen inlet pipe and a dropping device was charged with 30 parts of propylene glycol monopropyl ether whose temperature was then raised to 85° C. Into the flask a mixture of 6 parts of styrene, 30 parts of methyl methacrylate, 25 parts of n-butyl acrylate, 20 parts of 2-ethylhexyl acrylate, 13 parts of 4-hydroxybutyl acrylate, 6 parts of acrylic acid, 10 parts of propylene glycol monopropyl ether and 2 parts of 2,2'-azobis(2,4-dimethylvaleronitrile) was added dropwise over 4 hours. After completion of the dropping, the reaction mixture was aged for an hour. Then a mixture of 5 parts of propylene glycol monopropyl ether and 1 part of 2,2'-azobis(2,4-dimethylvaleronitrile) was added to the flask dropwise over an hour, followed by an hour's aging. Further 7.4 parts of 2-(dimethylamino)ethanol was added for neutralization, and deionized water was gradually added to provide a hydroxy-containing acrylic resin solution (Ac-1) having a solid content of 40%. The resultant hydroxy-containing acrylic resin had an acid value of 47 mgKOH/g, hydroxy value of 51 mgKOH/g and weight-average molecular weight of 50,000.

Production Example 35

A reactor equipped with a thermometer, thermostat, stirrer, reflux condenser, nitrogen inlet pipe and dropping device was charged with 100 parts of deionized water and 1 part of ADEKARIASOAP SR-1025 (tradename, ADEKA Corporation, ammonium salt of α-sulfo-ω-(1-(alkoxy)methyl-2-(2-propenyloxy)ethoxy)-poly(oxy-1,2-ethan-di-yl), active ingredient, 25%), which were then stirred and mixed in nitrogen current. The temperature was raised to 75° C. Then 3% of the total amount of the later specified monomer emulsion and 10 parts of 0.5% aqueous ammonium persulfate solution were introduced into the reactor and kept at 75° C. for 2 hours. Then the rest of the monomer emulsion was dropped into the reactor over 5 hours, followed by 6 hours' aging. After cooling the reaction mixture to 30° C., the solid content and pH were adjusted to 40% and 6.8, respectively, using 5% aqueous 2-(dimethylamino)ethanol solution and deionized water. Then the reaction mixture was discharged while being filtered through a 200 mesh Nylon cloth, to provide a hydroxy-containing acrylic resin dispersion (Ac-2) having a solid content of 40%. The resultant hydroxy containing acrylic resin had an acid value of 11 mgKOH/g, hydroxy value of 24 mgKOH/g and weight-average molecular weight of 1,800,000.

Monomer emulsion: Mixing and stirring 55 parts of deionized water, 4 parts of LATEMUL E-118B (tradename, Kao Corporation, sodium polyoxyethylene alkyl ether sulfate, active ingredient 26%), 10 parts of styrene, 53.5 parts of methyl methacrylate, 30 parts of n-butyl acrylate, 5 parts of 2-hydroxyethyl acrylate, 1.5 parts of acrylic acid and 0.2 part of 2,2'-azobis[2-(2-imidazolin-2-yl)propane, the monomer emulsion was obtained.

Preparation of Water-Based First Coloring Paint (X)

Production Example 36

A pigment-dispersed paste was obtained by mixing 56 parts (solid resin content, 25 parts) of the hydroxy-containing polyester resin solution (A-1) as obtained in Production Example 1, 60 parts of JR-806 (tradename, Tayca Corporation, rutile type titanium dioxide), 1 part of CARBON MA-100 (tradename, Mitsubishi Chemicals Co., carbon black), 15 parts of BARIACE B-35 (tradename, Sakai Chemical Industry Co., Ltd., barium sulfate powder, average primary particle size, 0.5 μm), 3 parts of MICRO ACE S-3 (tradename, Nippon Talc Co., Ltd., talc powder, average primary particle size, 4.8 μm) and 5 parts of deionized water; adjusting pH of the mixture to 8.0 with 2-(dimethylamino) ethanol and dispersing it with a paint shaker for 30 minutes.

Then 140 parts of so obtained pigment-dispersed paste, 29 parts of the hydroxy-containing polyester resin solution (A-1) as obtained in Production Example 1, 33 parts of melamine resin (B-1) (methyl-butyl-mixed etherified melamine resin, solid content 80%, weight-average molecular weight 800), 15 parts of BAYHYDUR VPLS 2310 (tradename, Sumika Bayer Urethane Co., Ltd., blocked polyisocyanate compound, solid content 38%), 33 parts of the water-dispersible acrylic resin dispersion (C-1) as obtained in Production Example 5, 25 parts of the hydroxy-containing acrylic resin solution (Ac-1) as obtained in Production Example 34, 28 parts of U-COAT UX-8100 (tradename, Sanyo Chemical Industries, Ltd., a urethane emulsion, solid content 35%) and 10 parts of 2-ethyl-1-hexanol (soluble mass in 100 g of water at 20° C.: 0.1 g) were uniformly mixed.

Thereafter UH-752 (tradename, ADEKA Corporation, urethane association type thickener), 2-(dimethylamino) ethanol and deionized water were added to the formed mixture to provide a water-based first coloring paint (X-1) whose pH was 8.0, solid content, 48%, and viscosity, 30 seconds as measured with Ford cup No. 4 at 20° C.

Production Examples 37-79, 82-85

Production Example 36 was repeated except that the composition of the blend was changed to those as shown in Table 2, to provide water-based first coloring paints (X-2)-(X-44) and (X-47)-(X-50) whose pH was 8.0, solid content was 48% and the viscosity, 30 seconds as measured with Ford cup No. 4 at 20° C.

Production Example 80

A pigment-dispersed paste was obtained by mixing 56 parts (solid resin content, 25 parts) of the hydroxy-containing polyester resin solution (A-1) as obtained in Production Example 1, 60 parts of JR-806, 1 part of CARBON MA-100, 15 parts of BARIACE B-35, 3 parts of MICRO ACE S-3 and 5 parts of deionized water; adjusting pH of the mixture to 8.0 with 2-(dimethylamino)ethanol and dispersing it with a paint shaker for 30 minutes.

Then 140 parts of so obtained pigment-dispersed paste, 29 parts of the hydroxy-containing polyester resin solution (A-1) as obtained in Production Example 1, 33 parts of melamine resin (B-1), 15 parts of BAYHYDUR VPLS 2310, 33 parts of the water-dispersible acrylic resin dispersion (C-7) as obtained in Production Example 11, 25 parts of the hydroxy-containing acrylic resin solution (Ac-1) as obtained in Production Example 34, 28 parts of U-COAT UX-8100 and 10 parts of 2-ethyl-1-hexanol were uniformly mixed.

To the resulting mixture then PRIMAL ASE-60 (tradename, Rohm & Haas Co., polyacrylic acid type thickener), 2-(dimethylamino)ethanol and deionized water were added, to provide a water-based first coloring paint (X-45) whose pH was 8.0, solid content, 48%, and viscosity, 30 seconds as measured with Ford cup No. 4 at 20° C.

Production Example 81

A pigment-dispersed paste was obtained by mixing 56 parts (solid resin content, 25 parts) of the hydroxy-containing polyester resin solution (A-1) as obtained in Production Example 1, 60 parts of JR-806, 1 part of CARBON MA-100, 15 parts of BARIACE B-35, 3 parts of MICRO ACE S-3 and 5 parts of deionized water; adjusting pH of the mixture to 8.0 with 2-(dimethylamino)ethanol and dispersing it with a paint shaker for 30 minutes.

Then 140 parts of so obtained pigment-dispersed paste, 29 parts of the hydroxy-containing polyester resin solution (A-1) as obtained in Production Example I, 33 parts of melamine resin (B-1), 15 parts of BAYHYDUR VPLS 2310, 33 parts of the water-dispersible acrylic resin dispersion (C-7) as obtained in Production Example 11, 25 parts of the hydroxy-containing acrylic resin solution (Ac-1) as obtained in Production Example 34, 28 parts of U-COAT UX-8100 and 10 parts of 2-ethyl-1-hexanol were uniformly mixed.

Thereafter 2-(dimethylamino)ethanol and deionized water were added to the formed mixture to provide a water-based first coloring paint (X-46) whose pH was 8.0 and the viscosity, 30 seconds as measured with Ford cup No. 4 at 20° C.

TABLE 2

| Production Example | | | | 36 | 37 | 38 | 39 | 40 | 41 | 42 | 43 | 44 | 45 | 46 | 47 |
|---|---|---|---|---|---|---|---|---|---|---|---|---|---|---|---|
| Water-based first coloring paint (X) | | | | X-1 | X-2 | X-3 | X-4 | X-5 | X-6 | X-7 | X-8 | X-9 | X-10 | X-11 | X-12 |
| Pigment-dispersed paste | hydroxy-containing polyester resin (A) | | kind | A-1 | A-1 | A-1 | A-1 | A-1 | A-1 | A-1 | A-1 | A-1 | A-1 | A-1 | A-1 |
| | | | amount | 56 | 56 | 56 | 56 | 56 | 56 | 56 | 56 | 56 | 56 | 56 | 56 |
| | pigment (D) | coloring pigment | JR-806 amount | 60 | 60 | 60 | 60 | 60 | 60 | 60 | 60 | 60 | 60 | 60 | 60 |
| | | | MA-100 amount | 1 | 1 | 1 | 1 | 1 | 1 | 1 | 1 | 1 | 1 | 1 | 1 |
| | | extender pigment | BARIACE B-35 amount | 15 | 15 | 15 | 15 | 15 | 15 | 15 | 15 | 15 | 15 | 15 | 15 |
| | | | MICRO ACE S-3 amount | 3 | 3 | 3 | 3 | 3 | 3 | 3 | 3 | 3 | 3 | 3 | 3 |
| | deionized water | | amount | 5 | 5 | 5 | 5 | 5 | 5 | 5 | 5 | 5 | 5 | 5 | 5 |
| Hydroxy-containing polyester resin (A) | | | kind | A-1 | A-1 | A-1 | A-1 | A-1 | A-1 | A-1 | A-1 | A-1 | A-1 | A-1 | A-1 |
| | | | amount | 29 | 29 | 29 | 29 | 29 | 29 | 29 | 29 | 29 | 29 | 29 | 29 |
| Curing agent (B) | melamine resin | | kind | B-1 | B-1 | B-1 | B-1 | B-1 | B-1 | B-1 | B-1 | B-1 | B-1 | B-1 | B-1 |
| | | | amount | 33 | 33 | 33 | 33 | 33 | 33 | 33 | 33 | 33 | 33 | 33 | 33 |
| | blocked polyisocyanate compound | BAYHYDUR VPLS2310 | amount | 15 | 15 | 15 | 15 | 15 | 15 | 15 | 15 | 15 | 15 | 15 | 15 |
| Water-dispersible acrylic resin(C) | | | kind | C-1 | C-2 | C-3 | C-4 | C-5 | C-6 | C-7 | C-8 | C-9 | C-10 | C-11 | C-12 |
| | | | amount | 33 | 33 | 33 | 33 | 33 | 33 | 33 | 33 | 33 | 33 | 33 | 33 |
| Hydroxy-containing acrylic resin (A) | | | kind | Ac-1 | Ac-1 | Ac-1 | Ac-1 | Ac-1 | Ac-1 | Ac-1 | Ac-1 | Ac-1 | Ac-1 | Ac-1 | Ac-1 |
| | | | amount | 25 | 25 | 25 | 25 | 25 | 25 | 25 | 25 | 25 | 25 | 25 | 25 |
| Urethane emulsion | | U-COAT UX-5100 | amount | 28 | 28 | 28 | 28 | 28 | 28 | 28 | 28 | 28 | 28 | 28 | 28 |
| Hydrophobic solvent (E) | | 2-ethyl-1-hexanol | amount | 10 | 10 | 10 | 10 | 10 | 10 | 10 | 10 | 10 | 10 | 10 | 10 |

TABLE 2-continued

| Production Example | | | | | 48 | 49 | 50 | 51 | 52 | 53 | 54 | 55 | 56 | 57 | 58 |
|---|---|---|---|---|---|---|---|---|---|---|---|---|---|---|---|
| Water-based first coloring paint (X) | | | | | X-13 | X-14 | X-15 | X-16 | X-17 | X-18 | X-19 | X-20 | X-21 | X-22 | X-23 |
| Pigment-dispersed paste | hydroxy-containing polyester resin (A) | | | kind | A-1 | A-1 | A-1 | A-1 | A-1 | A-1 | A-1 | A-1 | A-1 | A-1 | A-1 |
| | | | | amount | 56 | 56 | 56 | 56 | 56 | 56 | 56 | 56 | 56 | 56 | 56 |
| | pigment (D) | coloring pigment | JR-806 | amount | 60 | 60 | 60 | 60 | 60 | 60 | 60 | 60 | 60 | 60 | 60 |
| | | | MA-100 | amount | 1 | 1 | 1 | 1 | 1 | 1 | 1 | 1 | 1 | 1 | 1 |
| | | extender pigment | BARIACE B-35 | amount | 15 | 15 | 15 | 15 | 15 | 15 | 15 | 15 | 15 | 15 | 15 |
| | | | MICRO ACE S-3 | amount | 3 | 3 | 3 | 3 | 3 | 3 | 3 | 3 | 3 | 3 | 3 |
| | deionized water | | | amount | 5 | 5 | 5 | 5 | 5 | 5 | 5 | 5 | 5 | 5 | 5 |
| Hydroxy-containing polyester resin (A) | | | | kind | A-1 | A-1 | A-1 | A-1 | A-1 | A-1 | A-1 | A-1 | A-1 | A-1 | A-1 |
| | | | | amount | 29 | 29 | 29 | 29 | 29 | 29 | 29 | 29 | 29 | 29 | 29 |
| Curing agent (B) | melamine resin | | | kind | B-1 | B-1 | B-1 | B-1 | B-1 | B-1 | B-1 | B-1 | B-1 | B-1 | B-1 |
| | | | | amount | 33 | 33 | 33 | 33 | 33 | 33 | 33 | 33 | 33 | 33 | 33 |
| | blocked polyisocyanate compound | | BAYHYDUR VPLS2310 | amount | 15 | 15 | 15 | 15 | 15 | 15 | 15 | 15 | 15 | 15 | 15 |
| Water-dispersible acrylic resin(C) | | | | kind | C-13 | C-14 | C-15 | C-16 | C-17 | C-18 | C-19 | C-29 | C-21 | C-22 | C-23 |
| | | | | amount | 33 | 33 | 33 | 33 | 33 | 33 | 33 | 33 | 33 | 33 | 33 |
| Hydroxy-containing acrylic resin | | | | kind | Ac-1 | Ac-1 | Ac-1 | Ac-1 | Ac-1 | Ac-1 | Ac-1 | Ac-1 | Ac-1 | Ac-1 | Ac-1 |
| | | | | amount | 25 | 25 | 25 | 25 | 25 | 25 | 25 | 25 | 25 | 25 | 25 |
| Urethane emulsion | | | U-COAT UX-5100 | amount | 28 | 28 | 28 | 28 | 28 | 28 | 28 | 28 | 28 | 28 | 29 |
| adipic dihydrazide | | | | amount | | 1.5 | | | | | | | | | |
| Hydrophobic solvent (E) | | | 2-ethyl-1-hexanol | amount | 10 | 10 | 10 | 10 | 10 | 10 | 10 | 10 | 10 | 10 | 10 |

| Production Example | | | | | 59 | 60 | 61 | 62 | 63 | 64 | 65 | 66 | 67 | 68 | 69 |
|---|---|---|---|---|---|---|---|---|---|---|---|---|---|---|---|
| Water-based first coloring paint (X) | | | | | X-24 | X-25 | X-26 | X-27 | X-28 | X-29 | X-30 | X-31 | X-32 | X-33 | X-34 |
| Pigment-dispersed paste | hydroxy-containing polyester resin (A) | | | kind | A-1 | A-1 | A-1 | A-1 | A-1 | A-1 | A-1 | A-1 | A-1 | A-1 | A-1 |
| | | | | amount | 56 | 56 | 56 | 56 | 56 | 56 | 56 | 56 | 56 | 56 | 56 |
| | pigment (D) | coloring pigment | JR-806 | amount | 60 | 60 | 60 | 60 | 60 | 60 | 60 | 60 | 60 | 60 | 60 |
| | | | MA-100 | amount | 1 | 1 | 1 | 1 | 1 | 1 | 1 | 1 | 1 | 1 | 1 |
| | | extender pigment | BARIACE B-35 | amount | 15 | 15 | 15 | 15 | 15 | 15 | 15 | 15 | 15 | 15 | 15 |
| | | | MICRO ACE S-3 | amount | 3 | 3 | 3 | 3 | 3 | 3 | 3 | 3 | 3 | 3 | 3 |
| | deionized water | | | amount | 5 | 5 | 5 | 5 | 5 | 5 | 5 | 5 | 5 | 5 | 5 |
| Hydroxy-containing polyester resin (A) | | | | kind | A-1 | A-1 | A-1 | A-1 | A-1 | A-1 | A-1 | A-1 | A-1 | A-1 | A-1 |
| | | | | amount | 29 | 29 | 29 | 29 | 29 | 29 | 29 | 23 | 29 | 29 | 48 |
| | | | | kind | | | | | | | A-2 | | | | |
| | | | | amount | | | | | | | 22 | | | | |
| Curing agent (B) | melamine resin | | | kind | B-1 | B-1 | B-1 | B-1 | B-1 | B-1 | B-1 | B-1 | B-1 | B-2 (note 2) | |
| | | | | amount | 33 | 33 | 33 | 33 | 33 | 33 | 33 | 33 | 40 | 33 | |
| | blocked polyisocyanate compound | | BAYHYDUR VPLS2310 | amount | 15 | 15 | 15 | 15 | 15 | 15 | 15 | 10 | | 15 | |
| | polyisocyanate compound | | BAYHYDUR XP2570 (note 3) | amount | | | | | | | | | | | 25 |
| Water-dispersible acrylic resin(C) | | | | kind | C-24 | C-25 | C-26 | C-27 | C-7 | C-7 | C-17 | C-5 | C-17 | C-12 | C-17 |
| | | | | amount | 33 | 33 | 33 | 33 | 33 | 33 | 33 | 33 | 33 | 33 | 33 |
| Hydroxy-containing acrylic resin | | | | kind | Ac-1 | Ac-1 | Ac-1 | Ac-1 | Ac-1 | Ac-1 | | Ac-1 | Ac-1 | Ac-1 | Ac-1 |
| | | | | amount | 25 | 25 | 25 | 25 | 25 | 25 | | 12 | 25 | 25 | 12 |
| | | | | kind | | | | | | | | Ac-2 | | | Ac-2 |
| | | | | amount | | | | | | | | 25 | | | 10 |
| Urethane emulsion | | | U-COAT UX-5100 | amount | 28 | 28 | 28 | 28 | 28 | 28 | 28 | 28 | 28 | 28 | 28 |
| Hydrophobic solvent (E) | | | 2-ethyl-1-hexanol | amount | 10 | 10 | 10 | 10 | 10 | 10 | 10 | 10 | 10 | 10 | 10 |

| Production Example | | | | | 70 | 71 | 72 | 73 | 74 | 75 | 76 | 77 | 78 | 79 |
|---|---|---|---|---|---|---|---|---|---|---|---|---|---|---|
| Water-based first coloring paint (X) | | | | | X-35 | X-36 | X-37 | X-38 | X-39 | X-40 | X-41 | X-42 | X-43 | X-44 |
| Pigment-dispersed paste | hydroxy-containing polyester resin (A) | | | kind | A-1 | A-1 | A-1 | A-1 | A-1 | A-1 | A-1 | A-1 | A-1 | A-1 |
| | | | | amount | 56 | 56 | 56 | 56 | 56 | 56 | 56 | 56 | 56 | 56 |
| | pigment (D) | coloring pigment | JR-806 | amount | 60 | 60 | 60 | 60 | 60 | 60 | 60 | 60 | 60 | 60 |
| | | | MA-100 | amount | 1 | 1 | 1 | 1 | 1 | 1 | 1 | 1 | 1 | 1 |
| | | extender pigment | BARIACE B-35 | amount | 15 | 15 | 15 | 15 | | 15 | 15 | 15 | 15 | 15 |
| | | | SPARWITE W-5HB (note 1) | | | | | | 15 | | | | | |
| | | | MICRO ACE S-3 | amount | 3 | 3 | 3 | 3 | 3 | | 3 | 3 | 3 | 3 |
| | deionized water | | | amount | 5 | 5 | 5 | 5 | 5 | 5 | 5 | 5 | 5 | 5 |
| Hydroxy-containing polyester resin (A) | | | | kind | A-1 | A-4 | A-4 | A-1 | A-1 | A-1 | A-1 | A-1 | A-1 | A-1 |
| | | | | amount | 48 | 78 | 100 | 22 | 29 | 29 | 29 | 29 | 23 | 21 |
| | | | | kind | | | | A-4 | | | | | | |
| | | | | amount | | | | 22 | | | | | | |
| Curing agent (B) | melamine resin | | | kind | | | | B-1 | B-1 | B-1 | B-1 | B-1 | B-1 | B-1 |
| | | | | amount | | | | 19 | 33 | 30 | 33 | 33 | 30 | 33 |
| | blocked polyisocyanate compound | | BAYHYDUR VPLS2310 | amount | | | | | 15 | 15 | 15 | 15 | 15 | 15 |
| | polyisocyanate compound | | BAYHYDUR XP2319 (note 4) | amount | 25 | | | | | | | | | |

TABLE 2-continued

| | | | | | | | | | | | | |
|---|---|---|---|---|---|---|---|---|---|---|---|---|
| carbodiimide group-containing compound | CARBODILITE SV-02 (note 5) | | | 75 | | 38 | | | | | | |
| oxazoline group-containing compound | EPOCROS WS-500 (note 6) | | | | 50 | | | | | | | |
| Water-dispersible acrylic resin(C) | | kind | C-7 | C-7 | C-7 | C-7 | C-7 | C-7 | C-7 | C-7 | C-7 | C-17 |
| | | amount | 66 | 33 | 33 | 50 | 27 | 50 | 33 | 33 | 33 | 40 |
| Hydroxy-containing acrylic resin | | kind | Ac-1 | | | Ac-1 | Ac-1 | Ac-1 | Ac-1 | Ac-1 | Ac-1 | Ac-1 |
| | | amount | 12 | | | 12 | 25 | 18 | 25 | 12 | 12 | 12 |
| | | kind | Ac-2 | | | Ac-2 | | | | Ac-2 | Ac-2 | Ac-2 |
| | | amount | 10 | | | 12 | | | | 12 | 25 | 20 |
| Urethane emulsion | U-COAT UX-5100 | amount | | | | | 34 | 28 | 28 | 28 | 28 | |
| Hydrophobic solvent (E) | 2-ethyl-1-hexanol | amount | 10 | 10 | 10 | 10 | 10 | 10 | | 10 | 10 | 10 |
| Ethylene glycol mono-n-butyl ether (note 7) | | amount | | | | | | | 10 | | | |
| Diester compound (F) | diester compound (F-1) (note 8) | amount | | | | | | | | 10 | | |

| Production Example | | | | | 80 | 81 | 82 | 83 | 84 | 85 |
|---|---|---|---|---|---|---|---|---|---|---|
| Water-based first coloring paint (X) | | | | | X-45 | X-46 | X-47 | X-48 | X-49 | X-50 |
| Pigment-dispersed paste | hydroxy-containing polyester resin (A) | | | kind | A-1 | A-1 | A-1 | A-1 | A-1 | |
| | | | | amount | 56 | 56 | 56 | 56 | 56 | |
| | hydroxy-containing acrylic resin | | | kind | | | | | | Ac-1 |
| | | | | amount | | | | | | 63 |
| | pigment (D) | coloring pigment | JR-806 | amount | 60 | 60 | 60 | 60 | 60 | 60 |
| | | | MA-100 | amount | 1 | 1 | 1 | 1 | 1 | 1 |
| | | extender pigment | BARIACE B-35 | amount | 15 | 15 | 15 | 15 | 15 | 15 |
| | | | MICRO ACE S-3 | amount | 3 | 3 | 3 | 3 | 3 | 3 |
| | deionized water | | | amount | 5 | 5 | 5 | 5 | 5 | 5 |
| Hydroxy-containing polyester resin (A) | | | | kind | A-1 | A-1 | A-1 | A-1 | A-1 | |
| | | | | amount | 29 | 29 | 29 | 29 | 29 | |
| Curing agent (B) | melamine resin | | | kind | B-1 | B-1 | B-1 | B-1 | B-1 | B-1 |
| | | | | amount | 33 | 33 | 33 | 33 | 33 | 33 |
| | blocked polyisocyanate compound | | BAYHYDUR VPLS2310 | amount | 15 | 15 | 15 | 15 | 15 | 15 |
| Water-dispersible acrylic resin(C) | | | | kind | C-7 | C-7 | | C-28 | C-29 | C-13 |
| | | | | amount | 33 | 33 | | 33 | 33 | 33 |
| Hydroxy-containing acrylic resin | | | | kind | Ac-1 | Ac-1 | Ac-1 | Ac-1 | Ac-1 | Ac-2 |
| | | | | amount | 25 | 25 | 25 | 25 | 25 | 58 |
| Urethane emulsion | | | U-COAT UX-5100 | amount | 28 | 28 | 56 | 28 | 28 | 28 |
| Hydrophobic solvent (E) | | | 2-ethyl-1-hexanol | amount | 10 | 10 | 10 | 10 | 10 | 10 |

(note 1) SPARWITE W-5HB: tradename, Wilbur-Ellis Co., barium, sulfate powder, average primary particle size, 1.6 μm (note 2) Melamine resin (B-2): methyl-etherified melamine resin, solid content 80%, weight-average molecular weight 800

(note 3) BAYHYDUR XP2570: tradename, Sumika Bayer Urethane Co., Ltd., anionic hydrophilic polyisocyanate compound, solid content 100%

(note 4) BAYHYDUR VPLS2319: tradename, Sumika Bayer Urethane Co., Ltd., nonionic hydrophilic polyisocyanate compound, solid content 100%

(note 5) CARBODILITE V-02: tradename, Nisshinbo Industries, Inc., carbodiimido group-containing compound, solid content 40%

(note 6) EPOCROS WS-500: tradename, Nippon Shokubai Co., Ltd., oxazoline group-containing compound, solid content 40%

(note 7) Ethylene glycol mono-n-butyl ether: its mass soluble in 100 g of water at 20° C. is infinite (note 8) Diester compound (F-1): a diester compound of polyoxyethylene glycol with 2-ethylhexanoic acid, corresponding to the compound of the general formula (1) in which $R^1$ and $R^2$ are 2-ethylheptyl groups, $R^3$ is ethylene group and m is 7; molecular weight 578

Preparation of Acrylic Resin Emulsion for Water-Based Second Coloring Paint (Y)

Production Example 86

A reactor equipped with a thermometer, thermostat, stirrer, reflux condenser, nitrogen-inlet pipe and dropping device was charged with 130 parts of deionized water and 0.52 part of AQUALON KH-10 which were stirred and mixed in gaseous nitrogen current. The temperature was raised to 80° C., and then 1% of the total amount of a later specified monomer emulsion (1) and 5.3 parts of 6% aqueous ammonium persulfate solution were introduced into the reactor and kept at 80° C. for 15 minutes. Then the remainder of the monomer emulsion (1) was dropped into the reactor which was maintained at the same temperature, over 3 hours, followed by an hour's aging. Thereafter a monomer emulsion (2) as specified later was added dropwise over an hour, aged for an hour, and the reaction mixture was cooled to 30° C. under gradual addition of 40 parts of 5% aqueous dimethylethanolamine solution into the reactor. The reaction mixture was discharged from the reactor while being filtered through 100 mesh Nylon cloth, to provide an acrylic resin emulsion (AC) having a solid content of 30%, the average particle size of the emulsion being 100 nm [as measured with a submicron particle size distribution measuring device, COULTER N4 Model (tradename, Beckman Coulter, Inc.), as to its sample diluted with deionized water at 20° C.]. Thus obtained acrylic resin had an acid value of 33 mgKOH/g and a hydroxy value of 25 mgKOH/g.

Monomer emulsion (1): The monomer emulsion (1) was obtained by mixing by stirring 42 parts of deionized water, 0.72 part of AQUALON KH-10, 2.1 parts of methylenebisacrylamide, 2.8 parts of styrene, 16.1 parts of methyl methacrylate, 28 parts of ethyl acrylate and 21 parts of n-butyl acrylate.

Monomer emulsion (2): The monomer emulsion (2) was obtained by mixing by stirring 18 parts of deionized water, 0.31 part of AQUALON KH-10, 0.03 part of ammonium persulfate, 5.1 parts of methacrylic acid, 5.1 parts of 2-hydroxyethyl acrylate, 3 parts of styrene, 6 parts of methyl methacrylate, 1.8 parts of ethyl acrylate and 9 parts of n-butyl acrylate.

Preparation of Polyester Resin for Water-Based Second Coloring Paint (Y)

Production Example 87

A reactor equipped with a thermometer, thermostat, stirrer, reflux condenser and water separator was charged with 109 parts of trimethylolpropane, 141 parts of 1,6-hexanediol, 126 parts of hexahydrophthalic anhydride and 120 parts of adipic acid, and the temperature therein was raised from 160° C. to 230° C. over 3 hours, followed by 4 hours' condensation reaction at 230° C. Then further 38.3 parts of trimellitic anhydride was added and reacted at 170° C. for 30 minutes to add carboxy groups to the resulting condensation reaction product. The reaction product was diluted with 2-ethyl-1-hexanol to provide a polyester resin solution (PE1) having a solid content of 70%. The resultant polyester resin had an acid value of 46 mgKOH/g, hydroxy value of 150 mgKOH/g, solid content of 70% and weight-average molecular weight of 6,400.

Production Example 88

Production Example 87 was repeated except that the diluting solvent was changed from 2-ethyl-1-hexanol to ethylene glycol mono-n-butyl ether to provide a polyester resin solution (PE2).

Preparation of Pigment-Dispersed Paste for Water-Based Second Coloring Paint (Y)

Production Example 89

A pigment-dispersed paste was obtained by mixing 56 parts (solid resin content, 25 parts) of the hydroxy-containing polyester resin solution (A-1) as obtained in Production Example 1, 60 parts of JR-806 (tradename, Tayca Corporation, rutile type titanium dioxide) and 5 parts of deionized water, adjusting its pH to 8.0 with 2-(dimethylamino)ethanol and dispersing the mixture with a paint shaker for 30 minutes.

Preparation of Effect Pigment Dispersion for Water-Based Second Coloring Paint (Y)

Production Example 90

Within an agitation mixing vessel, 19 parts of aluminum pigment paste, GX-180A (tradename, Asahikasei Metals Co., Ltd., metal content 74%), 35 parts of 2-ethyl-1-hexanol, 8 parts of phosphoric acid group-containing resin solution (note 9) and 0.2 part of 2-(dimethylamino)ethanol were uniformly mixed to provide an effect pigment dispersion (P1).

(note 9) Phosphoric acid group-containing resin solution: A reactor equipped with a thermometer, thermostat, stirrer, reflux condenser, nitrogen inlet pipe and dropping device was charged with a mixed solvent of 27.5 parts of methoxypropanol and 27.5 parts of isobutanol. After heating it to 110° C., 121.5 parts of a mixture consisting of 25 parts of styrene, 27.5 parts of n-butyl methacrylate, 20 parts of Isostearyl Acrylate (tradename, Osaka Organic Chemical Industry, Ltd., branched higher alkyl acrylate), 7.5 parts of 4-hydroxybutyl acrylate, 15 parts of phosphoric acid group-containing polymerizable unsaturated monomer (note 10), 12.5 parts of 2-methacryloyloxyethyl acid phosphate, 10 parts of isobutanol and 4 parts of t-butyl peroxyoctanoate was added to the mixed solvent over 4 hours, and thereafter further a mixture of 0.5 part of t-butyl peroxyoctanoate and 20 parts of isopropanol was added dropwise over an hour. Stirring and aging the reaction mixture for a subsequent hour, a phosphoric acid group-containing resin solution having a solid content of 50% was obtained. The acid value of this resin attributable to the phosphoric acid groups was 83 mgKOH/g, hydroxy value was 29 mgKOH/g and weight-average molecular weight was 10,000.

(note 10) Phosphoric acid group-containing polymerizable unsaturated monomer: A reactor equipped with a thermometer, thermostat, stirrer, reflux condenser, nitrogen inlet pipe and dropping device was charged with 57.5 parts of monobutylphosphoric acid and 41 parts of isobutanol. Raising the temperature to 90° C., 42.5 parts of glycidyl methacrylate was added dropwise over 2 hours, followed by an hour's aging under stirring. Then 59 parts of isopropanol was added to provide a phosphoric acid group-containing polymerizable unsaturated monomer solution having a solid content of 50%. Thus obtained monomer had an acid value attributable to the phosphoric acid groups of 285 mgKOH/g.

Production Example 91

Production Example 90 was repeated except that 35 parts of the 2-ethyl-1-hexanol was replaced with 35 parts of ethylene glycol mono-n-butyl ether, to provide an effect pigment dispersion (P2).

Preparation of Water-Based Second Coloring Paint (Y)

Production Example 92

A water-based second coloring paint (Y-1) of pH 8.0, having a solid content of 48% and a viscosity of 60 seconds as measured with Ford cup No. 4 at 20° C. was obtained by uniformly mixing 100 parts of the acrylic resin emulsion (AC) as obtained in Production Example 86, 21 parts of the polyester resin solution (PE1) as obtained in Production Example 87, 121 parts of the pigment-dispersed paste as obtained in Production Example 89, 35 parts of 2-ethyl-1-hexanol and 37.5 parts of CYMEL 325 (tradename, Nihon Cytec Industries, Inc., melamine resin, solid content 80%) and further adding thereto PRIMAL ASE-60, 2-(dimethylamino)ethanol and deionized water.

Production Example 93

A water-based second coloring paint (Y-2) of pH8.0, having a solid content of 25% and a viscosity of 40 seconds as measured with Ford cup No. 4 at 20° C. was obtained by uniformly mixing 100 parts of the acrylic resin emulsion (AC) as obtained in Production Example 86, 57 parts of the polyester resin solution (PE1) as obtained in Production Example 87, 62 parts of the effect pigment dispersion (P1) as obtained in Production Example 90 and 37.5 parts of CYMEL 325, and further adding thereto PRIMAL ASE-60, 2-(dimethylamino)ethanol and deionized water.

Production Example 94

A water-based second coloring paint (Y-3) of pH8.0, having a solid content of 25% and a viscosity of 40 seconds as measured with Ford cup No. 4 at 20° C. was obtained by uniformly mixing 100 parts of the acrylic resin emulsion (AC) as obtained in Production Example 86, 57 parts of the polyester resin solution (PE2) as obtained in Production Example 88, 62 parts of the effect pigment dispersion (P2) as obtained in Production Example 91 and 37.5 parts of CYMEL 325, and further adding thereto PRIMAL ASE-60, 2-(dimethylamino)ethanol and deionized water.

Coating Film-Forming Method

Test plates were prepared using the water-based first coloring paints (X-1)-(X-50) as obtained in Production Examples 36-85, and water-based second coloring paints (Y-1)-(Y-3) as obtained in Production Examples 92-94, by the following procedure, and their evaluation tests were conducted.

(Preparation of Test Coating Object)

Onto cold-rolled steel sheets which had been given a zinc phosphate chemical conversion treatment, ELECRON GT-10 (tradename, Kansai Paint Co., cationic electrodeposition paint) was electrocoated to a dry film thickness of 20 μm, and dried at 170° C. for 30 minutes to be cured, to provide the test coating object.

Example 1

Onto the above test coating object, the water-based first coloring paint (X-1) as obtained in Production Example 36 was electrostatically coated with a rotary atomizing type electrostatic coater, to a cured film thickness of 20 μm to form an intermediate coating film. Leaving the object to stand for 3 minutes and then pre-heating the same at 80° C. for 3 minutes, the water-based second coloring paint (Y-1) as obtained in Production Example 92 was electrostatically coated on the uncured intermediate coating film with a rotary atomizing type electrostatic coater, to a cured film thickness of 35 μm, to form a top coating film. After leaving the object to stand for 3 minutes and then pre-heating the same at 80° C. for 3 minutes, the intermediate coating film and the top coating film were simultaneously cured by heating at 140° C. for 30 minutes, to provide the test plate.

Examples 2-46, Comparative Examples 1-4

Example 1 was repeated except that the water-based first coloring paint (X-1) as obtained in Production Example 36 was replaced with one of the water-based first coloring paints (X-2)-(X-50) as shown in the following Table 3 to provide the test plates.

Example 47

Onto the above test coating object, the water-based first coloring paint (X-1) as obtained in Production Example 36 was electrostatically coated with a rotary atomizing type electrostatic coater, to a cured film thickness of 20 μm to form an intermediate coating film. Leaving the object to stand for 3 minutes and then preheating the same at 80° C. for 3 minutes, the water-based second coloring paint (Y-2) as obtained in Production Example 93 was electrostatically coated on the uncured intermediate coating film with a rotary atomizing type electrostatic coater, to a cured film thickness of 15 to form a base coating film. After leaving the object to stand for 3 minutes and then preheating the same at 80° C. for 3 minutes, onto the uncured base coating film MAGICRON KINO-1210 (tradename, Kansai Paint Co., an acrylic resin-containing, solvent-based top clear paint which may be hereafter referred to as "clear paint (Z-1)") was electrostatically applied to a cured film thickness of 35 μm to form a clear coating film. After allowing the so coated object to stand for 7 minutes, the intermediate coating film, base coating film and clear coating film were simultaneously cured by heating at 140° C. for 30 minutes, to provide the test plate.

Examples 48-93, Comparative Examples 5-8

Example 47 was repeated except that the water-based first coloring paint (X-1) as obtained in Production Example 36 was replaced with one of those water-based first coloring paints (X-2)-(X-50) as shown in the following Table 4, and in Example 93 the water-based second coloring paint (Y-2) as obtained in Production Example 93 was replaced with the water-based second coloring paint (Y-3), to provide the test plates.

Evaluation Tests

The test plates as obtained in above Examples 1-93 and Comparative Examples 1-8 were evaluated by the following test methods. The results of the evaluation were as shown in the following Tables 3 and 4.

(Test Methods)

Smoothness: Evaluated using Wc value measured with Wave Scan DOI (tradename, BYK Gardner Co.). The less the Wc value, the higher the smoothness of the coated surface.

Distinctness of image: Evaluated using Wb value measured with Wave Scan DOI (tradename, BYK Gardner Co.). The less the Wb value, the higher the distinctness of image of the coated surface.

Water resistance: The test plates were immersed in 40° C. warm water for 240 hours, withdrawn and dried at 20° C. for 12 hours. The multilayer coating film on each test plate was crosscut with a cutter to the depth reaching the substrate, to form one-hundred 2 mm×2 mm squares. Then an adhesive cellophane tape was stuck thereon, and rapidly peeled off at 20° C. The remaining condition of the coating film squares was examined.

◉: One-hundred squares of the coating film remained, and no minor peeling of the coating film occurred at the cutting edges with the cutter.

○: One-hundred squares of the coating film remained, but minor peeling of the coating film occurred at the cutting edges with the cutter.

Δ: Remaining number of the squares was 90-99.

X: Remaining number of the square was not more than 89.

Chipping Resistance:

Each of the test plates was mounted on the test piece support in Suga Test Instruments Co., Ltd.'s gravel chipping test instrument JA-400 type (tradename, a chipping test device), and 50 g of crushed granite rock of particle size No. 7 was impinged at the coated surface at an angle of 45° over a distance of 30 cm, with compressed air of 0.392 MPa (4 kgf/cm$^2$) at −20° C. Thereafter the test plates were washed with water, dried, and a cloth adhesive tape (Nichiban Co., Ltd.) was stuck on the coated surface. After peeling the tape off, the extent of thereby incurred damage on the coated film was visually observed and evaluated according to the following standard.

◉: Size of the damage was very small, and the electrocoated surface or substrate steel sheet was not exposed.

○: Size of the damage was small, and the electrocoated surface or substrate steel sheet was not exposed.

Δ: Size of the damage was small but the electrocoated surface or substrate steel sheet was exposed.

X: Size of the damage was considerably large and the substrate steel sheet also was broadly exposed.

TABLE 3

| | | Water-based first coloring paint (X) | Water-based second coloring paint (Y) | Result of Evaluation smoothness | distinctness of image | water resistance | chipping resistance |
|---|---|---|---|---|---|---|---|
| Example | 1 | X-1 | Y-1 | 29.8 | 29.9 | ○ | ○ |
| | 2 | X-2 | Y-1 | 29.7 | 28.9 | ○ | ○ |
| | 3 | X-3 | Y-1 | 27.8 | 28.4 | ○ | ○ |
| | 4 | X-4 | Y-1 | 27.8 | 26.7 | ○ | ⊙ |
| | 5 | X-5 | Y-1 | 23.4 | 24.7 | ○ | ○ |
| | 6 | X-6 | Y-1 | 26.8 | 26.4 | ⊙ | ○ |
| | 7 | X-7 | Y-1 | 21.7 | 23.2 | ⊙ | ⊙ |
| | 8 | X-8 | Y-1 | 22.8 | 24.1 | ○ | ⊙ |
| | 9 | X-9 | Y-1 | 23.9 | 23.9 | ○ | ⊙ |
| | 10 | X-10 | Y-1 | 26.2 | 24.8 | ○ | ○ |
| | 11 | X-11 | Y-1 | 22.8 | 25.8 | ○ | ○ |
| | 12 | X-12 | Y-1 | 25.0 | 26.1 | ⊙ | ⊙ |
| | 13 | X-13 | Y-1 | 27.1 | 28.1 | ⊙ | ⊙ |
| | 14 | X-14 | Y-1 | 26.8 | 25.0 | ○ | ○ |
| | 15 | X-15 | Y-1 | 26.4 | 26.4 | ○ | ○ |
| | 16 | X-16 | Y-1 | 26.9 | 27.6 | ○ | ○ |
| | 17 | X-17 | Y-1 | 22.0 | 23.4 | ⊙ | ⊙ |
| | 18 | X-18 | Y-1 | 22.8 | 25.2 | ⊙ | ⊙ |
| | 19 | X-19 | Y-1 | 22.2 | 24.0 | ⊙ | ⊙ |
| | 20 | X-20 | Y-1 | 28.4 | 26.9 | ○ | ○ |
| | 21 | X-21 | Y-1 | 24.1 | 24.1 | ○ | ⊙ |
| | 22 | X-22 | Y-1 | 23.2 | 24.4 | ⊙ | ⊙ |
| | 23 | X-23 | Y-1 | 25.4 | 25.4 | ○ | ⊙ |
| | 24 | X-24 | Y-1 | 25.4 | 25.3 | ○ | ⊙ |
| | 25 | X-25 | Y-1 | 27.5 | 27.7 | ○ | ⊙ |
| | 26 | X-26 | Y-1 | 28.1 | 28.4 | ○ | ⊙ |
| | 27 | X-27 | Y-1 | 29.2 | 29.9 | ○ | ○ |
| | 28 | X-28 | Y-1 | 23.2 | 25.3 | ⊙ | ○ |
| | 29 | X-29 | Y-1 | 24.3 | 26.0 | ○ | ⊙ |
| | 30 | X-30 | Y-1 | 28.1 | 29.4 | ○ | ⊙ |
| | 31 | X-31 | Y-1 | 23.3 | 24.1 | ⊙ | ⊙ |
| | 32 | X-32 | Y-1 | 21.9 | 23.4 | ⊙ | ○ |
| | 33 | X-33 | Y-1 | 24.9 | 26.3 | ○ | ○ |
| | 34 | X-34 | Y-1 | 20.8 | 22.0 | ○ | ○ |
| | 35 | X-35 | Y-1 | 21.4 | 22.6 | ○ | ⊙ |
| | 36 | X-36 | Y-1 | 22.7 | 23.4 | ○ | ○ |
| | 37 | X-37 | Y-1 | 24.3 | 23.8 | ○ | ○ |
| | 38 | X-38 | Y-1 | 24.0 | 24.1 | ⊙ | ⊙ |
| | 39 | X-39 | Y-1 | 23.9 | 25.0 | ⊙ | ⊙ |
| | 40 | X-40 | Y-1 | 23.3 | 26.2 | ○ | ○ |
| | 41 | X-41 | Y-1 | 26.9 | 26.9 | ○ | ○ |
| | 42 | X-42 | Y-1 | 22.7 | 22.3 | ⊙ | ⊙ |
| | 43 | X-43 | Y-1 | 20.8 | 23.0 | ⊙ | ⊙ |
| | 44 | X-44 | Y-1 | 23.2 | 23.3 | ⊙ | ○ |
| | 45 | X-45 | Y-1 | 24.2 | 23.5 | ⊙ | ⊙ |
| | 46 | X-46 | Y-1 | 25.0 | 26.1 | ⊙ | ⊙ |
| Com-parative Example | 1 | X-47 | Y-1 | 40.9 | 40.0 | ○ | ○ |
| | 2 | X-48 | Y-1 | 36.0 | 33.0 | Δ | Δ |
| | 3 | X-49 | Y-1 | 36.8 | 34.3 | Δ | Δ |
| | 4 | X-50 | Y-1 | 32.3 | 32.1 | Δ | Δ |

TABLE 4

| | | Water-based first coloring paint (X) | Water-based second coloring paint (Y) | Clear paint (Z) | Result of Evaluation smoothness | distinctness of image | water resistance | chipping resistance |
|---|---|---|---|---|---|---|---|---|
| Example | 47 | X-1 | Y-2 | Z-1 | 28.9 | 29.2 | ○ | ○ |
| | 48 | X-2 | Y-2 | Z-1 | 29.0 | 28.1 | ○ | ○ |
| | 49 | X-3 | Y-2 | Z-1 | 26.9 | 27.2 | ○ | ○ |
| | 50 | X-4 | Y-2 | Z-1 | 26.8 | 25.7 | ○ | ⊙ |
| | 51 | X-5 | Y-2 | Z-1 | 22.2 | 23.9 | ○ | ○ |
| | 52 | X-6 | Y-2 | Z-1 | 25.9 | 25.3 | ⊙ | ○ |
| | 53 | X-7 | Y-2 | Z-1 | 20.8 | 22.2 | ⊙ | ⊙ |
| | 54 | X-8 | Y-2 | Z-1 | 22.1 | 22.9 | ○ | ⊙ |
| | 55 | X-9 | Y-2 | Z-1 | 23.0 | 22.9 | ○ | ⊙ |
| | 56 | X-10 | Y-2 | Z-1 | 25.2 | 23.7 | ○ | ○ |
| | 57 | X-11 | Y-2 | Z-1 | 22.0 | 24.9 | ○ | ○ |
| | 58 | X-12 | Y-2 | Z-1 | 23.9 | 25.1 | ⊙ | ⊙ |
| | 59 | X-13 | Y-2 | Z-1 | 25.9 | 26.8 | ⊙ | ⊙ |
| | 60 | X-14 | Y-2 | Z-1 | 26.0 | 24.1 | ○ | ○ |

TABLE 4-continued

| | | Water-based first coloring paint (X) | Water-based second coloring paint (Y) | Clear paint (Z) | Result of Evaluation smoothness | distinctness of image | water resistance | chipping resistance |
|---|---|---|---|---|---|---|---|---|
| | 61 | X-15 | Y-2 | Z-1 | 25.3 | 25.2 | ○ | ○ |
| | 62 | X-16 | Y-2 | Z-1 | 25.9 | 26.8 | ○ | ○ |
| | 63 | X-17 | Y-2 | Z-1 | 21.2 | 22.1 | ⊙ | ⊙ |
| | 64 | X-18 | Y-2 | Z-1 | 21.8 | 24.0 | ⊙ | ⊙ |
| | 65 | X-19 | Y-2 | Z-1 | 21.3 | 22.8 | ⊙ | ⊙ |
| | 66 | X-20 | Y-2 | Z-1 | 27.2 | 26.0 | ○ | ○ |
| | 67 | X-21 | Y-2 | Z-1 | 23.2 | 22.9 | ○ | ⊙ |
| | 68 | X-22 | Y-2 | Z-1 | 21.9 | 23.2 | ⊙ | ⊙ |
| | 69 | X-23 | Y-2 | Z-1 | 24.1 | 24.2 | ○ | ⊙ |
| | 70 | X-24 | Y-2 | Z-1 | 24.1 | 24.1 | ○ | ⊙ |
| | 71 | X-25 | Y-2 | Z-1 | 26.2 | 26.5 | ○ | ⊙ |
| | 72 | X-26 | Y-2 | Z-1 | 27.2 | 27.3 | ○ | ⊙ |
| | 73 | X-27 | Y-2 | Z-1 | 28.2 | 29.3 | ○ | ○ |
| | 74 | X-28 | Y-2 | Z-1 | 22.2 | 24.1 | ⊙ | ○ |
| | 75 | X-29 | Y-2 | Z-1 | 23.1 | 24.9 | ○ | ⊙ |
| | 76 | X-30 | Y-2 | Z-1 | 27.0 | 28.2 | ○ | ⊙ |
| | 77 | X-31 | Y-2 | Z-1 | 22.1 | 23.2 | ⊙ | ⊙ |
| | 78 | X-32 | Y-2 | Z-1 | 21.1 | 22.3 | ⊙ | ○ |
| | 79 | X-33 | Y-2 | Z-1 | 23.9 | 25.1 | ○ | ○ |
| | 80 | X-34 | Y-2 | Z-1 | 19.9 | 20.8 | ○ | ○ |
| | 81 | X-35 | Y-2 | Z-1 | 20.7 | 21.5 | ○ | ⊙ |
| | 82 | X-36 | Y-2 | Z-1 | 21.8 | 22.3 | ○ | ○ |
| | 83 | X-37 | Y-2 | Z-1 | 23.5 | 22.5 | ○ | ○ |
| | 84 | X-38 | Y-2 | Z-1 | 22.8 | 22.9 | ⊙ | ⊙ |
| | 85 | X-39 | Y-2 | Z-1 | 23.1 | 23.8 | ⊙ | ⊙ |
| | 86 | X-40 | Y-2 | Z-1 | 22.2 | 24.9 | ○ | ○ |
| | 87 | X-41 | Y-2 | Z-1 | 26.2 | 25.8 | ○ | ○ |
| | 88 | X-42 | Y-2 | Z-1 | 21.2 | 21.1 | ⊙ | ⊙ |
| | 89 | X-43 | Y-2 | Z-1 | 20.1 | 21.9 | ⊙ | ⊙ |
| | 90 | X-44 | Y-2 | Z-1 | 22.3 | 22.1 | ⊙ | ○ |
| | 91 | X-45 | Y-2 | Z-1 | 23.1 | 22.7 | ⊙ | ⊙ |
| | 92 | X-46 | Y-2 | Z-1 | 24.2 | 25.0 | ⊙ | ⊙ |
| | 93 | X-7 | Y-3 | Z-1 | 21.4 | 22.3 | ⊙ | ⊙ |
| Comparative Example | 5 | X-47 | Y-2 | Z-1 | 39.8 | 39.1 | ○ | ○ |
| | 6 | X-48 | Y-2 | Z-1 | 35.1 | 31.8 | Δ | Δ |
| | 7 | X-49 | Y-2 | Z-1 | 35.9 | 33.1 | Δ | Δ |
| | 8 | X-50 | Y-2 | Z-1 | 31.2 | 30.9 | Δ | Δ |

The invention claimed is:

1. A multilayer coating film-forming method comprising successively carrying out the following steps (1)-(4), step (1): applying a water-based first coloring paint (X) onto a coating object to form a first colored coating film, step (2): applying a water-based second coloring paint (Y) onto the uncured first colored coating film as formed in the step (1) to form a second colored coating film, step (3): applying a clear paint (Z) onto the uncured second colored coating film as formed in the step (2) to form a clear coating film, and step (4): heating to simultaneously cure the uncured first colored coating film, the uncured second colored coating film and the uncured clear coating film as formed in the steps (1)-(3), wherein the water-based first coloring paint (X) contains (A) a hydroxy-containing polyester resin, (B) a curing agent and (C) a water-dispersible acrylic resin which is obtained by polymerizing a monomer component comprising a $C_{5-22}$ alkyl-containing polymerizable unsaturated monomer (c-1), and a polymerizable unsaturated monomer (c-2) other than the polymerizable unsaturated monomer (c-1), wherein the water-dispersible acrylic resin (C) is a water-dispersible acrylic resin (C1) having a core/shell type structure formed of the core of a polymer (I) which is obtained by polymerizing a monomer component comprising 60-100 mass % of the $C_{5-22}$ alkyl-containing polymerizable unsaturated monomer (c-1) and 0-40 mass % of the polymerizable unsaturated (c-2) other than the polymerizable unsaturated monomer (c-1), and the shell of a polymer (II) which is obtained by polymerizing a monomer component comprising 45-100 mass % of $C_{1-2}$ alkyl-containing polymerizable unsaturated monomer (c-3) and 0-55 mass % of polymerizable unsaturated monomer (c-4) other than the polymerizable unsaturated monomer (c-3), wherein the core of the polymer (I) has crosslinked structure.

2. A multilayer coating film-forming method comprising successively carrying out the following steps (1), (2) and (5), step (1): applying a water-based first coloring paint (X) onto a coating object to form a first colored coating film, step (2): applying a water-based second coloring paint (Y) onto the uncured first colored coating film as formed in the step (1) to form a second colored coating film, and step (5): heating to simultaneously cure the uncured first colored coating film and the uncured second colored coating film as formed in the steps (1) and (2), wherein the water-based first coloring paint (X) contains (A) a hydroxy-containing polyester resin, (B) a curing agent and (C) a water-dispersible acrylic resin which is obtained by polymerizing a monomer component comprising a $C_{5-22}$ alkyl-containing polymerizable unsaturated monomer (c-1), and a polymerizable unsaturated monomer (c-2) other than the polymerizable unsaturated monomer (c-1), wherein the water-dispersible acrylic resin (C) is a water-dispersible acrylic resin (C1) having a core/shell type structure formed of the core of a polymer (I) which is obtained by polymerizing a monomer component comprising 60-100 mass % of the $C_{5-22}$ alkyl-containing polymerizable unsaturated monomer (c-1) and 0-40 mass % of the polymerizable unsaturated monomer (c-2) other than the polymerizable unsaturated monomer (c-1), and the shell of a polymer (II) which is obtained by polymerizing a monomer component comprising 45-100 mass % of $C_{1-2}$alkyl-containing polymerizable unsaturated monomer (c-3) and 0-55 mass % of polymerizable unsaturated monomer (c-4) other than the polymerizable unsaturated monomer (c-3), wherein the core of the polymer (I) has crosslinked structure.

3. The method according to claim 1 or 2, wherein the hydroxy-containing polyester resin (A) is a hydroxy-containing polyester resin (A1) of which combined content of the aliphatic polybasic acid and alicyclic polybasic acid is 30-97 mol %, based on the total amount of its starting acid component, and the content of the aromatic polybasic acid is 3-70 mol %, based on the total amount of its starting acid component; and the curing agent (B) is at least one alkyl-etherified melamine resin selected from the group consisting of methyl-etherified melamine resin, butyl-etherified melamine resin and methyl-butyl mixed-etherified melamine resin.

4. The method according to claim 1 or 2, wherein the polymerizable unsaturated monomer (c-1) is at least one polymerizable unsaturated monomer selected from the group consisting of 2-ethylhexyl acrylate, dodecyl methacrylate and tridecyl methacrylate.

5. The method according to claim 1 or 2, wherein the polymerizable unsaturated monomer (c-4) contains, as at least a part thereof, 1-55 mass % of hydroxy-containing polymerizable unsaturated monomer, based on the total mass of the polymerizable unsaturated monomer (c-3) and polymerizable unsaturated monomer (c-4).

6. The method according to claim 1 or 2, wherein the polymer (I) has a glass transition temperature ($Tg_1$) within a range from −65 to −10° C.

7. The method according to claim 1 or 2, wherein the water-dispersible acrylic resin (C1) contains the polymer (I) and polymer (II) at a ratio within a range of 5/95-95/5, as the solid mass of the polymer (I)/solid mass of the polymer (II).

8. The method according to claim 1 or 2, wherein the water-based first coloring paint (X) contains 20-95 mass parts of the hydroxy-containing polyester resin (A), 5-80 mass parts of the curing agent (B) and 1-100 mass parts of the water-dispersible acrylic resin (C), based on 100 mass parts in total of the hydroxy-containing polyester resin (A) and curing agent (B).

9. The method according to claim 1 or 2, wherein the water-based first coloring paint (X) further contains hydrophobic solvent (E).

10. The method according to claim 1 or 2, wherein the coating object is a car body on which an undercoating film has been formed with an electrodeposition paint.

* * * * *